US007364483B2

(12) United States Patent
Harada et al.

(10) Patent No.: US 7,364,483 B2
(45) Date of Patent: Apr. 29, 2008

(54) MARINE REVERSING GEAR ASSEMBLY

(75) Inventors: Kazuyoshi Harada, Hyogo-ken (JP); Yoshiaki Terasawa, Hyogo-ken (JP); Naoyuki Oga, Okayama-ken (JP); Hideo Misao, Hyogo-ken (JP)

(73) Assignee: Kanzaki Kokyukoki Mfg. Co., Ltd., Hyogo-ken (JP)

( * ) Notice: Subject to any disclaimer, the term of this patent is extended or adjusted under 35 U.S.C. 154(b) by 0 days.

(21) Appl. No.: 11/242,028

(22) Filed: Oct. 4, 2005

(65) Prior Publication Data

US 2006/0073747 A1 Apr. 6, 2006

(30) Foreign Application Priority Data

| | | |
|---|---|---|
| Oct. 6, 2004 | (JP) | 2004-293988 |
| Oct. 13, 2004 | (JP) | 2004-298485 |
| Oct. 13, 2004 | (JP) | 2004-298557 |
| Oct. 22, 2004 | (JP) | 2004-308603 |
| Aug. 3, 2005 | (JP) | 2005-225837 |

(51) Int. Cl.
*B60L 11/00* (2006.01)

(52) U.S. Cl. ..... 440/6; 440/75

(58) Field of Classification Search ..... 440/6, 440/75

See application file for complete search history.

(56) References Cited

U.S. PATENT DOCUMENTS

| | | | | |
|---|---|---|---|---|
| 4,209,986 | A * | 7/1980 | Cunningham | 60/403 |
| 4,343,331 | A * | 8/1982 | Tersteegen | 137/625.65 |
| 4,362,117 | A * | 12/1982 | Mishina | 114/150 |
| 4,864,210 | A * | 9/1989 | Dantlgraber | 318/625 |
| 5,509,863 | A * | 4/1996 | Mansson et al. | 475/273 |
| 2003/0204985 | A1 * | 11/2003 | Cox | 43/19.2 |

* cited by examiner

*Primary Examiner*—Stephen Avila
(74) *Attorney, Agent, or Firm*—Posz Law Group, PLC

(57) ABSTRACT

The present invention provides a marine reversing gear assembly, wherein a manual directional control valve 7*a* and an electromagnetic directional control valve 7*b* for a forward/reverse directional control valve 7 for hydraulic oil supply circuit 10 have a common structure of an oil line joint surface for the hydraulic oil supply circuit 10 for friction discs of a forward clutch 2*f* and a reverse clutch 2*a*, and the forward/reverse directional control valve 7 for the hydraulic oil supply circuit 10 can be changed to either the manual directional control valve 7*a* or the electromagnetic directional control valve 7*b* by exchanging spools 7*c* or 7*e* of the manual directional control valve 7*a* or the electromagnetic directional control valve 7*b*. Therefore, the operational manner of the forward/reverse directional control valve for the hydraulic oil supply line of a marine reversing gear assembly can be changed quite easily between the manual directional control valve and the electromagnetic directional control valve.

22 Claims, 46 Drawing Sheets

(a)

(b)

(c)

MARINE REVERSING GEAR ASSEMBLY

BACKGROUND OF THE INVENTION (1) Field of the Invention

The present invention relates to a marine reversing gear assembly.

(2) Description of the Related Art

Conventionally, a marine reversing gear assembly provided with a friction disk hydraulic clutch is known for use in small crafts, such as motorboats, fishing boats, and the like. Such a marine reversing gear assembly is disclosed in, for example, Japanese Patent Publication No. 1994-80098.

The marine reversing gear assembly is configured in such a manner that hydraulic oil pressure is applied to the friction disks of a forward clutch or a reverse clutch to press the friction disks against each other, and the rotation of an output shaft is transmitted to an input shaft, thereby forwarding and reversing crafts.

There are two means for exchanging the hydraulic oil pressure of the hydraulic clutch according to the forwarding or reversing motions. In one means, a directional control valve for hydraulic oil disposed in a hydraulic line is directly operated in a manual manner. In another means, the directional control valve is remotely controlled by operating an electromagnetic valve with an electric signal. The former means is disclosed in, for example, Japanese Patent Publication No. 1994-80098, and the latter means is disclosed in, for example, Japanese Patent Publication No. 1999-182582.

Among the above-mentioned directional control valves, the electromagnetic directional control valve is advantageous in that since remote control can be easily performed, crafts can be comfortably controlled as compared with crafts provided with the manually-operated directional control valve. However, the electromagnetic directional control valve has drawbacks in that it is susceptible to salt damage by sea water, and the function of the directional control valve tends to be spoiled by electrical shorts in the electrical circuit of the electromagnetic valve or by the malfunction of relay switches. When such failure arises, the spool of the electromagnetic valve needs to be directly operated by human power, which makes it quite difficult and troublesome to manage crafts. On the other hand, the manually-operated directional control valve is advantageous in such problems do not occur, and failures are rare.

Therefore, in view of the advantages of the forward/reverse directional control valve, requests are sometimes made to change the specifications of an already-installed directional control valve from a manual directional control valve to an electromagnetic directional control valve, or vice versa.

However, the manual directional control valve and the electromagnetic directional control valve have different spool structures. Conventionally, in order to avoid sudden engagement of the forward clutch or the reverse clutch when the forward/reverse directional control valve is changed, a kind of pressure control valve referred to as a loose-fitting valve is disposed in the hydraulic oil supply circuit. The manual directional control valve is integrally provided with a restrictor for the loose-fitting valve in its valve body, while the electromagnetic directional control valve is not provided with a restrictor. Therefore, changing the specifications of the already-installed directional control valve from a manual directional control valve to an electromagnetic directional control valve, or vice versa, requires replacing the marine reversing gear assembly itself or at least the entire oil passage block to which the directional control valve is installed. This results not only in wasting the marine reversing gear assembly itself or the parts installed therein but also requires much work for the replacement.

Small crafts, such as fishing boats, fishing leisure boats, and the like, are frequently required to travel at quite low-speeds for some uses. The following cases can be cited: stopping at fishing grounds; crafts stopping at a fixed point against a current without anchoring; traveling at a slow speed in accordance with the net hauling speed so as not to apply an excessive load to the net and to avoid tangling the net around the propeller during net hauling, etc.

As a device for achieving such travel, a marine reversing gear assembly with a trolling device provided with a friction disc hydraulic clutch is conventionally known. Such a marine reversing gear assembly with a trolling device is disclosed in, for example, Japanese Patent Publication No. 1994-80098.

The trolling device is configured in such a manner as to enable trolling by the slippage of the friction discs caused by lowering the hydraulic oil pressure applied to the friction discs of the forward clutch or reverse clutch, which can be suitably changed, and by lowering the ship speed by reducing the rotation of the output shaft to be less than that of the input shaft.

Conventionally, the hydraulic oil pressure is adjusted in a mechanical manner or in an electrical manner. More specifically, the hydraulic oil pressure is mechanically adjusted by a governor provided on a rotary shaft that is interlocked with the propeller shaft so as to rotate a propeller shaft at the number of revolutions corresponding to the ship speed during trolling. Alternatively, it is electrically adjusted by electrically detecting the number of revolutions of the propeller shaft, and electrically adjusting the hydraulic oil pressure of the hydraulic clutch to achieve the number of revolutions corresponding to the ship speed during trolling. The former case is disclosed in, for example, Japanese Patent Publication No. 1996-200405, and the latter case is disclosed in, for example, Japanese Patent Publication No. 2001-63692.

However, since the prior-art mechanical and electrical adjustment elements of the hydraulic oil pressure for trolling are different in the structure of the hydraulic oil circuit, the structure of the adjustment elements must be matched with either one of the hydraulic oil circuits at the manufacturing stage. Therefore, if the hydraulic oil adjustment element is changed from a mechanical element to an electrical element, or vice versa, after the installation thereof, the gear case itself for the trolling device must be replaced, resulting in wasting the hydraulic oil pressure adjusting element installed beforehand requiring much work for the replacement.

In some cases, trolling travel is not required depending on the intended use of the ship or craft. In that case, the mechanical or electrical hydraulic oil adjusting device installed beforehand is completely useless.

BRIEF SUMMARY OF THE INVENTION

The first object of the invention is to enable installation of either a manual directional control valve or an electromagnetic directional control valve in the same hydraulic oil supply line, thereby facilitating exchange of the valve from a manual directional control valve to an electromagnetic directional control valve, or vice versa.

The second object of the invention is to provide a marine reversing gear assembly with a trolling device configured in such a manner that either a mechanically-operated hydraulic oil pressure adjusting element or an electrically-operated hydraulic oil pressure adjusting element can be installed in one and the same hydraulic oil supply line, and when unnecessary, the hydraulic oil pressure adjusting element alone can be easily removed from the hydraulic oil supply line.

In order to achieve the above-described first object, the invention provides a marine reversing gear assembly wherein a manual directional control valve and an electromagnetic directional control valve for a forward/reverse directional control valve for a hydraulic oil supply line have a common structure of an oil line joint surface for the hydraulic oil supply lines for forward and reverse clutches, and the forward/reverse directional control valve for the hydraulic oil supply line can be changed to either the manual directional control valve or the electromagnetic directional control valve by exchanging a spool of the manual directional control valve or the electromagnetic directional control valve.

According to the invention, the manual directional control valve and the electromagnetic directional control valve can be easily changed simply by exchanging the spool in the same marine reversing gear assembly. Therefore, changing the specification of the already-installed valve from the manual directional control valve to the electromagnetic directional control valve, or vice versa, can be effected by replacing the spool, i.e., replacement of parts, which makes it possible to change the specification of the valve with great ease, no waste of parts installed beforehand, and at low cost. In this case, the spool of the electromagnetic directional control valve is also configured to shift by a manual operation in such a manner that this shift permits exchanging of the oil passage, thereby securing the safety at the time of failure.

A directional control valve for supplying hydraulic oil to a loose-fitting valve for adjusting hydraulic oil pressure that is provided for the hydraulic oil supply line may be equipped with a restrictor for adjusting the oil pressure applied to the loose-fitting valve. This makes it possible to control the operation of either the manual or electromagnetic directional control valve that is not provided with any restrictor, thereby facilitating replacement of the directional control valve.

The marine reversing gear assembly can be configured as follows:

a spool of the manual directional control valve is a cylindrical rotator to be received in a cylinder; the spool is provided on its outer peripheral surface with circumferential grooves, which corresponds to hydraulic oil communicating openings that are open at a plurality of positions on the inner surface of the cylinder, and axial grooves, which axially communicates with these circumferential grooves; the communicating state of the openings can be selected by rotating the spool around the axis inside the cylinder;

a spool of the electromagnetic valve is axially inserted in a slidable manner in an adapter sleeve to be received in the cylinder; circumferential grooves formed at the outer peripheral surface of the spool of the electromagnetic valve communicate via the adapter sleeve with the hydraulic oil communicating openings that open at a plurality of positions on the inner surface of the cylinder; and the communicating state of the openings at the inner surface of the cylinder can be selected by axially sliding the spool.

In order to adapt to a complicated oil passage, the spool of the manual directional control valve can be provided with an axially extending oil passage that is formed in the axial center and communicates with at least one of the circumferential grooves and the axial grooves, and the cylinder is provided with apertures that communicate with the axially extending oil passage. On the other hand, the adapter sleeve of the electromagnetic directional control valve can have a dual structure of an outer sleeve and an inner sleeve. The outer sleeve is provided with radial oil through passages that communicate, on the outer surface of the outer sleeve, with the hydraulic oil communicating openings formed at a plurality of positions on the inner surface of the cylinder and that open, on the inner surface of the outer sleeve, toward a concave portion for forming an oil passage. The concave portion is formed on the outer surface of the inner sleeve. The inner sleeve can be provided with radial openings that communicate with the radial oil through passages opening on the inner surface of the outer sleeve and that open at positions corresponding to the circumferential grooves formed at the outer peripheral surface of the spool that is disposed inside the inner sleeve. Further, the spool of the electromagnetic directional control valve to be received in the inner sleeve can be provided with an axially extending oil passage, and a radial opening communicating with the axially extending oil passage and the outer peripheral surface of the spool. An opening communicating with the axially extending oil passage of the spool is formed on the cylinder.

The spool of the electromagnetic directional control valve may be configured to shift in the axial direction also by a manual operation.

The marine reversing gear assembly maybe configured in such a manner that the manual directional control valve and the electromagnetic directional control valve are disposed beforehand in parallel in the hydraulic oil supply line, as a forward/reverse directional control valve for hydraulic oil supply to a friction disc of the forward and reverse clutches, and either the manual directional control valve or the electromagnetic valve can be suitably selected by a directional control valve of the oil passage. This configuration eliminates the necessity of replacing the parts, and thus makes it possible to select the wanted directional control valve simply by exchanging the oil passage. This creates an advantage such that even when the electromagnetic valve is subjected to salt damage by sea water, resulting in electrical shorts in the electrical circuit of the electromagnetic valve or malfunction of relay switches, the manual directional control valve functions as a complementary operating element, thereby enhancing the safety in traveling.

The marine reversing gear assembly can be configured such that the operation of the loose-fitting valve is controlled by a directional control valve that is operated by using oil pressure of the hydraulic oil supply line as a pilot pressure, or the operation of the loose-fitting valve is controlled by a directional control valve that is directly operated by oil pressure of the hydraulic oil supply line. When the loose-fitting valve for adjusting oil pressure of the hydraulic oil supply line is controlled by the directional control valve that is operated by using oil pressure of the hydraulic oil supply line as a pilot pressure, hydraulic oil for the loose-fitting valve can be supplied directly from a pump, thereby securing operation of the loose-fitting valve. Further, when the loose-fitting valve is operated by a directional control valve that is directly controlled by oil pressure of the hydraulic oil supply line, a pilot line can be omitted, thereby simplifying the configuration of the hydraulic lines of the invention.

A restrictor for controlling flowrate that is provided inside the directional control valve so as to control the operation of the loose-fitting valve may comprise a cylinder in which a hydraulic oil supply port and a hydraulic oil discharge port are open on the inner surface and a plurality of pistons each having a hydraulic oil guide groove, on the outer peripheral surface, extending from the hydraulic oil supply port to the hydraulic oil discharge port, wherein the restriction amount thereof is adjustable by selectively inserting into the cylinder some of the pistons each with a different capacity of the hydraulic oil guide passage in a slidable manner. This makes it possible to determine a basic restriction amount in accordance with properties of the marine reversing gear assembly or the viscosity of hydraulic oil.

In this case, the following configuration may be employed. The hydraulic oil guide groove is provided spirally on the outer peripheral surface of the piston, and the capacity of the hydraulic oil guide groove is varied by varying a spiral length. Alternatively, the capacity of the hydraulic oil guide groove is varied by varying a cross-sectional area of the hydraulic oil guide groove. This makes it possible to easily vary the length of the hydraulic oil guide groove even in one and the same piston, and the restriction amount can be variously adjusted even in a small piston.

In order to achieve the second object, the marine reversing gear assembly with a trolling device of the invention is characterized in that either a mechanically-operated hydraulic oil pressure adjusting element such as a manual adjustor or an electrically-operated hydraulic oil pressure adjusting element such as an electromagnetic valve can be applied as a hydraulic oil pressure adjusting element for trolling to be attached to a hydraulic oil supply element for supplying oil to friction discs of forward and reverse clutches, and either one of the mechanically-operated or electrically-operated hydraulic oil pressure adjusting element suitably selected can be attached to the hydraulic oil supply element. This makes it possible to install either the mechanically-operated or electrically-operated hydraulic oil pressure adjusting element for trolling on the same marine reversing gear assembly. Thus, changing the specification of the controlling element from the mechanically-operated adjusting element to the electrically-operated adjusting element, or vice versa, after the installation thereof can be effected simply by replacing the hydraulic oil pressure adjusting element, which makes it possible to change the specification with very ease, with no waste, and at low cost.

In the above configuration, the mechanically-operated hydraulic oil adjusting element and the electrically-operated hydraulic oil pressure adjusting element can have a common attachment structure to the hydraulic oil supply element, and either the mechanically-operated hydraulic oil adjusting element or the electrically-operated hydraulic oil pressure adjusting element can be attached to the one attachment site formed on the hydraulic oil supply element. Thereby, this facilitates replacement of the adjusting elements.

The attachment site on the side of the hydraulic oil supply element to which the mechanically-operated hydraulic oil pressure adjusting element or the electrically-operated hydraulic oil pressure adjusting element may be attached can be sealed with a cover. This makes it possible to deal with situations where no hydraulic oil pressure adjusting element is needed, thereby permitting a wide use of the marine reversing gear assembly with a trolling device of the invention.

Preferably, the hydraulic oil supply element comprises the hydraulic oil supply lines for the forward and reverse clutches, and a hydraulic line casing for encasing the hydraulic oil supply line is connected to a gear casing for accommodating the forward and reverse clutches.

The marine reversing gear assembly further comprises marks provided around the input/output shaft of the forward and reverse clutches and a sensor that is fixed opposite the marks and that detects the number of revolutions of an input/output shaft to the electrically-operated hydraulic oil pressure adjusting element, wherein the sensor can count the number of times that the mark passes the sensor per a certain period of time, thereby detecting the number of revolutions of the input/output shaft. Thus, digital detection of the number of revolutions can be performed, thereby securing the control of hydraulic oil.

The marks may be a dot-like magnets, and the sensor may be a magnetic sensor. The marks may be spline teeth formed at a shaft end, and the sensor may be a sensor for detecting spline teeth. When the marks are magnet and the sensor is a magnetic pickup, the magnet marks can be adhered to the rotation shaft with adhesive or a gluing agent, thereby facilitating the attachment of the accurate sensor of the number of revolutions. Thereby, the sensor can be disposed very easily even when changing from the mechanically-operated hydraulic oil pressure adjusting element to the electrically-operated hydraulic oil pressure adjusting element.

BRIEF DESCRIPTION OF SEVERAL VIEWS OF THE DRAWINGS

FIG. 15(*a*) shows one whose spiral groove is short, FIG. 15(*b*) shows one whose spiral groove is of medium length, and FIG. 15(*c*) shows one whose spiral groove is long.

DETAILED DESCRIPTION OF THE INVENTION

Figure 1:
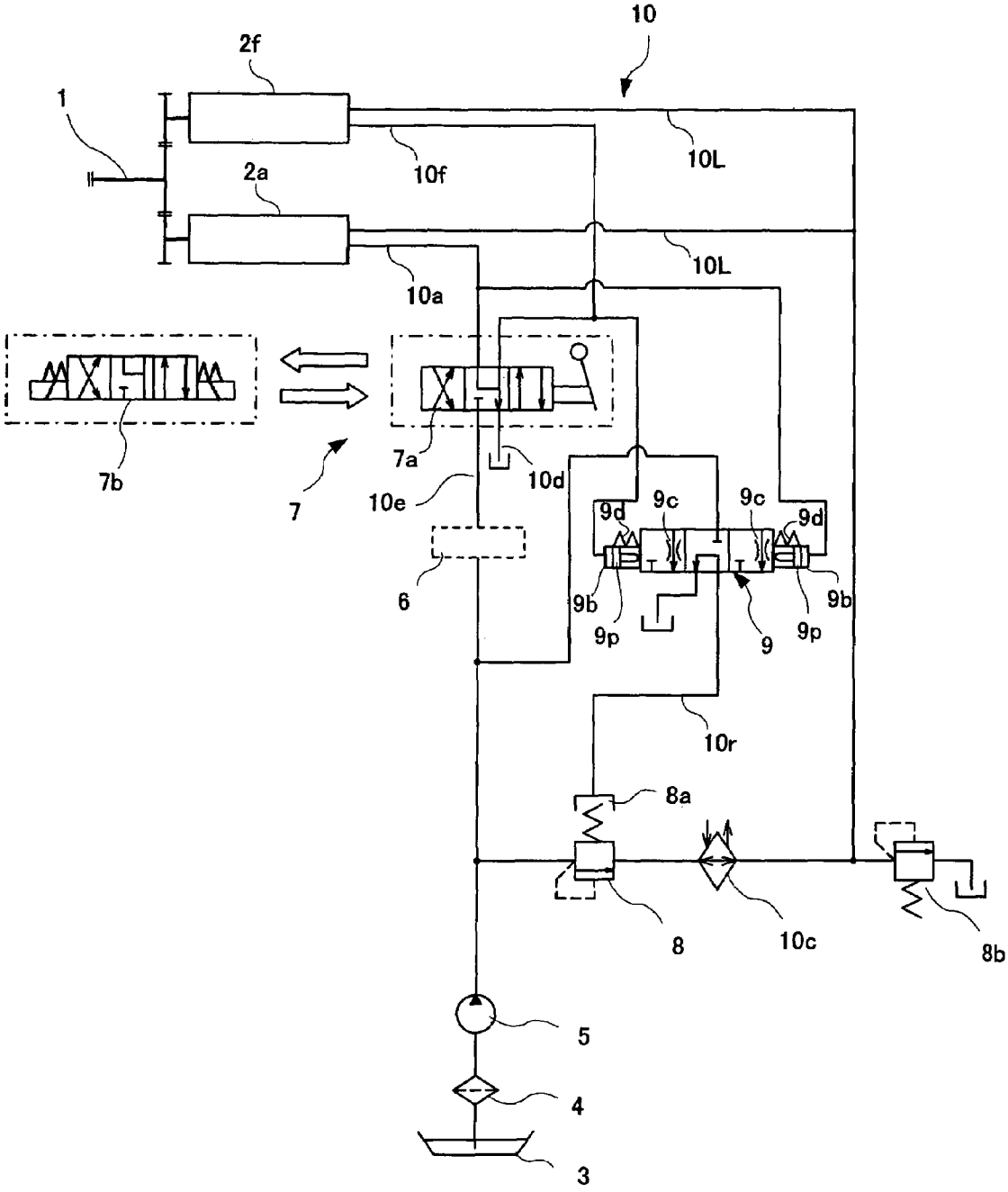
FIG. 1 is an oil-circuit diagram showing a hydraulic oil supply line of a marine reversing gear assembly according to one embodiment of the invention.

Hereinafter, a marine reversing gear assembly according to one embodiment of the invention will be described. In all of the figures, the same reference numerals denote the same constitutional elements.

FIG. 1 is an oil circuit diagram of a marine reversing gear assembly according to this embodiment of the invention. An input shaft 1 that receives drive force from an engine disposed outside the view is provided with a forward clutch 2*f* and a reverse clutch 2*a*.

Although not shown in detail, the forward clutch 2*f* and the reverse clutch 2*a* comprise friction discs and steel plates that are disposed alternately. The steel plates are connected to an inside gear, and the friction discs are connected to an outside gear that is in continuous rotation. By pressing the friction discs and steel plates against each other by a hydraulic piston, the outside gear and the inside gear rotate integrally. This rotate a large gear that engages the inside gear, thereby rotating a propeller via a propeller shaft.

Hydraulic oil for the forward or reverse clutch selectively changed via a forward-drive oil line 10*f* or a reverse-drive oil line 10*a* of a hydraulic oil supply circuit 10 is supplied to the hydraulic piston of the forward clutch 2*f* or the reverse clutch 2*a*.

As shown in FIG. 1, the hydraulic oil supply circuit 10 is provided with an oil tank 3, a filter 4, a pump 5, a low-speed valve 6, and a forward/reverse directional control valve 7. Hydraulic oil supplied from the low-speed valve 6 capable of adjusting oil pressure for low speed traveling is supplied to the forward-drive oil line 10*f* or the reverse-drive oil line 10*a* by the forward/reverse directional control valve 7, to actuate the hydraulic piston of the forward clutch 2*f* or the reverse clutch 2*a*, thereby transmitting a forward/reverse turning effect for propulsion to a propeller.

The hydraulic oil supply circuit 10 is provided with a loose-fitting valve 8 so as to avoid sudden contact between the forward clutch 2*a* and the reverse clutch 2*b* when the forward/reverse directional control valve 7 is changed.

The loose-fitting valve 8 is one kind of a pressure control valve, and hydraulic oil is supplied to the loose-fitting valve 8 through an oil line 10*r*. The hydraulic oil is supplied to the loose-fitting valve 8 from a pump 5 through a three position directional control valve 9 that is operated by using as a pilot pressure the oil pressure of the forward-drive oil line 10*f* or the reverse-drive oil line 10*a* of the hydraulic oil supply circuit 10.

The three position directional control valve 9 is provided with cylinders 9*b*, pistons 9*p*, and return springs 9*d*. Pressure oil flows to the forward-drive oil line 10*f* or the reverse-drive oil line 10*a* to increase the oil pressure inside the cylinders 9*b*, whereby one of the pistons 9*p* shifts to change the directional control valve 9. Thus, hydraulic oil whose flow rate is controlled by a restrictor 9*c* flows, and is supplied under pressure to a back chamber 8*a* of the loose-fitting valve 8 through the hydraulic oil line 10*r*. After changing the forward/reverse directional control valve 7, a relief spring of the valve 7 is gradually energized via a control piston of the valve 7 over a certain period of time, and in other words, a setting relief pressure of the loose-fitting valve 8 is gradually increased, and when the energy applied to the spring reaches a maximum, a pressure capable of completely engaging the clutch can be obtained. If oil pressure is not applied to the back chamber 8*a*, the directional control valve 9 returns to a neutral state by energized force of the return springs 9*d*, which stops flow of hydraulic oil, and thus the control piston of the loose-fitting valve 8 is reset to its original position.

More specifically, when the forward/reverse directional control valve 7 is in a neutral position (as shown in the figure), the three position directional control valve 9 is also in a neutral position, which prevents pressure oil being supplied to the back chamber 8*a* of the loose-fitting valve 8. Therefore, in this state, the spool of the loose-fitting valve 8 moves backward, and behaves as a relief valve with a low relief pressure. Part of the pressure oil supplied from the pump 5 is discharged by the relief operation of the loose-fitting valve 8, and then passed to a lubricating oil line 10L through an oil cooler 10*c*, and finally circulates to a drain of the directional control valve 7 through the forward clutch 2*f* and the reverse clutch 2*a*.

The oil pressure relieved from the loose-fitting valve 8 to the lubricating oil line 10L is kept to a setting low pressure by a lubricating oil pressure setting relief valve 8*b*.

Next, when the forward/reverse directional control valve 7 is changed to a forward or reverse position, the three position directional control valve 9 also moves towards either the right or left by the pistons 9*p* by using the oil pressure of hydraulic oil which begins to flow through the oil lines 10*f* and 10*a* as a pilot pressure. Thereby, an oil passage in the valve 7 is opened, and simultaneously the flow rate of hydraulic oil is controlled by the restrictor 9*c* disposed in the three position directional control valve 9. Therefore, the hydraulic oil is supplied under the controlled pressure to the back chamber 8*a* of the loose-fitting valve 8 via the hydraulic oil line 10*r*. The hydraulic oil supplied under the controlled pressure moves the spool forward to gradually increase relief pressure, thereby gradually closing the lubricating oil line 10L. As reflex action of the gradually closing action, each of the hydraulic oil pressure to the forward clutch 2*f* and the reverse clutch 2*a* is gradually raised, thereby avoiding sudden contact of the clutches.

Finally, the forward clutch 2*f* and the reverse clutch 2*a* are completely pressed by a high pressure, to fully transmit driving force.

In FIG. 1, reference numeral 9*c* denotes a restrictor provided inside the three position directional control valve 9, and which controls the flow rate of hydraulic oil supplied to the back chamber 8*a* of the loose-fitting valve 8 according to the dimensions of the marine reversing gear assembly and the viscosity of the hydraulic oil.

The forward/reverse directional control valve 7 to be disposed in the above-described hydraulic oil supply circuit 10 will be described.

For the forward/reverse directional control valve 7 of FIG. 1, reference numeral 7*a* denotes a manual directional control valve, and reference numeral 7*b* denotes an electromagnetic directional control valve. As shown by outlined arrows, these directional control valves can be changed for each other.

Figure 2:
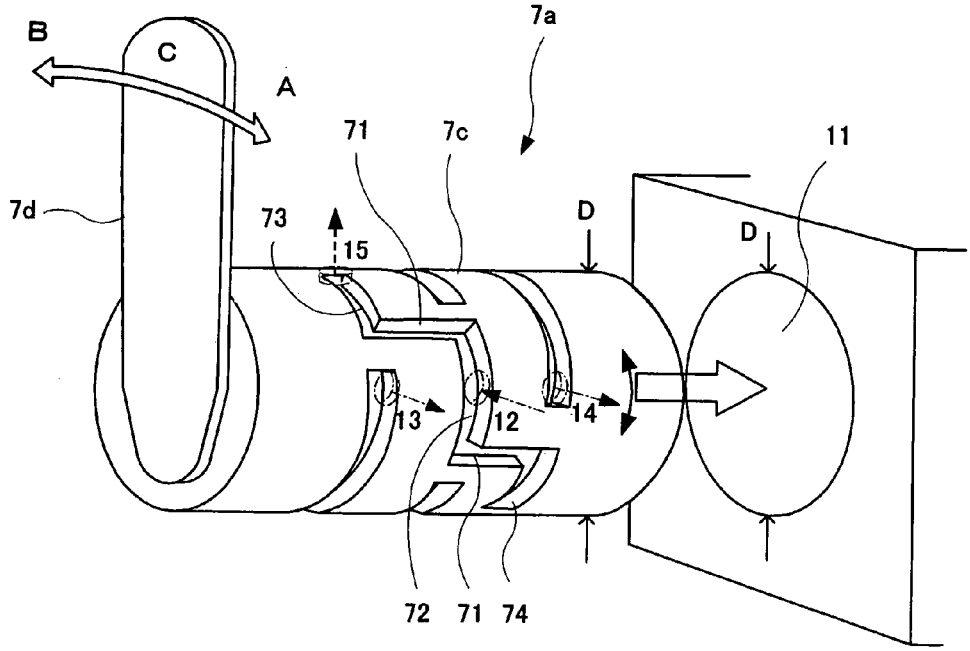
FIG. 2 is a perspective view schematically showing a manual directional control valve according to an embodiment of the invention.

As shown in FIG. 2, which schematically illustrates the structure of the manual directional control valve, the forward-drive oil line, the reverse-drive oil line, or a neutral state can be selected by rotating the spool 7*c* by a manually-operated handle 7*d*.

The spool 7*c* of the manual directional control valve 7*a* is a cylindrical rotator, and is provided with circumferential grooves 72, 73, and 74 at positions corresponding to hydraulic oil communicating openings 12, 13, 14, and 15 formed on the cylinder 11, and with axial grooves 71 axially communicating with these circumferential grooves at positions where the axial grooves communicate with adjacent circumferential grooves that shift depending on the rotation angle.

As shown in FIG. 2, when the manual handle 7*d* is in the neutral position, hydraulic oil, for example, enters from the communicating opening 12; flows through the circumferential groove 72, the axial groove 71, and the circumferential groove 73; and is discharged from the communicating opening 15 that functions as a drain port. Accordingly, the forward clutch 2*f* and the reverse clutch 2*a* are not in operation.

When the handle 7*d* is moved in the direction of arrow A so that the circumferential groove 71 is adjusted to the position of the discharge port 13, hydraulic oil entering from the communicating opening 12 as a supply port is discharged from communicating opening 13 as another discharge port via the circumferential groove 72, the axial groove 71, and the circumferential groove 73, and thus hydraulic oil flows to, for example, the forward clutch 2*f* to transmit rotation for going ahead. In this situation, the drain communicating opening 15 is closed by a surface of the spool 7*c*.

When the handle 7*d* is moved toward the direction of arrow B so that the axial groove 71 is adjusted to the position of the communicating opening 14, hydraulic oil supplied from the communicating opening 12 serving as a supply port is discharged from the communicating opening 14 via the circumferential groove 72, the axial groove 71, and the circumferential groove 74, and thus hydraulic oil flows to, for example, the reverse clutch 2*a* to transmit rotation for going astern. In this situation, the communicating opening 15 as a drain port is closed with another surface of the spool 7*c*.

Figure 3:
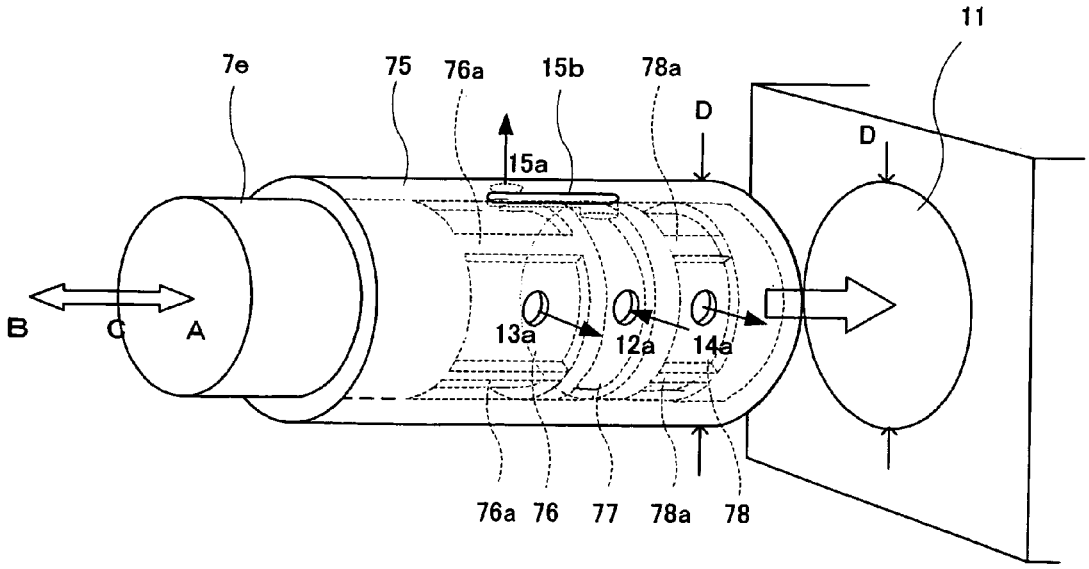
FIG. 3 is a perspective view schematically showing an electromagnetic directional control valve according to one embodiment of the invention.

The structure of the spool 7*e* of the electromagnetic directional control valve 7*b* shown in FIG. 1 is schematically shown in FIG. 3. As shown in FIG. 3, the spool 7*e* is shifted in the axial direction by an electromagnetic solenoid (not shown), thereby selecting the driving mode of forward, reverse, or neutral.

The spool 7*e* is received in the adapter sleeve 75 in a slidable manner in the axial direction. This adapter sleeve 75 comprises a cylindrical body with an outer diameter D which is the same as in the outer diameter D of the spool 7*c* shown in FIG. 2, and is provided on the circumferential surface with through holes 12*a*, 13*a*, 14*a*, and 15*a* that communicate with the hydraulic oil communicating openings 12 to 15 of the cylinder 11, respectively. Moreover, the spool 7*e* is provided on the outer peripheral surface with a circumferential groove 76 having an axial width that allows communication between the hydraulic oil communicating openings 12 and 13 and a circumferential groove 78 having an axial width that allows communication between the hydraulic oil communicating openings 12 and 14. At a position sandwiched between the circumferential grooves 76 and 78, a circumferential groove 77 is provided that allows communication in the circumferential direction between the hydraulic oil communicating openings 12 and 15. The adapter sleeve 75 is provided with an axial guide groove 15*b* for communicating the communicating opening 15 of the cylinder 11 with the circumferential groove 77. The circumferential grooves 76 and 78 are made discontinuous in the circumferential direction by partitions 76*a* and 78*a*.

As shown in FIG. 3, when the spool 7*e* is at a neutral position C in the axial direction, hydraulic oil entering from the hydraulic oil communicating opening 12 flows from the circumferential groove 77 to, for example, the communicating opening 15*a* as a drain port via the axial guide groove 15*b*, and thus the forward clutch 2*f* and the reverse clutch 2*a* do not operate.

When the operation of the electromagnetic valve shifts the spool 7*e* in the direction of arrow A in the figure so that the circumferential groove 76 covers the communicating ports 12*a* and 13*a*, hydraulic oil entering from the communicating opening 12*a* is discharged from the communicating opening 13*a* via the circumferential groove 76 to the forward clutch 2*f*, thereby transmitting rotation for going ahead. In this situation, hydraulic oil does not flow to the communicating opening 14 as a drain port because the flow is blocked by the partitions 76*a* and 76*a*.

When the operation of the electromagnetic valve shifts the spool 7*e* in the direction of arrow B in the figure so that the circumferential groove 78 covers the communicating openings 12*a* and 14*a*, hydraulic oil entering from the communicating opening 12*a* is discharged from the communicating opening 14 via the circumferential groove 78 to the reverse clutch 2*a*, thereby transmitting rotation in the reverse direction. In this case, hydraulic oil does not flow to the communicating opening 15 serving as a discharge port for drain because the flow is blocked by the partitions 78*a* and 78*a*.

As is clear from the above, either the spool 7*c* shown in FIG. 2 or the adapter sleeve 75 shown in FIG. 3 can be interexchangeably inserted in the cylinder 11.

More specifically, when the spool 7*c* is inserted in the cylinder 11, the directional control valve is a manual directional control valve 7*a*, and when the adapter sleeve 75 and the spool 7*e* are inserted therein, the directional control valve is an electromagnetic directional control valve 7*b*.

Figure 4:
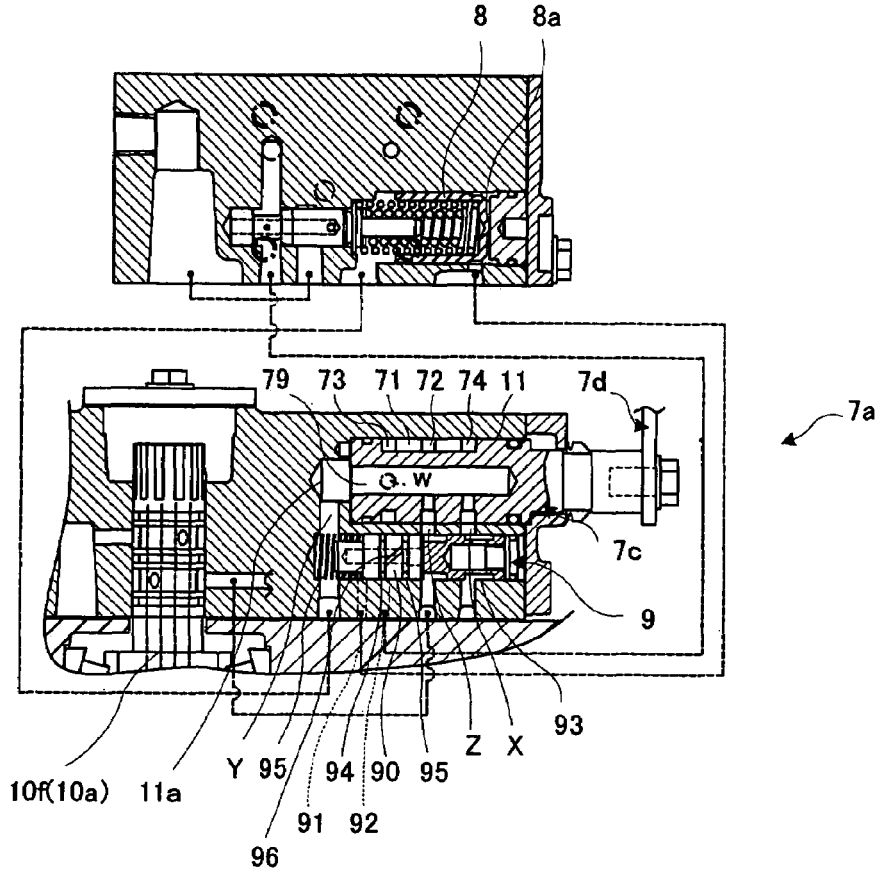
FIG. 4 is a cross-sectional view of a principal part of a marine reversing gear assembly in which a manual directional control valve is installed according to one embodiment of the invention.
Figure 5:
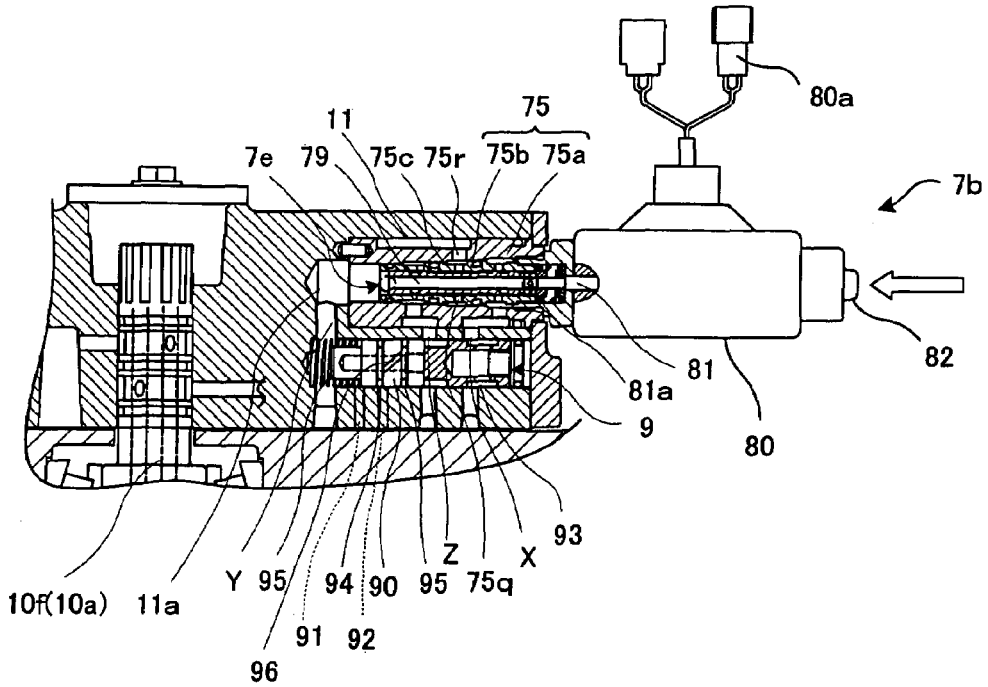
FIG. 5 is a cross-sectional view of a principal part of a marine reversing gear assembly in which an electromagnetic directional control valve is installed according to one embodiment of the invention.

FIGS. 4 and 5 show cross-sectional views of a principal part a marine reversing gear assembly in which the spool 7*c* or 7*e* is practically installed therein.

FIG. 4 shows a manual directional control valve and FIG. 5 shows an electromagnetic directional control valve. The oil line in a marine reversing gear assembly in practical use has a complicated three-dimensional line, and both the spool 7*c* shown in FIG. 4 and the spool 7*e* shown in FIG. 5 have at their axial center an axially extending passage 79 which is not shown in FIG. 2 and FIG. 3.

The spool 7*c* of the manual directional control valve shown in FIG. 4 is inserted into the cylinder 11, and is rotated around the axis while supporting the handle 7*d*, thereby changing the oil line, and thus hydraulic oil is guided to the forward-drive oil line 10*f* or the reverse-drive oil line clutch 10*a*.

Openings equivalent to the communicating openings 12 to 15 shown in FIG. 2 are indicated by w, x, y, and z in FIG. 4, and an oil line is changed to each of the openings w, x, y, and z via the circumferential grooves 72, 73, and 74, and the axial groove 71.

Reference numeral 9 denotes a hydraulic oil directional control valve for the loose-fitting valve 8, which operates by using the oil pressure of the oil lines 10*f* and 10*a* shown in FIG. 1 as a pilot pressure. Reference numeral 90 denotes a piston which constitutes a restrictor and which is provided on its outer peripheral surface with the circumferential grooves 94 and 95, and an axial groove 96 that communicates therewith. When the piston 90 shifts inside a cylinder 93 toward the left as viewed from the figure against the elastic power of a spring 95 by the oil pressure applied to the directional control valve 9, oil line openings 91 and 92 provided inside the cylinder 93 are made to communicate with the circumferential grooves 94 and 95. The flow rate of the hydraulic oil at this time is controlled by a circumferential groove 96, and the hydraulic oil is led to the back chamber 8*a* of the loose-fitting valve 8 as shown by a dotted line.

Hereinafter, the spool 7*e* of the electromagnetic directional control valve 7*b* is described.

In FIG. 5, reference numeral 80 denotes an electromagnetic solenoid device, and reference numeral 80*a* shows a wiring connector to a controller (not shown). Reference numeral 81 in the figure denotes a spindle of the electromagnetic solenoid device 80, which, at one end, is connected to the spool 7*e* with a pin 81*a*. The other end 82 of this spindle 81 projects from the electromagnetic solenoid device 80, and by pushing the spindle in the direction as indicated by an arrow, the spool can shift in the axial direction, thereby allowing manual operation of the spool. The other end 82 is also referred to as a manual push pin.

When current cannot be applied to the electromagnetic solenoid 83 due to power outage, etc., the electromagnetic directional control valve cannot be electrically controlled. In such an emergency situation, the other end 82 is kept pressed in the direction of the arrow so as to hold the clutches in engagement, thereby enabling traveling. In preparation of such emergency sailing, it is preferable to provide an emergency device to the other end 82 in some embodiments as shown in FIGS. 6 and 7 or FIGS. 8 and 9.

Figure 6:
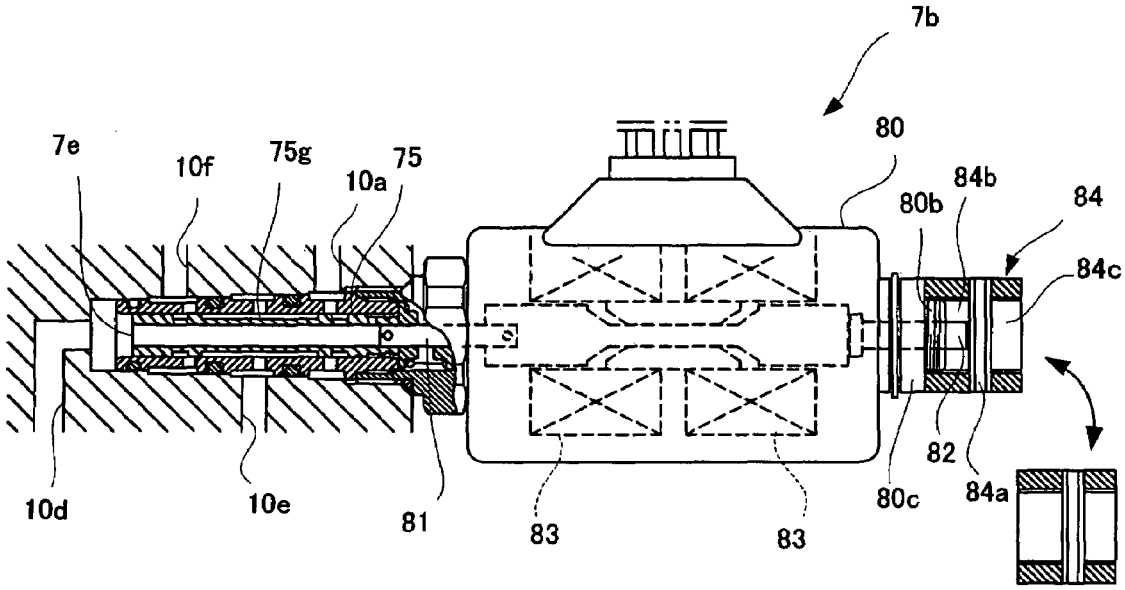
FIG. 6 is a cross sectional view of an electromagnetic directional control valve according to another embodiment of the invention.
Figure 7:
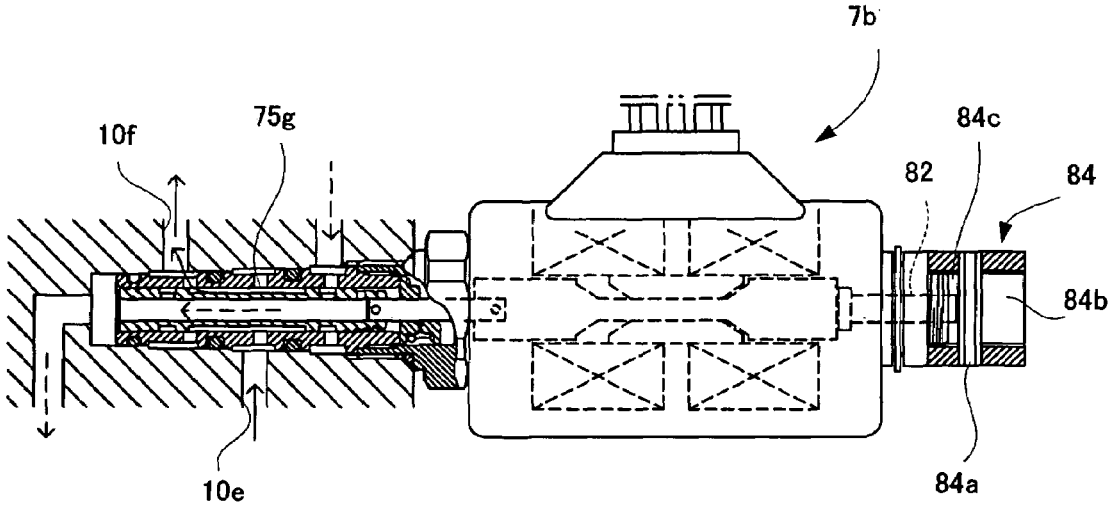
FIG. 7 is a cross sectional view showing an operating state of the electromagnetic directional control valve of FIG. 6.

An emergency nut 84 as the emergency device shown in FIGS. 6 and 7 is screwed to the electromagnetic valve 7*b* in such a manner as to be screwed to an external screwed ring 80*b* fixed to the solenoid device 80, and cover the other end 82. The emergency nut 84 is provided with a pressing member 84*a* extending transversely across its screw hole. A spring pin or the like can be used as the pressing member 84*a*. The pressing member 84*a* is offset in the axial direction with respect to the screw hole for the emergency nut 84. The screw hole of the emergency nut 84 is sectioned to a non-pressure side portion 84*b* and a pressure side portion 84*c* with the pressing member 84*a*. The distance from the axial end surface of the emergency nut 84 to the pressing member 84*a* of the non-pressure side portion 84*b* is longer than that from the axial end surface of the emergency nut 84 to the pressing member 84*a* of the pressure-side portion 84*c*. When the non-pressure side portion 84*b* is screwed to be fixed to the solenoid device 80 until the axial end surface touches a collar 80*c* fixed to the solenoid device, the pressing member 84*a* does not press the other end 82 as shown in FIG. 6. In contrast, when the pressure-side portion 84*c* is screwed to be fixed to the solenoid device, the pressing member 84*a* presses the other end 82, as shown in FIG. 7. Accordingly, in the normal state, the non-pressure side portion 84*b* is screwed to the external screwed ring 80*b*, and in the above-described emergency case, the emergency nut 84 is removed and the pressure-side portion 84*c* is screwed into the electromagnetic directional control valve. Thus, in the emergency case, as shown in FIG. 7 by the solid line, pressure oil from the pump 5 (see FIG. 1) is provided to the forward clutch through an oil line 10*e*, an outer peripheral groove 75*g* of the spool 7*e*, and an oil line 10*f*. Note that the dotted arrow in FIG. 7 denotes the flow of oil drained from the reverse clutch.

Figure 8:
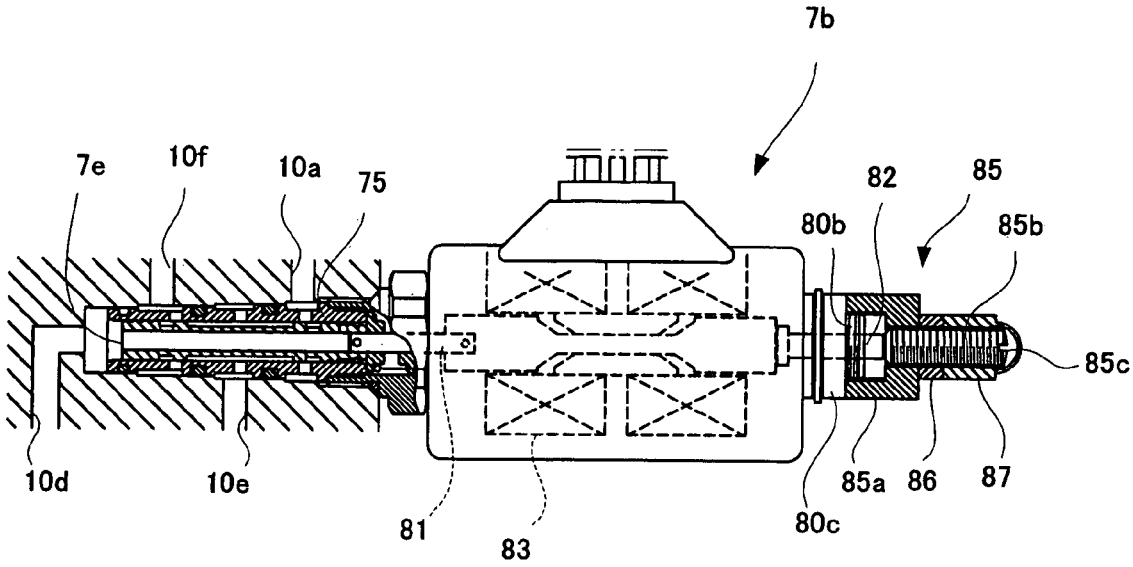
FIG. 8 is a cross sectional view of an electromagnetic directional control valve according to a still another embodiment of the invention.
Figure 9:
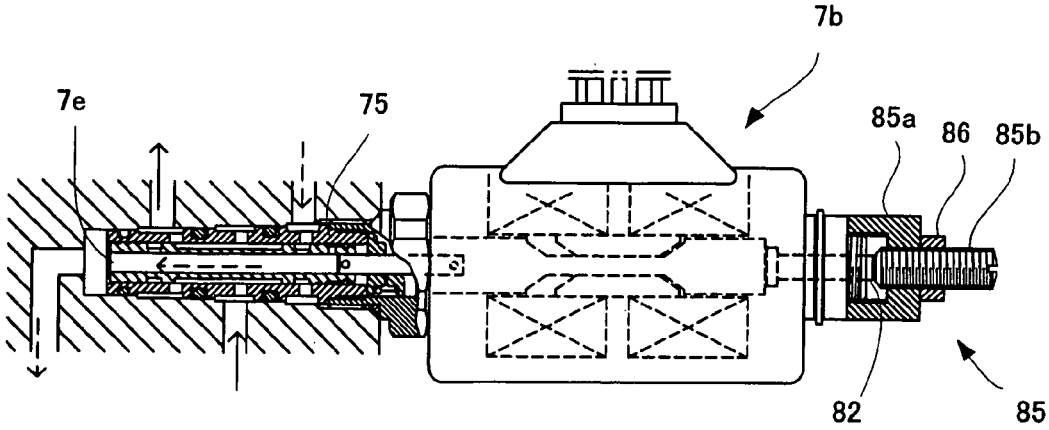
FIG. 9 is a cross sectional view of another operating state of the electromagnetic directional control valve of FIG. 8.

The emergency device 85 shown in FIGS. 8 and 9 comprises a nut 85*a* and a screw 85*b*. The nut 85*a* is screwed to the external screwed ring 80*b*, and is provided with a screw hole penetrating in the axial direction of the manual push pin which is a part of the other end 82. The screw 85*b* is screwed into the screw hole. The screw 85*b* is provided with a groove 85*c* for inserting a driver to the axial end surface. The screw 85*b* is fixed to the nut 85*a* with a nut 86, and is provided with a cap nut 87 to conceal the groove 85*c*. In the normal state, the screw 85*b* is fixed in a position so that the other end 82 is not pressed. However, in an emergency situation, the nut 86 and the cap nut 87 are unscrewed from the screw 85*b* so as to screw the screw 85*b* into the screw hole with a driver (not shown), which makes it possible to press the other end 82.

As shown in FIG. 5, the adapter sleeve 75 to receive the spool 7*e* comprises an outer sleeve 75*a* and an inner sleeve 75*b*, and oil passages that reach the circumferential grooves of the spool 7*e* from each of the openings 12 to 15 inside the cylinder 11 are formed in three dimensions.

The outer sleeve 75*a* is provided with a radially extending oil passage 75*r* that communicates, on its outer surface, with the openings w, x, y, and z formed in the inner surface of the cylinder 11, and that opens, on its inner surface, toward an oil passage forming concave portion 75*c* formed in the surface of the inner sleeve 75*b*. The inner sleeve 75*b* is provided with a radial oil through passage 75*q* that communicates with the radially extending oil passage 75*r* opening on the inner surface of the outer sleeve 75*a* and that is open at a position corresponding to a circumferential groove formed in the outer peripheral surface of a spool disposed inside the inner sleeve. An oil passage is changed to each of the openings w, x, y, and z by inserting or withdrawing the spindle 81 in the direction of either the left or right by the electromagnetic solenoid device 80.

As is clear from the above, either the spool 7*c* or the adapter sleeve 75 and the spool 7*e* can be alternatively received and fixed in the same cylinder 11, and the cylinder 11 in which either one is inserted and fixed can serve as either a manual directional control valve or an electromagnetic directional control valve.

Figure 10:
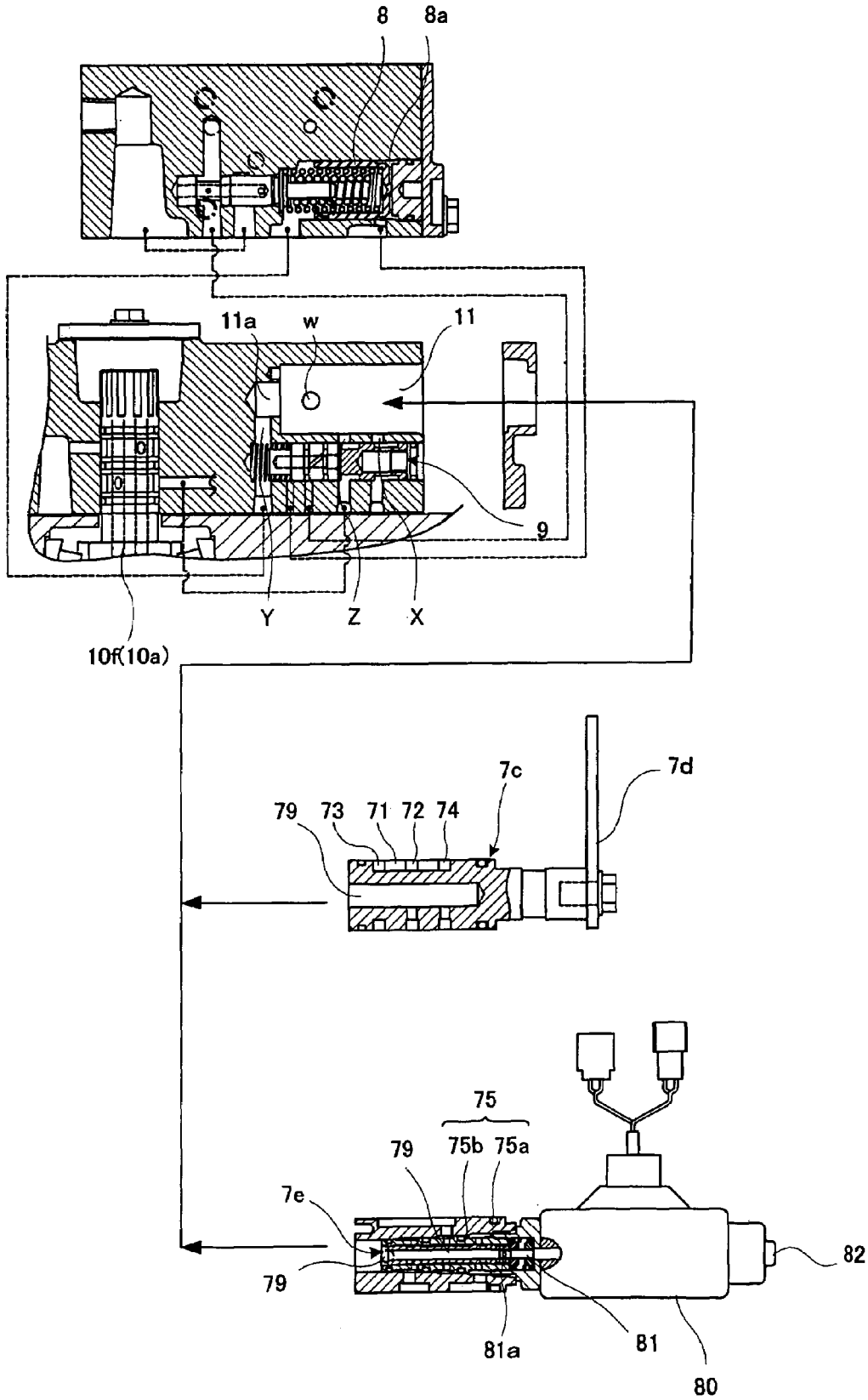
FIG. 10 is cross-sectional exploded view of a principal part of a marine reversing gear assembly in which both of a manual directional control valve and an electromagnetic directional control valve are installed according to one embodiment of the invention.

As shown in FIG. 10, the spool 7*c* or the spool 7*e* with the adapter sleeve 75 can be inserted selectively to the cylinder 11 as shown by an arrow, and a cylinder equipped with either one of them functions as a directional control valve.

The following configuration can be employed. The spool configuration is made to be exchangeable, and as shown in FIG. 11, as a forward/reverse directional control valve of hydraulic oil for the forward clutch 2*f* and the reverse clutch 2*a*, the manual directional control valve 7*a* and the electromagnetic directional control valve 7*b* are disposed in parallel in the same hydraulic oil supply circuit 10, and these directional control valves 7*a* and 7*b* may be changed by a selector valve 41 that is inserted between the hydraulic oil lines 10*a* and 10*f* extending from the directional control valves 7*a* and 7*b* to the forward clutch 2*f* and the reverse clutch 2*a*.

Figure 12:
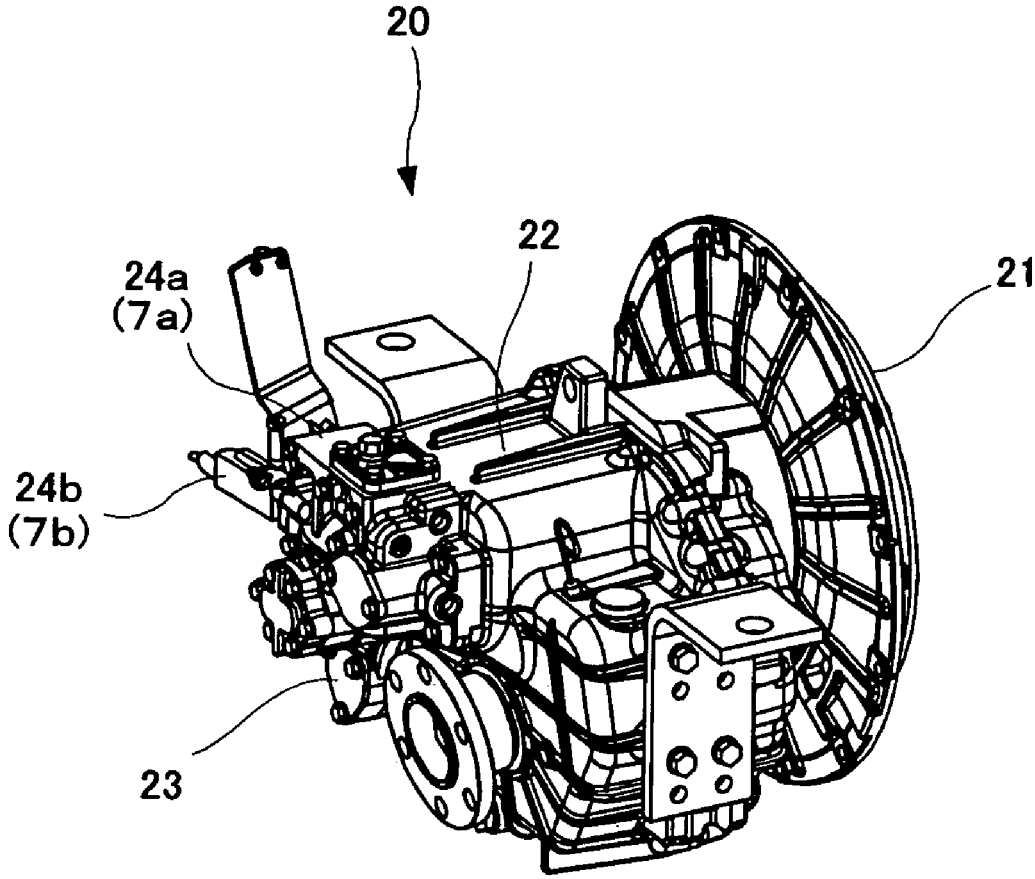
FIG. 12 is an external perspective view of a marine reversing gear assembly including the oil circuit of FIG. 11.

FIG. 12 is an external perspective view of a marine reversing gear assembly 20 that is equipped with the manual directional control valve 7*a* and the electromagnetic directional control valve 7*b*. This marine reversing gear assembly 20 is provided on its exterior with a mounting flange member 21 to be connected to the casing of a flywheel provided on an engine output shaft, a gear casing 22 accommodating the forward clutch 2*a*, the reverse clutch 2*f*, the gear, etc., and an oil line casing 23 containing a hydraulic oil supply line. The oil line casing 23 is provided with both a casing 24*a* containing the manual directional control valve 7*a* and a casing 24*b* containing the electromagnetic directional control valve 7*b*, and a directional control valve for these oil lines is provided on the back side as viewed from FIG. 12.

Figure 11:
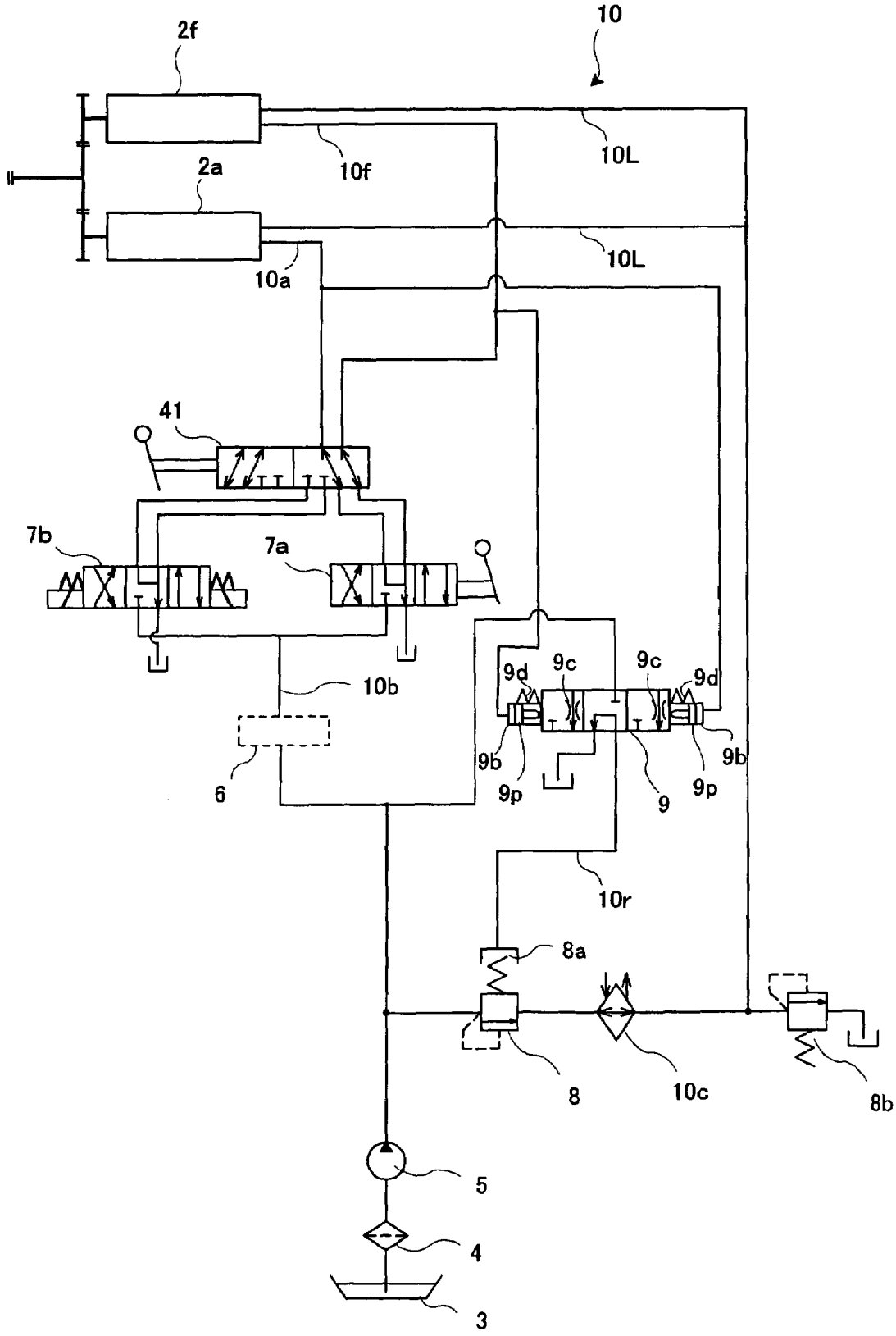
FIG. 11 is an oil-circuit diagram showing a hydraulic oil supply line configuration according to another embodiment of the invention.

In this case, changing between the manual directional control valve 7*a* and the electromagnetic directional control valve 7*b* can be rapidly conducted by changing the selector valve 41 (FIG. 11).

Figure 13:
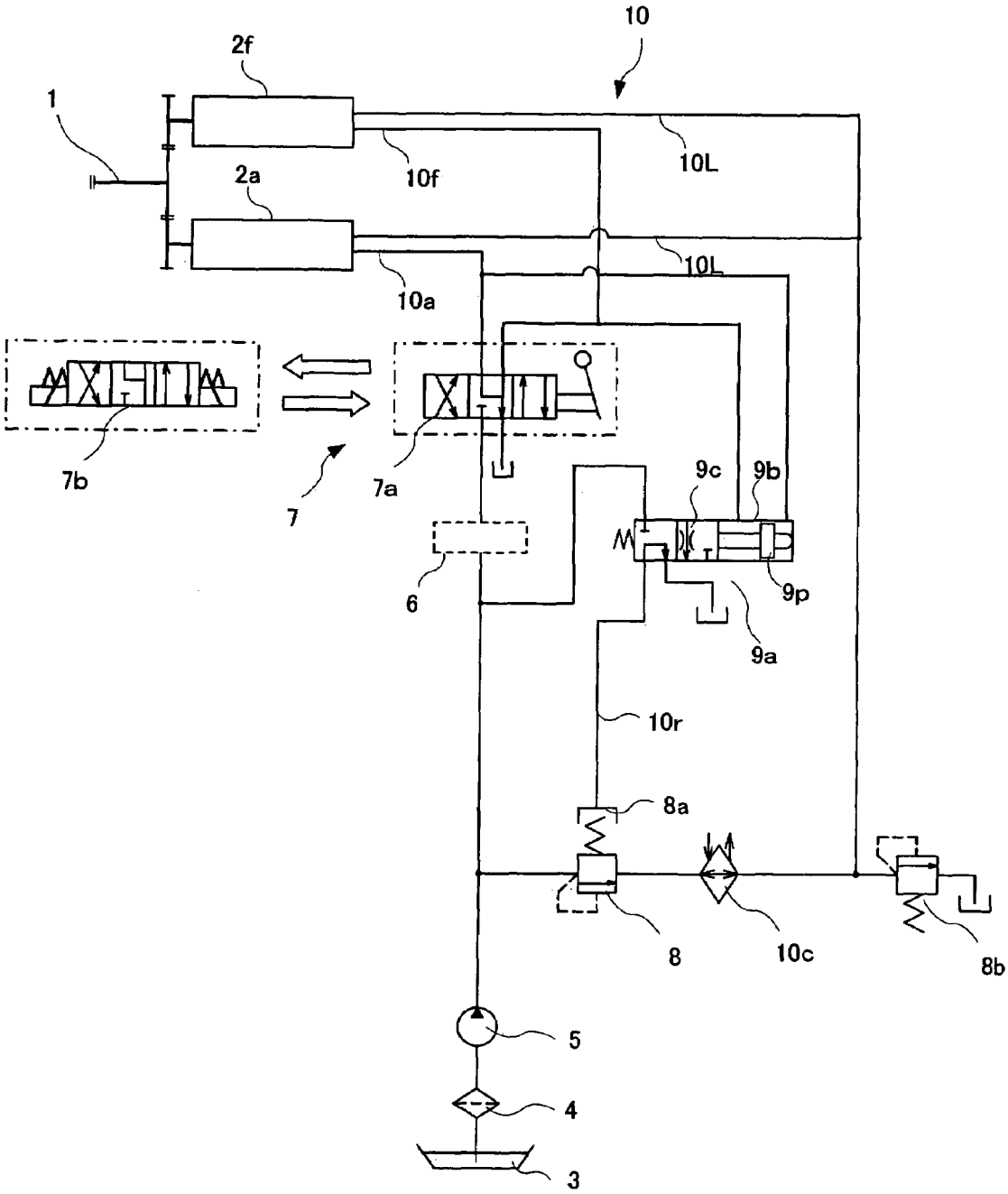
FIG. 13 is an oil-circuit diagram of a hydraulic oil supply line configuration according to yet another embodiment of the invention.
Figure 14:
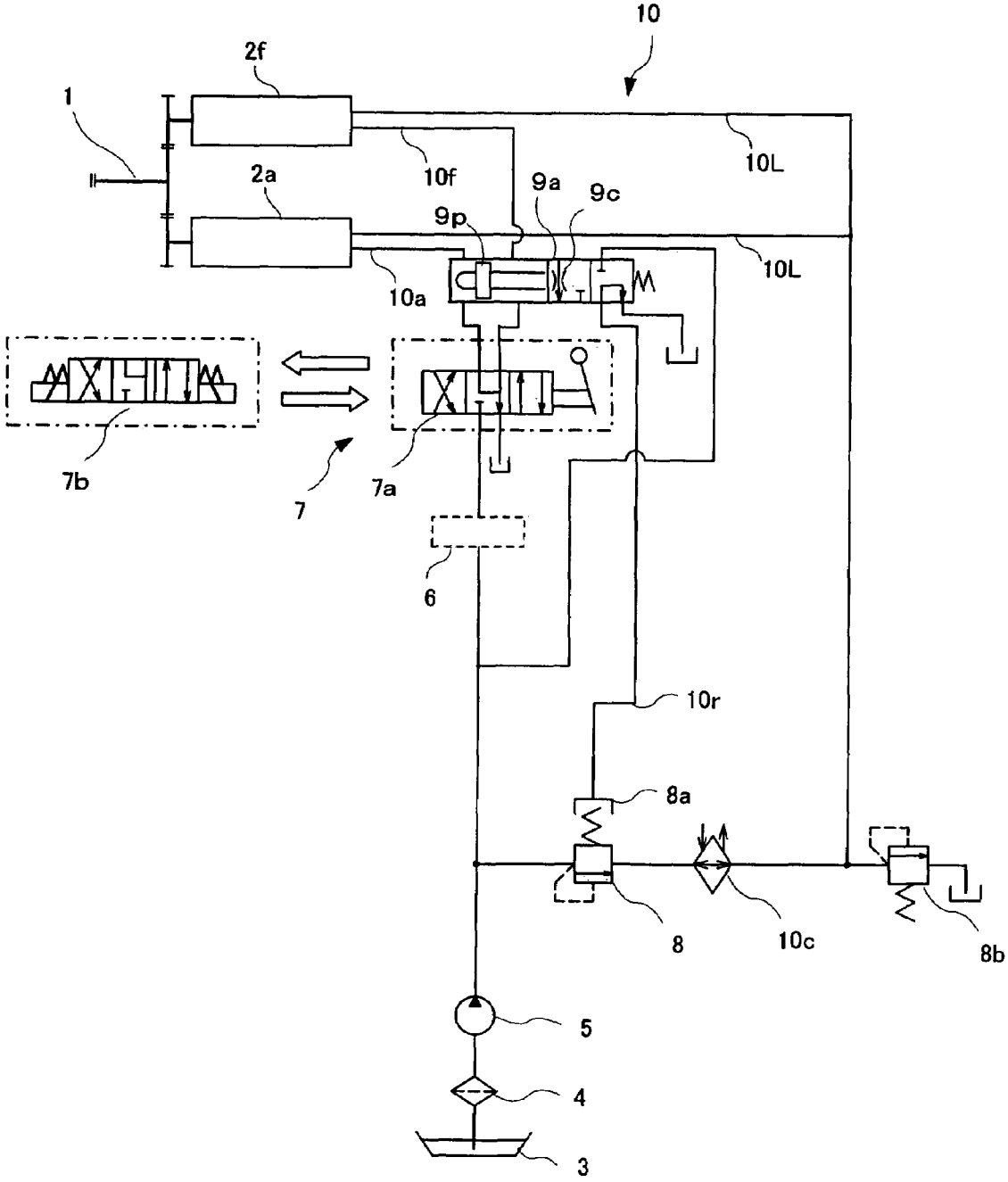
FIG. 14 is an oil-circuit diagram showing a hydraulic oil supply line configuration according to a still another embodiment of the invention.

As a control valve 9 for supplying hydraulic oil to the loose-fitting valve 8 in the hydraulic oil supply circuit 10 is described above, the following directional control valves can be employed; the three position directional control valve 9 of FIG. 1 that operates by using the oil pressure of the oil lines 10*f* and 10*a* as a pilot pressure; a two position directional control valve 9*a* as shown in FIG. 13 that operates with a cylinder 9*b* and two pistons 9*p* disposed in series by using the oil pressure of the oil lines 10*f* and 10*a* as a pilot pressure; and a two position directional control valve 9*a* as shown in FIG. 14 that operates with a cylinder 9*b* and a piston 9*p* disposed in-series by using the oil pressure itself of the oil lines 10*f* and 10*a*.

In this case, the pistons 9*p* contained inside the cylinder 9*b* are actuated directly by hydraulic oil, which obviates the necessity of a pilot hydraulic circuit.

In either case, the directional control valves 9 and 9*a* are provided with a restrictor 9*c*. This eliminates the necessity of providing a restrictor to the forward/reverse directional control valve 7, thereby achieving easier replacement of the directional control valve from the manual operation to electromagnetic operation by simply replacing just the spool.

Figure 15:
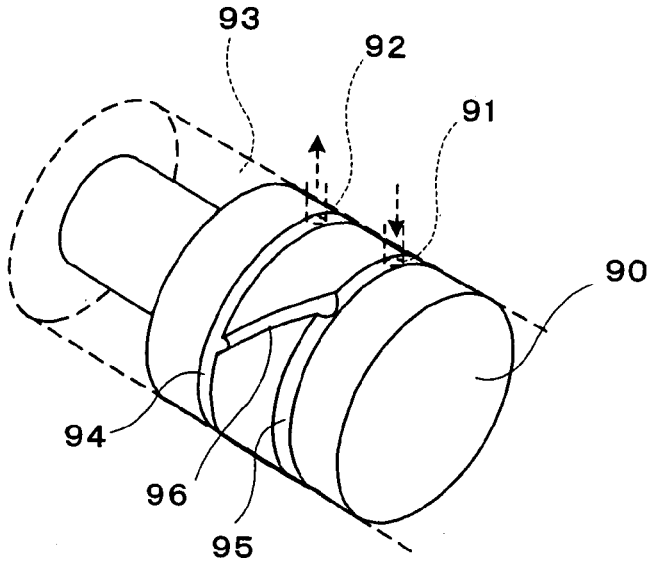
FIG. 15 is a perspective view showing a configuration of a restrictor for a hydraulic oil supply line according to one embodiment of the invention.
Figure 15:
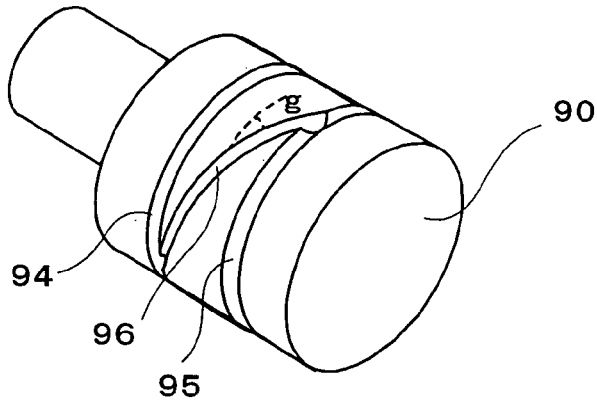
Figure 15:
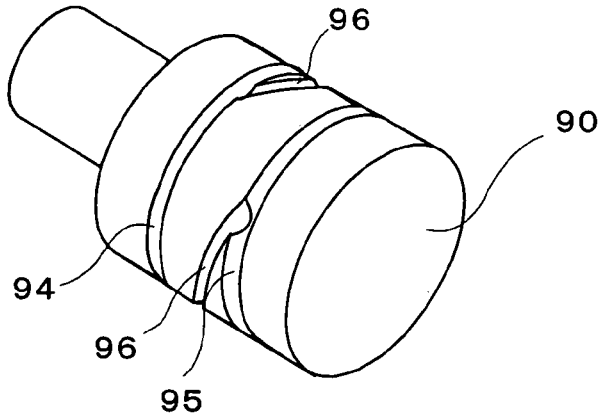

FIGS. 15(*a*) to (*c*) are perspective views showing a valve body 90 of the restrictor 9*c* shown in FIG. 4 or 5. The valve body 90 is like a piston and is to be received in a cylinder 93 provided with a hydraulic oil feed port 91 and a hydraulic oil discharge port 92 as shown by the dotted line in FIG. 15. The outer peripheral surface of the valve body 90 is provided with circumferential grooves 94 and 95 at positions corresponding to the hydraulic oil feed port 91 and the hydraulic oil discharge port 92. These circumferential grooves 94 and 95 communicate with each other by a spiral groove 96. The cylinder 93 is provided with two or more valve bodies 90 (FIG. 15 showing three examples of (a) to (c)), and the length of the spiral groove 96 is made different in each valve body 90 by varying the lead angle g of each spiral as shown in FIGS. 15(*a*) to (*c*). This length difference determines a restriction amount of hydraulic oil.

Given the same lead angle g, the restriction amount can also be adjusted also by varying not only the spiral length but also the cross-sectional area of the spiral groove. Thus, a spiral groove permits easy variation of the restriction amount over a larger range, even if a piston-like valve body, whose axial length of is short, is employed.

As described above, the forward/reverse directional control valve of the marine reversing gear assembly of the invention can be easily changed from a manual directional control valve to an electromagnetic directional control valve, or vice versa, simply by replacing the spool, i.e., replacement of parts. Moreover, a restrictor for hydraulic oil supplied to the loose-fitting valve is disposed in a directional control valve other than the forward/reverse directional control valve, which facilitates replacement of either the manual or the electromagnetic directional control valve.

When the restrictor is configured in such a manner that a spiral groove is formed in the outer peripheral surface of the piston and the flow rate of hydraulic oil is controlled by the flow passage resistance of the spiral groove, the length of the spiral groove can be extended or shortened by varying the lead angle of the spiral groove 96. Thus, even if a piston with a short axial length is employed, the flow rate can be controlled over a wide range.

Hereinafter, a marine reversing gear assembly with a trolling device according to this embodiment of the invention will be described.

Figure 16:
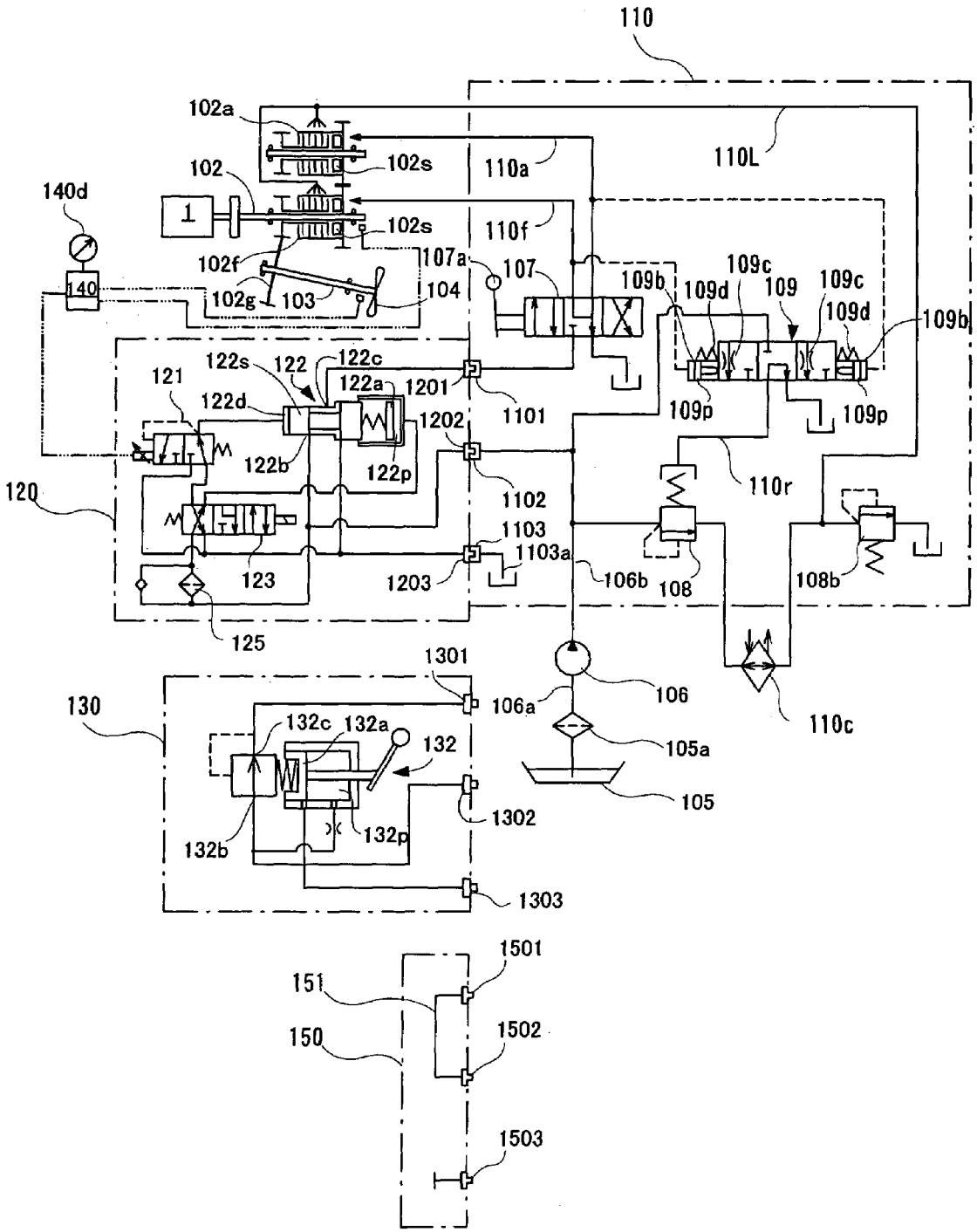
FIG. 16 is an oil-circuit diagram showing an oil circuit serving as a hydraulic oil supply element, and a hydraulic oil pressure adjusting element for a marine reversing gear assembly with a trolling device according to one embodiment of the invention.

FIG. 16 shows a hydraulic oil circuit diagram of a marine reversing gear assembly with a trolling device according to this embodiment of the invention.

An input shaft 102 from an engine 101 is provided with a forward clutch 102*f* and a reverse clutch 102*a*.

Figure 26:
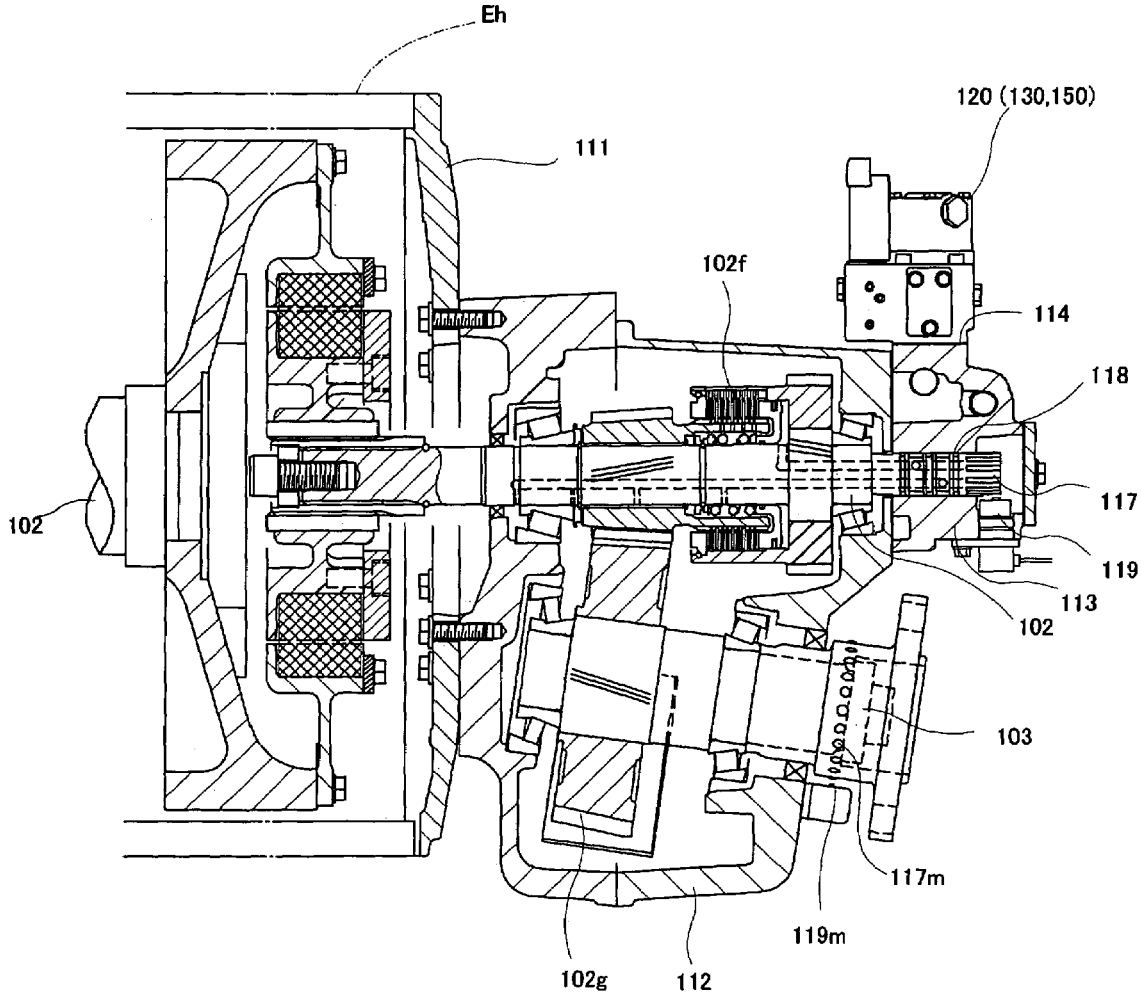
FIG. 26 is a cross-sectional view of a marine reversing gear assembly with a trolling device according to one embodiment of the invention.

Although not illustrated in detail in the figure, the forward clutch 102*f* and the reverse clutch 102*a* comprise friction discs and steel plates that are disposed alternately (see FIG. 26). The steel plates are connected to the inside gear (pinion gear), and the friction discs are connected to the outside gear that is in continuous rotation. By pressing them against each other with a hydraulic piston 102*s*, the outside gear and the inside gear integrally rotate, which rotates a large gear 102*g* which engages with the inside gear, whereby the large gear 102*g* transmits driving force to a propeller 104 via a propeller shaft 103.

By adjusting the pressure on the hydraulic piston 102*s*, the friction disc can be caused to slip on the steel plate to obtain a half-clutch state (slip engagement), thereby enabling trolling.

Hydraulic oil is supplied to the hydraulic piston 102*s* from hydraulic oil passages 110*f* and 110*a* of the hydraulic oil supply circuit 110 as a hydraulic oil supply element, and the hydraulic oil supply circuit 110 is further provided with a hydraulic oil pressure controlling circuit 120 as a hydraulic oil pressure controlling element. By adjusting the hydraulic oil pressure to be supplied to the hydraulic piston 102*s*, a half-clutch state for trolling can be obtained.

Since the hydraulic oil supply circuit 110 of FIG. 16 is configured in the same manner as in the hydraulic oil circuit shown in FIG. 1, detailed descriptions thereof are omitted.

The discharge pressure of the hydraulic pump 6 that reaches a port 1102 is regulated by the loose-fitting valve 8, and the hydraulic oil pressure from a port 1101 is regulated by a hydraulic oil pressure adjusting oil circuit 120 or the like, which is described later.

Although not shown, a three position directional control valve 109 can be used as an electromagnetic valve. In this case, the operation of the directional control valve is controlled by a detecting means (not shown) which comprises a contact switch, a pressure sensor, or the like that interlocks with the forward/reverse control lever 107*a*.

Next, the descriptions of a hydraulic oil pressure adjusting oil-circuit as a hydraulic oil pressure adjuster for trolling disposed in the hydraulic oil supply circuit 110 are given below.

The oil circuit enclosed by a chain line 120 shown in FIG. 16 is an electrically-operated hydraulic oil pressure adjusting oil-circuit, and the oil circuit similarly enclosed by a chain line 130 is a mechanically-operated hydraulic oil pressure adjusting oil-circuit.

The electrically-operated hydraulic oil pressure adjusting oil-circuit 120 is provided with a port 1202 that is joined to a port 1102 of the hydraulic oil supply circuit 110 to receive hydraulic oil, a proportional solenoid valve 121, a low-speed valve 122, a trolling directional control electromagnetic valve 123, an oil filter 125, a port 1201 that discharges hydraulic oil from the low-speed valve 122 to the port 1101 of the hydraulic oil supply circuit 110, and a controller 140 that detects the number of revolutions of an input shaft 102 and a propeller shaft 103 to determine the amount of slips of the clutch based on the difference in the number of revolutions, thereby determining the craft traveling speed for trolling. Reference numeral 140*d* of the figures denotes a dial for setting the above-mentioned amount of slips.

The controller 140 first receives an ON/OFF signal for trolling from the dial 140*d*, etc. When an OFF signal is input, an excitation signal for the trolling directional control electromagnetic valve 123 is not output. In this situation, the electromagnetic valve 123 is maintained at the position as shown in FIG. 16, hydraulic oil is supplied under pressure to a control piston chamber 122*p* of the low-speed valve 122, and is simultaneously drained through a pilot chamber 122*d* of the valve body 122*s* via the proportional solenoid valve 121. This moves a control piston 122*a* to the left from the position shown in the figure, which completely opens the valve body 1225 via a spring. Thus, the pressure oil supplied from a port 1202 into an inlet port 122*b* of the valve body 122*s* is discharged unregulated from a port 1201 via an output port 122*c*.

When an input signal for trolling is input, an excitation signal is output to the trolling directional control electromagnetic valve 123 so that the electromagnetic valve 123 moves to a port position at the right end as seen in the figure, thereby draining the control pump chamber 122*p* of the low-speed valve 122 and simultaneously introducing a pilot pressure into the pilot chamber 122*d* through the valve body 122*s* through the proportional solenoid valve 121. This controls the degree of opening of the valve body 122*s*, whereby the pressure oil supplied to the inlet port of the valve body 122*s* is reduced and then discharged from the port 1201 via an outlet port 122*c*. The amount of clutch slippage during trolling is determined based on an amount that the dial 140*d* is turned, and the controller 140 controls the proportional solenoid valve 121 by duty control according to this amount.

Hydraulic oil controlled by duty control enters the pilot chamber 122*d* of the low speed valve 122 from the proportional solenoid valve 121. The chamber 122*d* has a smaller pressure area than that of the control piston 122*a*, and the valve body 122*s* of the low-speed valve 122 is pushed to the right as viewed from the figure by the pressing force of the spring and the difference between the pressure areas to reduce the degree of opening of the inlet port 122*b*. Thus, an oil pressure inversely proportional to the pressure of the proportional solenoid valve 121 is output from the low-speed valve 122 as a control pressure. The low-speed valve 122 can thereby regulate pressure over a range of from a pressure that is regulated by the loose-fitting valve 108 so as to engage the clutch completely to a pressure reduced to approximately 0.

Reference numeral 1203 in the figure denotes a port for drain oil passage, which is connected to a port 1103 disposed in the hydraulic oil supply circuit 110. Drain oil is discharged from the port 1103 through an oil passage 1103*a*.

The mechanically-operated hydraulic oil pressure adjusting circuit 130 is provided with a port 1302 which is to be connected to a port 1102 of the hydraulic oil supply circuit 110 to receive hydraulic oil, a low-speed valve 132 equipped with a manual adjuster 132*a*, a port 1301 which is to be connected to a port 1101 of the hydraulic oil supply circuit 110 to discharge hydraulic oil, and a port 1303 for a drain line. The low-speed valve 132 adjusts the pressure of hydraulic oil introduced from the port 1302, and discharges the adjusted hydraulic oil from a port 1301. The mechanically-operated hydraulic oil pressure adjusting circuit can employ a well-known structure that controls the low-speed valve 132 using a governor, instead of the manual adjuster shown in the figure.

The low-speed valve 132 of the mechanically-operated hydraulic oil pressure adjusting circuit 130 regulates the hydraulic oil pressure over the range of from a pressure that is regulated by the loose-fitting valve 108 according to the operation amount of the manual adjuster 132*a* so as to engage the clutch completely, in the same manner as in the low-speed valve 122, to a pressure reduced to approximately 0, and transmits the adjusted pressure to the hydraulic oil supply circuit 110 via ports 1301 and 1101.

The three ports 1201, 1202, and 1203 of the electrically-operated hydraulic oil pressure control circuit 120 or the ports 1301, 1302, and 1303 of the mechanically-operated hydraulic oil pressure control oil-circuit can be suitably connected to the three ports 1101, 1102, and 1103 of the hydraulic oil supply circuit 110. After connection, the hydraulic oil pressure is adjusted and controlled by a suitably selected control method.

The oil circuit surrounded by the chain line 150 in FIG. 16 denotes a lid member, which is provided with ports 1501 and 1502 to be connected to the ports 1101 and 1102 of the hydraulic oil supply circuit 110, an oil passage 151 which bypasses between the ports 1501 and 1502, and a port 1503 which blocks the port 1103 for a drain oil passage. By connecting the port 1101 of the hydraulic oil supply circuit 110 to the port 1501, and connecting the port 1102 of the hydraulic oil supply circuit 110 to the port 1502, an oil passage of the hydraulic oil supply circuit 110 is bypassed directly from a pump 106 to a directional control valve 107. The lid member can be connected to the ports 1101 to 1103 of the hydraulic oil supply circuit 110 in the same manner as the electrically-operated hydraulic oil pressure adjusting circuit 120 or the mechanically-operated hydraulic oil pressure adjusting circuit 130.

Figure 17:
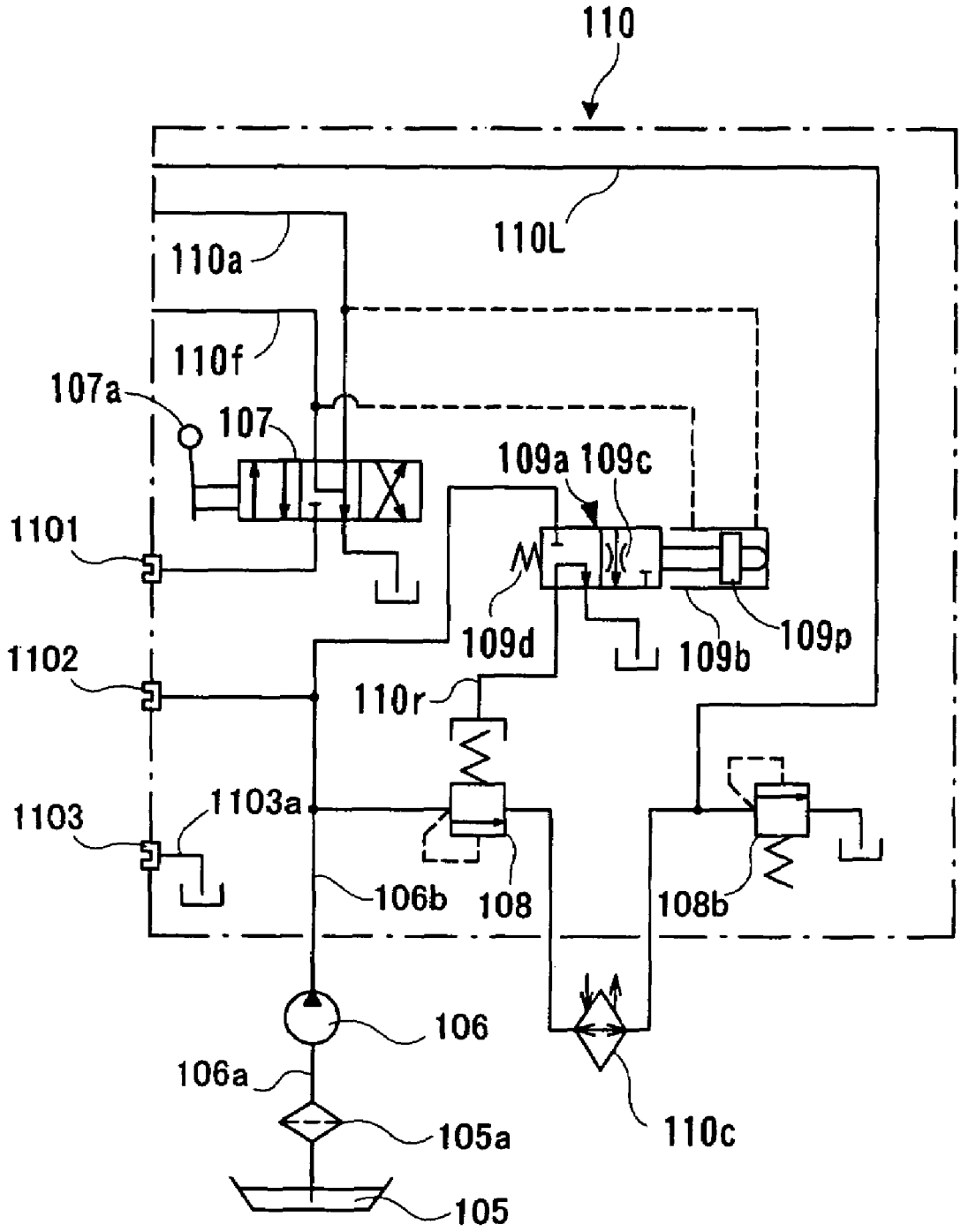
FIG. 17 is an oil-circuit diagram showing another configuration of a hydraulic oil supply element for a marine reversing gear assembly with a trolling device according to one embodiment of the invention.

FIG. 17 shows another configuration of the hydraulic oil supply circuit 110 according to the embodiment of FIG. 16. The three position directional control valve 109 of FIG. 16 is replaced by a two position directional control valve 109*a* which is operated by a cylinder piston 109*p*.

The two position directional control valve 109*a* of FIG. 17 selectively actuates the piston 109*p* inside the cylinder 109*b* by using the hydraulic oil pressure of the oil lines 110*f* and 110*a* as a pilot pressure, thereby adjusting and applying the pilot oil pressure to the loose-fitting valve 108. Since the other parts are the same as in the hydraulic oil supply circuit 110 shown in FIG. 16, their detailed descriptions are omitted by designating the same or corresponding parts by the same reference numerals.

Figure 18:
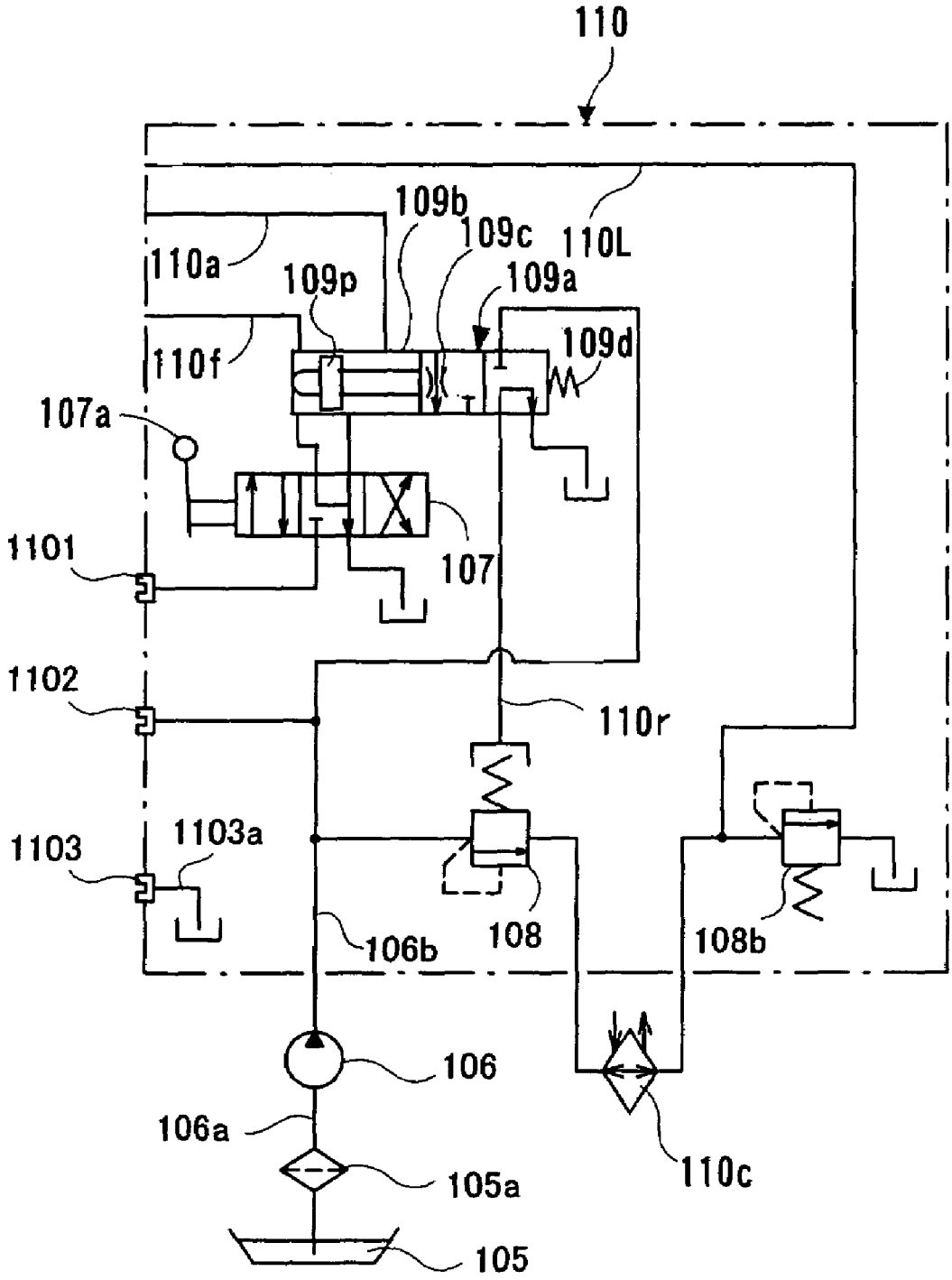
FIG. 18 is an oil-circuit diagram showing a still another configuration of a hydraulic oil supply element for a marine reversing gear assembly with a trolling device according to one embodiment of the invention.

FIG. 18 shows a still another example of the hydraulic oil supply circuit 110 according to the embodiment of FIG. 17. The two position directional control valve 109*a* shown in FIG. 17 is directly operated by the oil pressure of the oil circuits 110*f* and 110*a*. This configuration can obviate the need for the pilot pressure line shown by the dotted lines in FIG. 17, which reaches from the oil lines 110*f* and 110*a* to the two position directional control valve 109*a*.

The other parts are the same as in the hydraulic oil supply circuit 110 shown in FIG. 16, and thus their detailed descriptions are omitted by designating the same or corresponding parts by the same reference numerals.

As described above, any structure can be applied to the hydraulic oil supply circuit 110 according to the output and dimensions of the marine reversing gear assembly with a trolling device.

Figure 19:
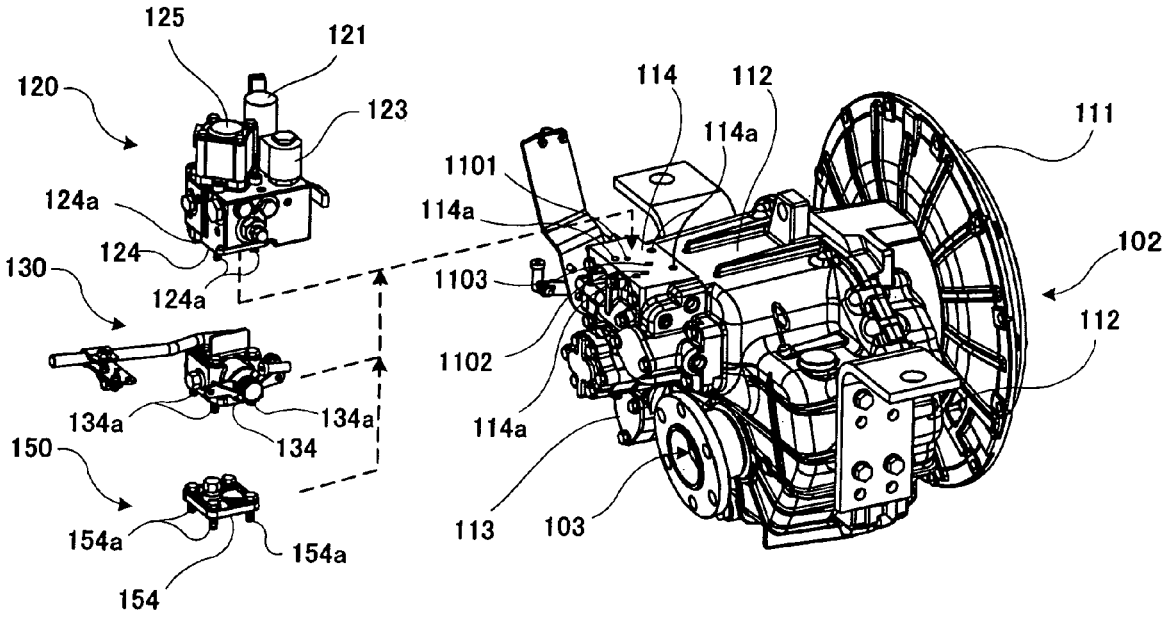
FIG. 19 is an exterior perspective view showing a marine reversing gear assembly with a trolling device according to one embodiment of the invention.

FIG. 19 shows an exterior perspective view of a marine reversing gear assembly with a trolling device that is provided with the clutches 102*a* and 102*f* and the hydraulic oil supply circuit 110. The exterior of the marine reversing gear assembly with a trolling device is provided with a mounting flange member 111 connected to an engine casing Eh (FIG. 26) accommodating an engine flywheel, a gear casing 112 accommodating the forward clutch 102*a*, the reverse clutch 102*f*, the gear 102*g*, etc., and the oil passage casing 113 accommodating the hydraulic oil supply circuit 110.

The gear casing 112 comprises two elements that can be separated and joined in the axial direction (see FIG. 26). The joint surface between the gear casing 112 and the oil passage casing 113 is shown enlarged in FIG. 20. Oil lines, and other parts that are provided at the bottom are shown by dashed lines in FIG. 20. FIG. 21 shows cross-sectional views taken along the line A to A and the line B to B of FIG. 20 together with a typical oil line.

In FIG. 21, a rotation spool 107*b* of a forward/reverse directional control valve 107 is provided on the outer peripheral surface with annular grooves 107*c* and 107*d* at both ends in the axial direction, and seal rings 160 and 161 are fitted in the annular grooves 107*c* and 107*d*, respectively. In order to keep up with the high torque of recent years, the pressure of clutch oil needs to be high so as to enhance clutch engaging force.

Hydraulic oil escapes into a drain through a gap between the outer peripheral surface of the rotation spool 107*b* of the forward/reverse directional control valve 107 and the cylindrical sliding surface 113*a* receiving the rotation spool 107*b*. The amount escaping into the drain increases in proportion to the increase in oil pressure. However, when the escaping amount excessively increases due to highly-pressurized hydraulic oil, the flow rate of oil passing the oil cooler decreases, a lubricating oil temperature is unfavorably raised, resulting in a problem of reduced durability. However, this problem can be solved by providing the seal rings 160 and 161.

Seal rings that are made of gum-like elastic materials, such as fluorocarbon rubbers, etc. and that have an approximately rectangular cross section are usable as seal rings 160 and 161. Instead of such seal rings, O rings with a circular cross section may be fitted in the annular grooves 107*c* and 107*d*.

The annular grooves in which the seal rings 160 and 161 or O rings are fitted may be formed in a cylindrical slipping surface (not shown) of the oil passage casing, instead of on the outer peripheral surface of the rotation spool 107*b*.

Figure 20:
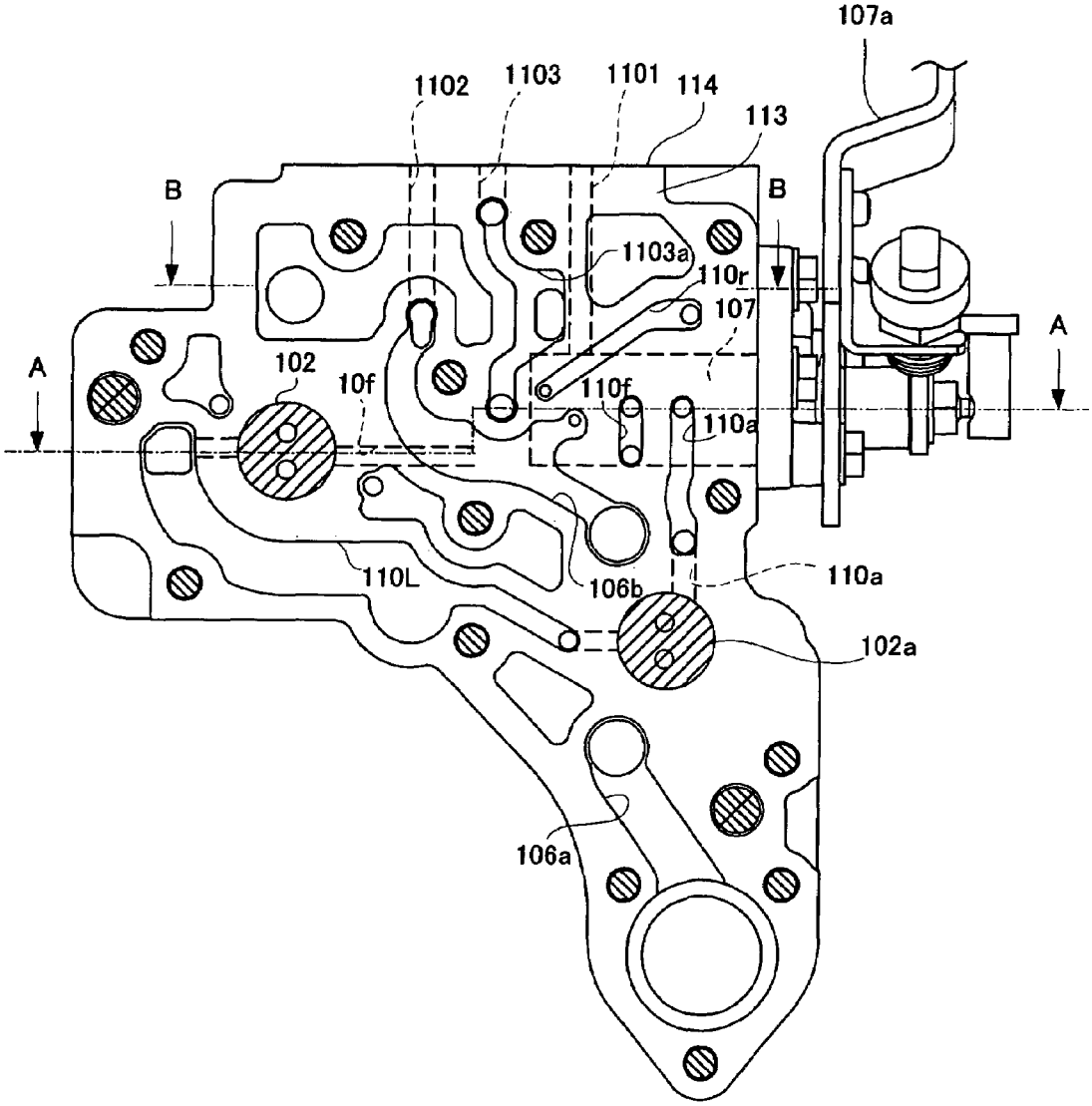
FIG. 20 is an enlarged end view of a joint surface of an oil line case and a gear case of FIG. 19.
Figure 21:
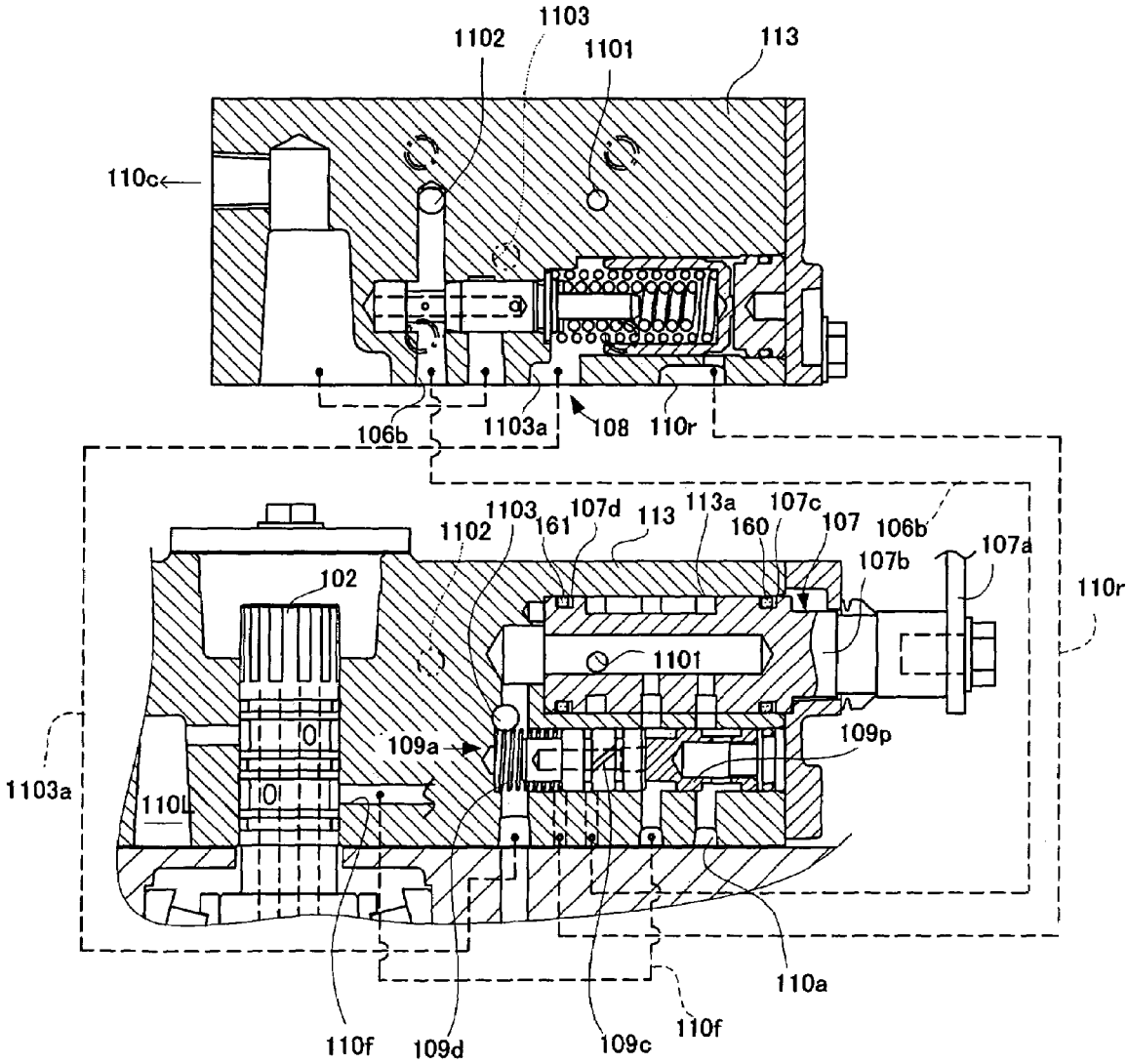
FIGS. 21 are a cross-sectional views taken along lines A to A and B to B of FIG. 20, in which an oil passage is schematically shown.

Referring to FIGS. 19 and 20, a joint surface 114 is formed in the upper surface of the oil passage casing 113. To the joint surface 114 can be suitably jointed an electrically-operated hydraulic oil pressure adjusting element comprising the electrically-operated hydraulic oil pressure adjusting oil-circuit 120 and a mechanically-operated hydraulic oil pressure adjusting element comprising the mechanically-operated hydraulic oil pressure control oil-circuit 130, or a lid body 150.

Figure 22:
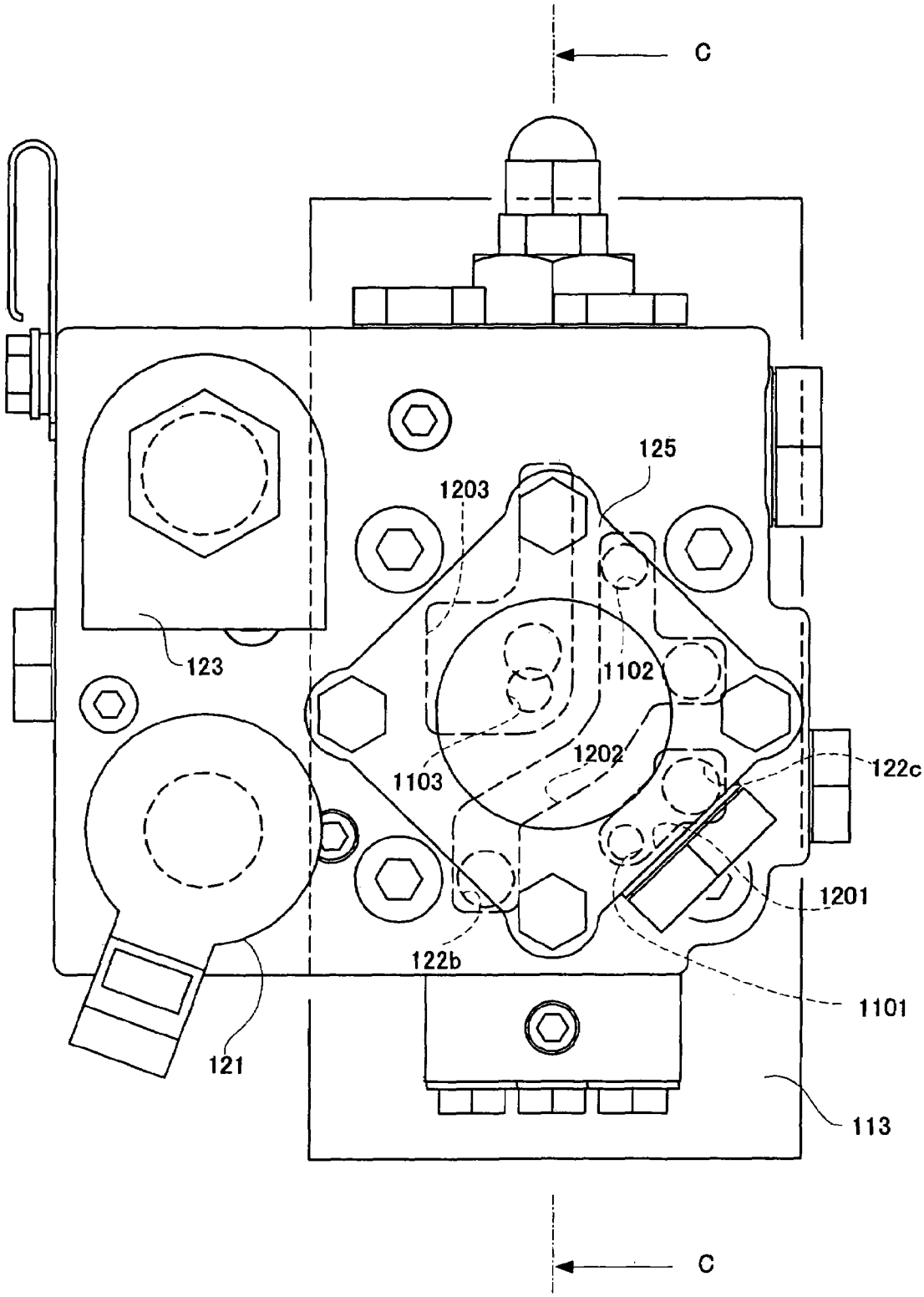
FIG. 22 is an enlarged plan view of the electrically-operated hydraulic oil pressure adjusting element of FIG. 19.
Figure 23:
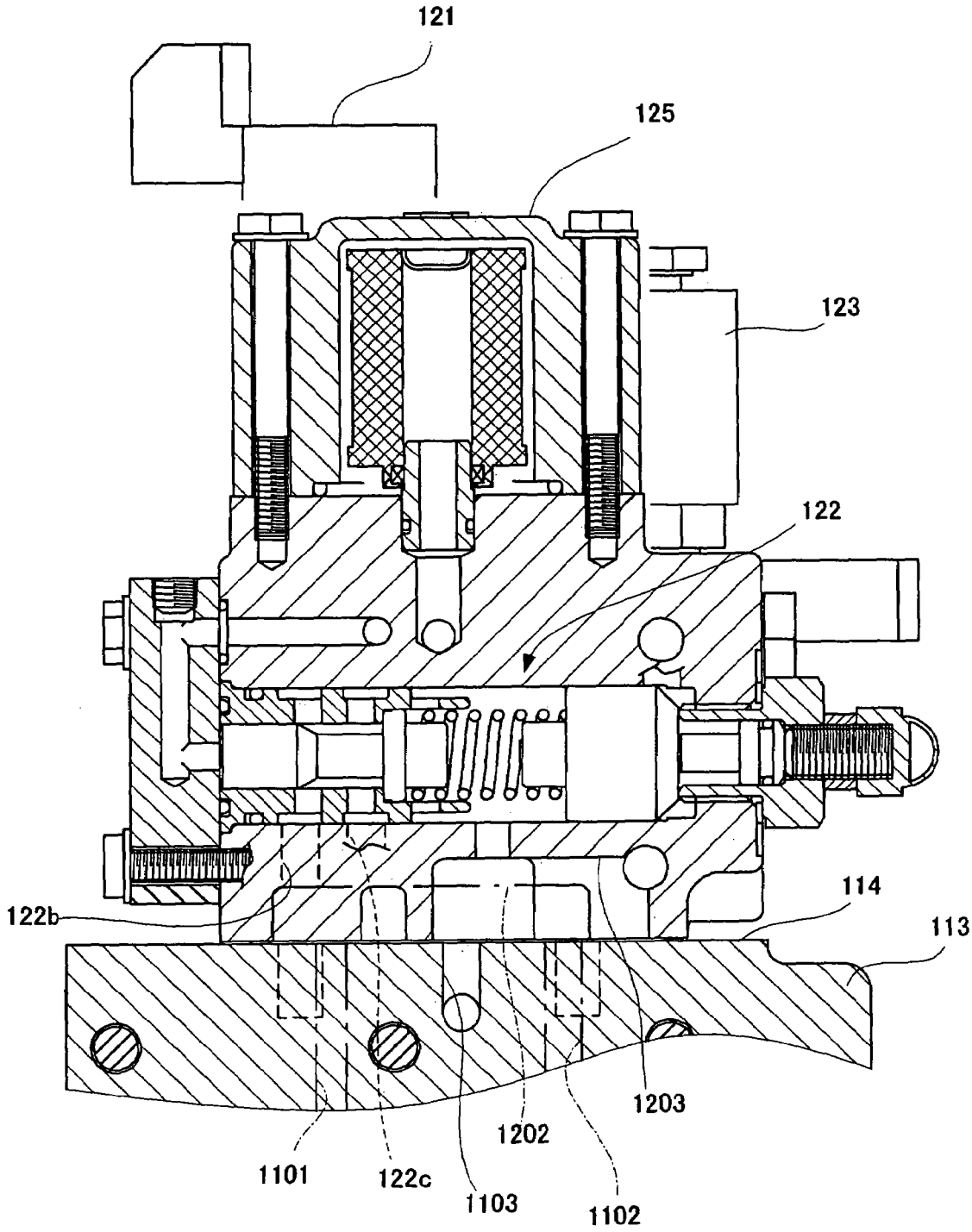
FIG. 23 is a view corresponding to a cross sectional view taken along line C to C of FIG. 22 and shows an example in which the electrically-operated hydraulic oil pressure adjusting element is installed.

FIG. 22 is a plan view showing an enlargement of the electrically-operated hydraulic oil pressure adjusting element of FIG. 19. FIG. 23 is a view corresponding to a cross section taken along the line C—C of FIG. 22, and shows a case where an electrically-operated hydraulic oil pressure adjusting element is installed on the joint surface 114.

Figure 24:
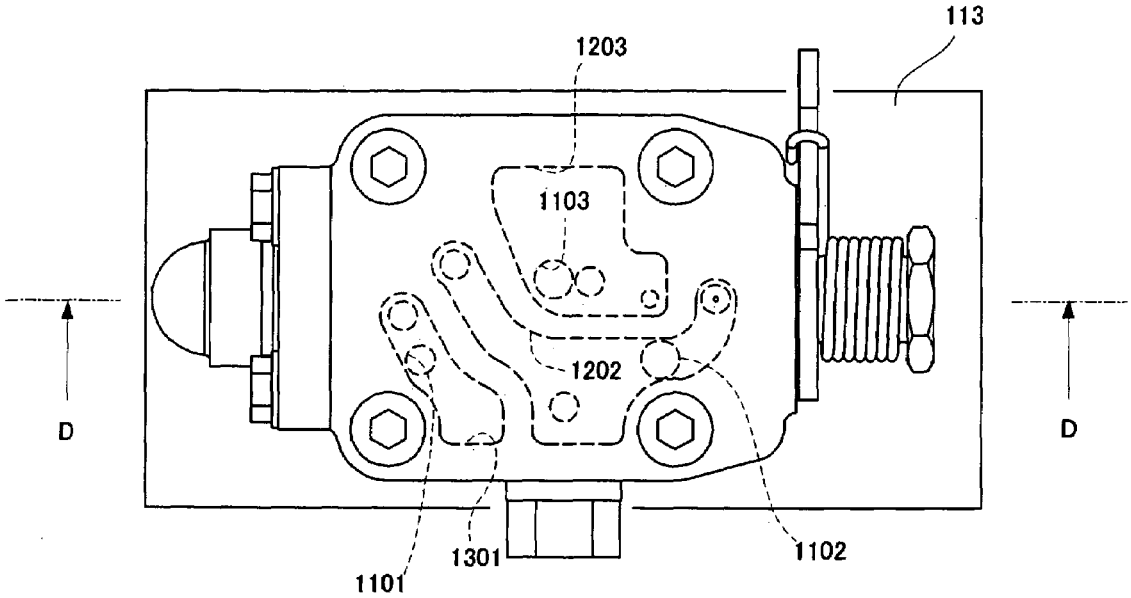
FIG. 24 is an enlarged plan view of the mechanically-operated hydraulic oil pressure adjusting element of FIG. 19.
Figure 25:
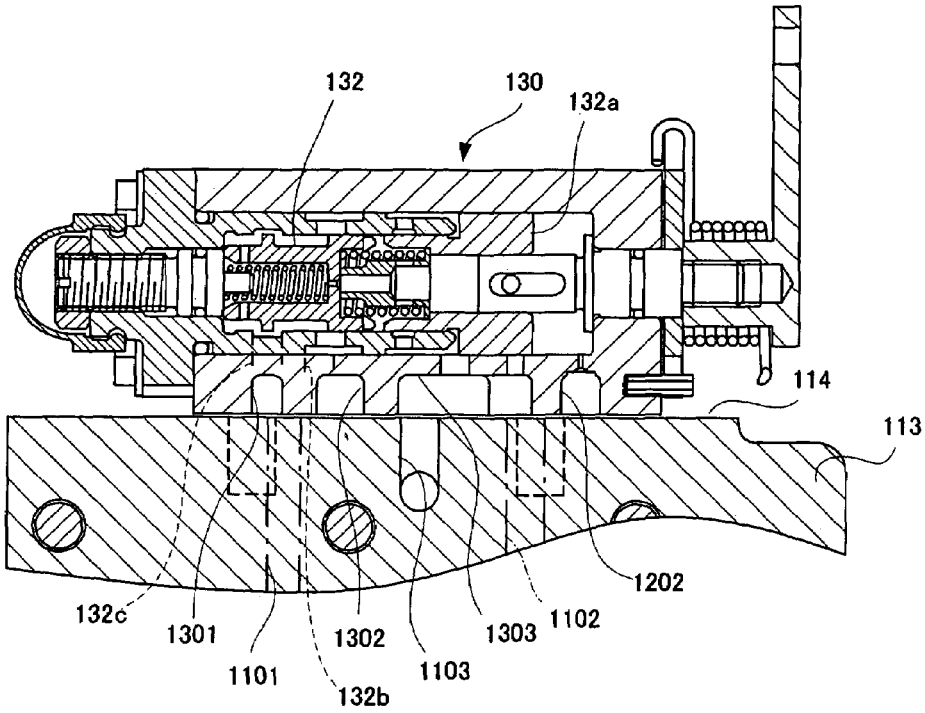
FIG. 25 is a view corresponding to a cross sectional view taken along line D to D of FIG. 24 and shows an example in which the mechanically-operated hydraulic oil pressure adjusting element is installed.

FIG. 24 is a plan view showing an enlargement of the mechanically-operated hydraulic oil pressure adjusting element of FIG. 19. FIG. 25 is a view corresponding to the cross section taken along the line D—D of FIG. 24, and shows that a mechanically-operated hydraulic oil pressure adjusting element is installed on the joint surface 114.

In FIG. 19, reference numerals 124*a*, 134*a*, and 154*a* denote attachment bolts for the oil circuits 120 and 130, and the lid body 150, respectively, and the joint surfaces are fixed by screwing the bolts into female screw holes 114*a* formed in the joint surface 114.

As shown in FIG. 19, openings serving as the ports 1102, 1101, and the drain port 1103 of the hydraulic oil supply circuit 110 are formed in the joint surface 114. As shown in FIGS. 20 to 25, openings serving as the ports corresponding thereto are also formed in the joint surfaces 124 and 134 of the electrically-operated hydraulic oil pressure adjusting oil-circuit 120 and the mechanically hydraulic oil pressure adjusting oil-circuit 130. Although the joint surface 154 of the lid body 150 is also provided with openings serving as the ports corresponding to each of the above, the openings are provided on the back side as viewed from the figure and thus not shown. Accordingly, the joint surfaces 124 to 134 of the oil circuits 120 and 130 or of the lid member 150 are connected and fixed to the joint surface 114 while positioning, whereby the ports 1201 to 1203, 1301 to 1303, and 1501 to 1503 shown in FIG. 16 are connected to the ports 1101 to 1103, respectively of the hydraulic oil supply circuit 110. Thus, hydraulic oil whose oil pressure has been adjusted or bypassed is supplied to the hydraulic oil supply circuit 110.

Accordingly, the oil pressure adjusting method for the hydraulic oil supply circuit 110 can be easily changed by exchanging an electrically-operated hydraulic oil pressure adjusting circuit 120, a mechanically-operated hydraulic oil pressure adjusting circuit 130, and a lid body 150.

Figure 27:
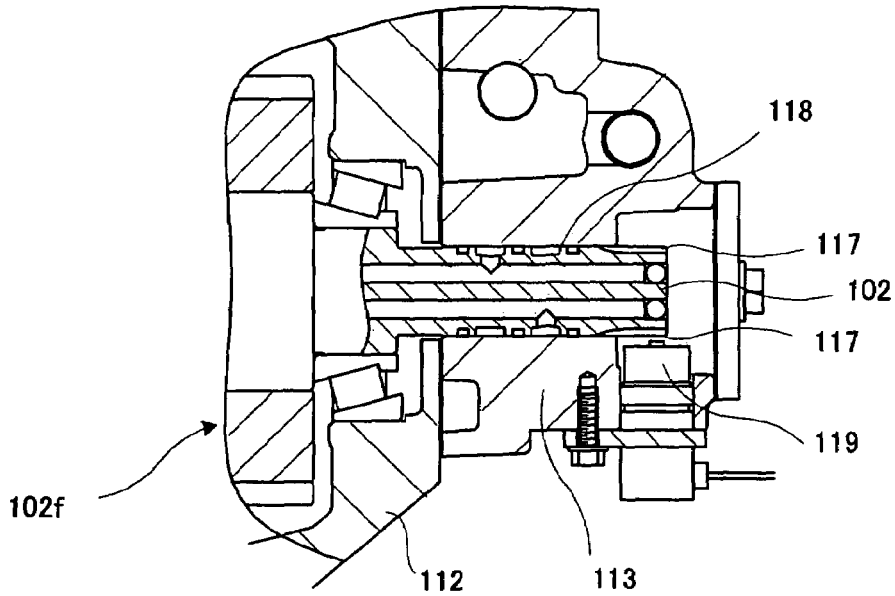
FIG. 27 is a cross-sectional view of a principal part of a marine reversing gear assembly with a trolling device according to one embodiment of the invention.
Figure 28:
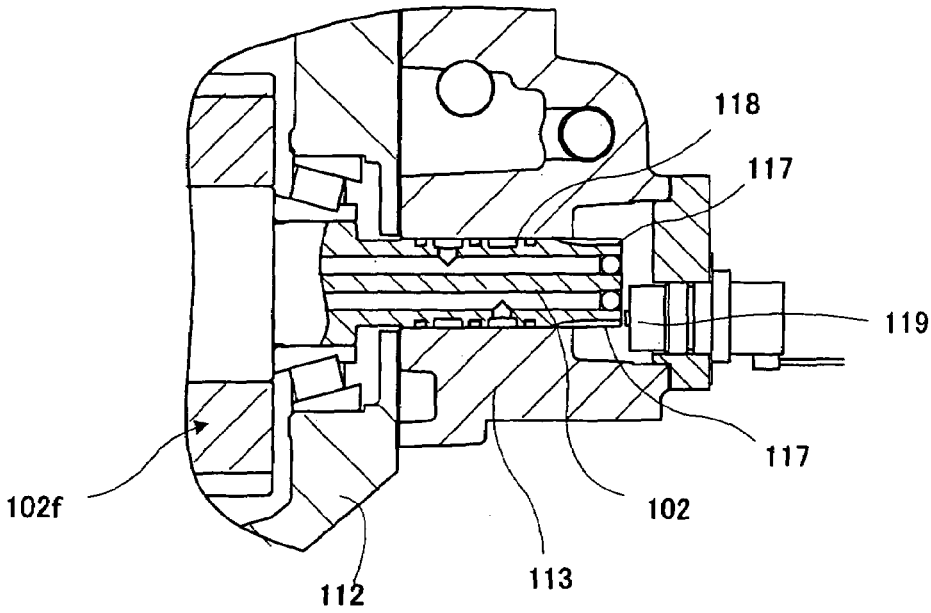
FIG. 28 is a cross-sectional view of a principal part of another configuration of a marine reversing gear assembly with a trolling device according to one embodiment of the invention.
Figure 29:
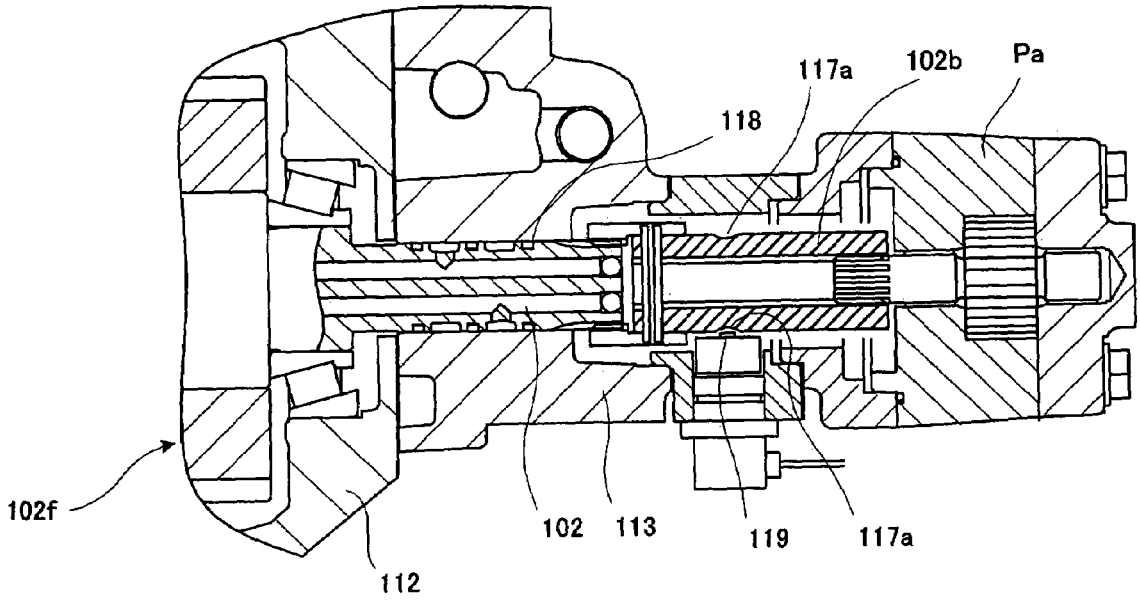
FIG. 29 is a cross-sectional view of a principal part of yet another configuration of a marine reversing gear assembly with a trolling device according to one embodiment of the invention.
Figure 30:
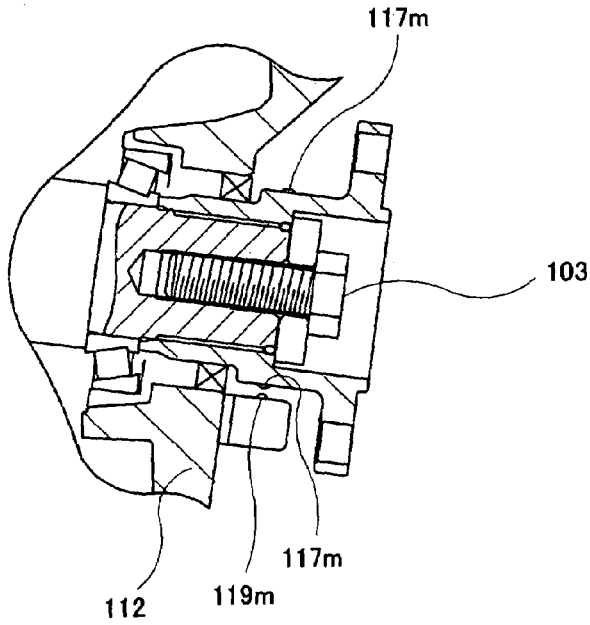
FIG. 30 is a cross-sectional view of a principal part of a still another configuration of a marine reversing gear assembly with a trolling device according to one embodiment of the invention.

When an electrically-operated hydraulic oil pressure adjusting circuit 120 is disposed in the marine reversing gear assembly with a trolling device according to the above-described embodiment, the number of revolutions of the input shaft 102 or the propeller shaft 103 need to be detected as an electric signal as shown in FIG. 16. FIGS. 26 to 30 show a detection structure for this case. FIGS. 26 to 28 show embodiments where objects to be detected are disposed on the input shaft 102, and FIGS. 29 and 30 show embodiments where objects to be detected are disposed on the propeller shaft 103.

In FIGS. 26 and 27, an annular groove 118 for supplying hydraulic oil or lubricating oil for the forward clutch 102*f* is provided on the outer peripheral surface of the input shaft 102 to be inserted into the oil passage casing 113, and the oil circuit 110*a* and the lubricating oil line 110L contained in the oil casing 113 are connected to the annular groove 118. At the shaft end, concavities 117 (spline teeth are employed in the Examples) extending in the axial direction are formed at equal intervals along the circumferential direction, and a sensor 119, such as a magnetic pickup or the like, for detecting the concavities formed in the oil passage casing 113. The sensor 119 counts the number of times that the concavities pass the sensing area per a certain period of time while the input shaft 102 rotates, thereby detecting the number of revolutions of the input shaft. The sensor 119 may be disposed on the engine 101 so as to directly detect the number of revolutions of its crankshaft. However, in view of production control, it is more efficient to localize all of the elements for the trolling device on the marine reversing gear assembly.

The sensor 119 for detecting the concavities 117 may be disposed in the radial direction as shown in FIGS. 26 and 27, or, may be disposed at the end of the input shaft 102 in parallel to the axial direction with respect to the concavities 117 as shown in FIG. 28. When a sleeve 102*b* serving as a PTO (power take off) shaft for driving an auxiliary oil pressure pump Pa is attached to the outer end of the input shaft 102 as shown in FIG. 29, concavities 117*a* are formed at equal intervals on the outer peripheral surface of the sleeve 102*b*, and the sensor 119 is arranged in the oil passage casing 113 opposite the concavities. Thus, the sensor 119 counts the number of times that the concavities pass the detecting area per a certain period of time while the input shaft 102 rotates, thereby detecting the number of revolutions of the input shaft 102.

FIGS. 26 and 30 show a case where objects to be detected are disposed on a propeller shaft. As shown in the figures, dot-like permanent magnets are attached to the outer peripheral surface of the propeller shaft 103 (corresponding to the shaft coupling portion for a propeller 104 in the figures) at fixed intervals in the circumferential direction, and a sensor 119*m*, such as a magnetic pickup (MR sensor) or the like, is located opposite to the permanent magnets 117*m* of the gear casing 112. Thus, the sensor 119*m* counts the number of times that the permanent magnets pass the detecting area per a certain period of time while the propeller shaft 103 rotates, thereby detecting the number of revolutions of the propeller shaft 103.

Figure 31:
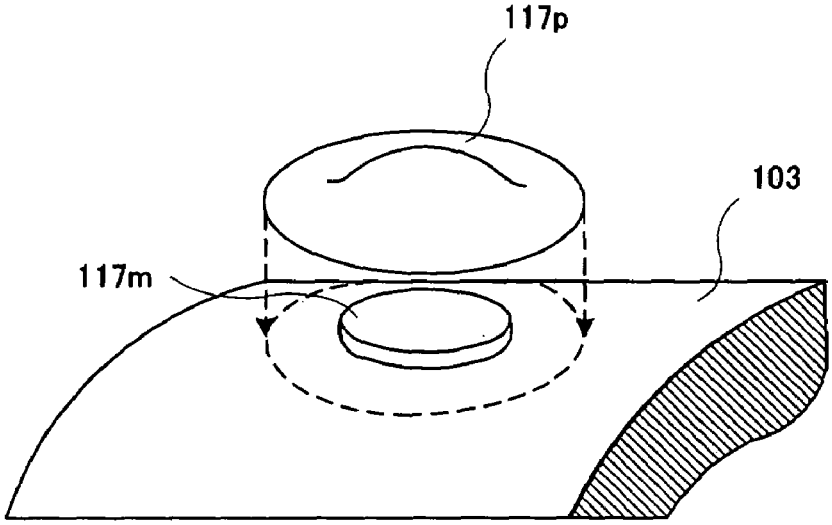
FIG. 31 is a perspective view of a principal part showing an example where a mark is attached to an outer peripheral surface of a shaft in a marine reversing gear assembly with a trolling device according to one embodiment of the invention.
Figure 32:
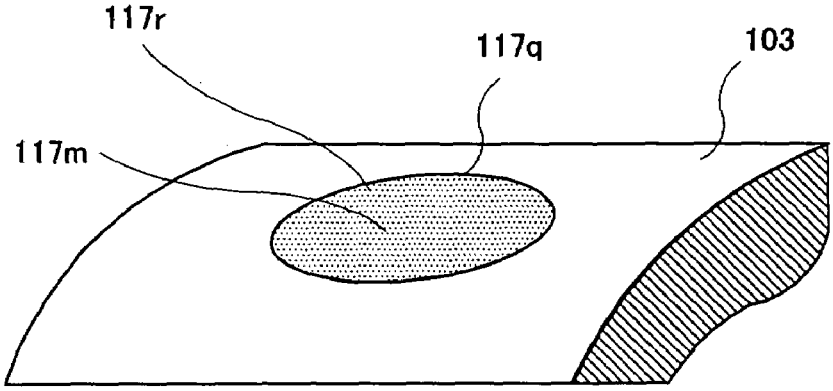
FIG. 32 is a perspective view of a principal part showing an example where a mark is disposed in a different manner on the outer peripheral surface of a shaft in a marine reversing gear assembly with a trolling device according to one embodiment of the invention.

Permanent magnets 117*m* may be adhered to the propeller shaft 103 with adhesive tape 117*p* as shown in FIG. 31 which is an enlarged perspective partial view. Alternatively, as shown in FIG. 32, permanent magnets 117*m* may be embedded and fixed with adhesive 117*r* shown by a dark color in the FIG. 31 in depressions 117*q* formed in the circumferential direction at fixed intervals on the outer peripheral surface of the propeller shaft 103.

As is clear from the above, the permanent magnets can be fixed to the propeller shaft 103 with adhesive-tape 117*p* or adhesive 117*r*, which advantageously facilitates replacing the sensor 119*m* when the mechanically hydraulic oil pressure control device is changed to the electrically-operated hydraulic oil pressure adjusting device, or vice versa.

Therefore, the above-described structure makes it possible to change the oil pressure adjusting method of a marine reversing gear assembly with a trolling device, even after the trolling device is installed in a ship or craft, from an electrical operational manner to a mechanical operational manner, or vice versa. Moreover, the oil pressure control element can be easily removed or added at low cost, including the installation of a sensor for the number of revolutions.

Figure 41:
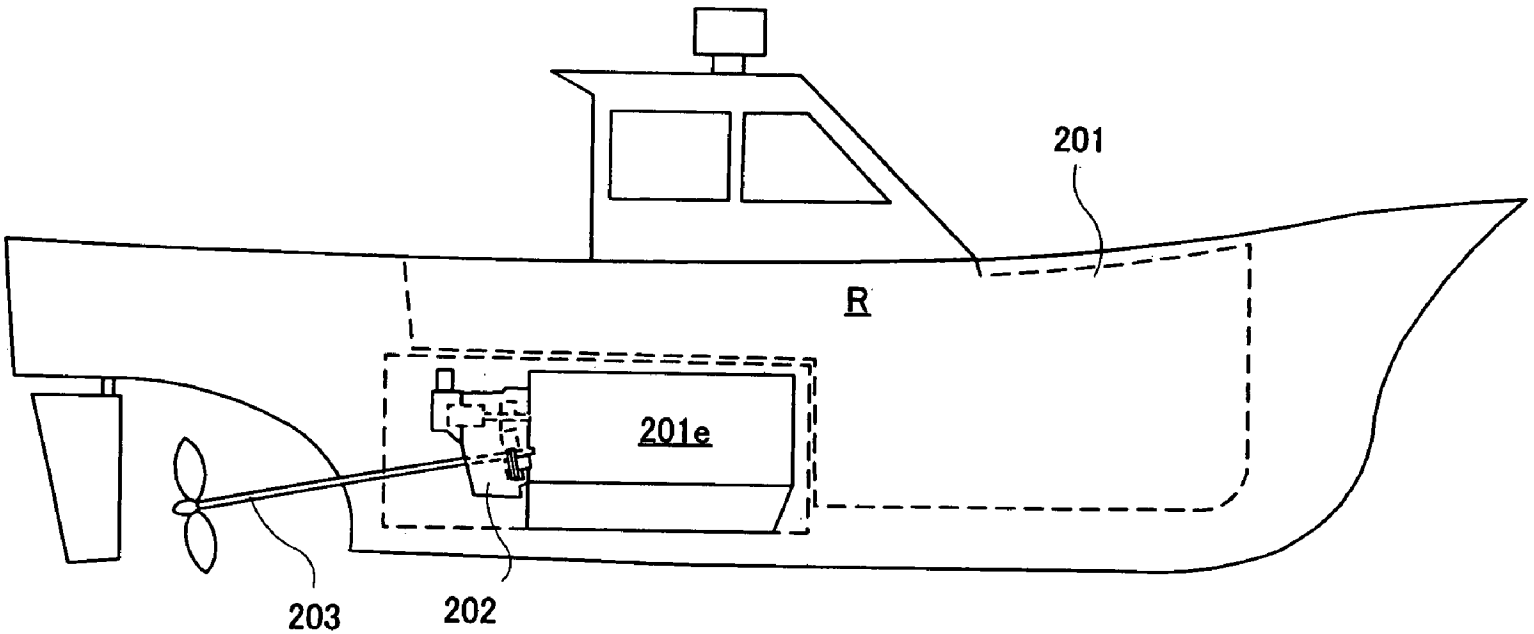
FIG. 41 is a descriptive side view showing an example in which a marine reversing gear assembly is installed.
Figure 42:
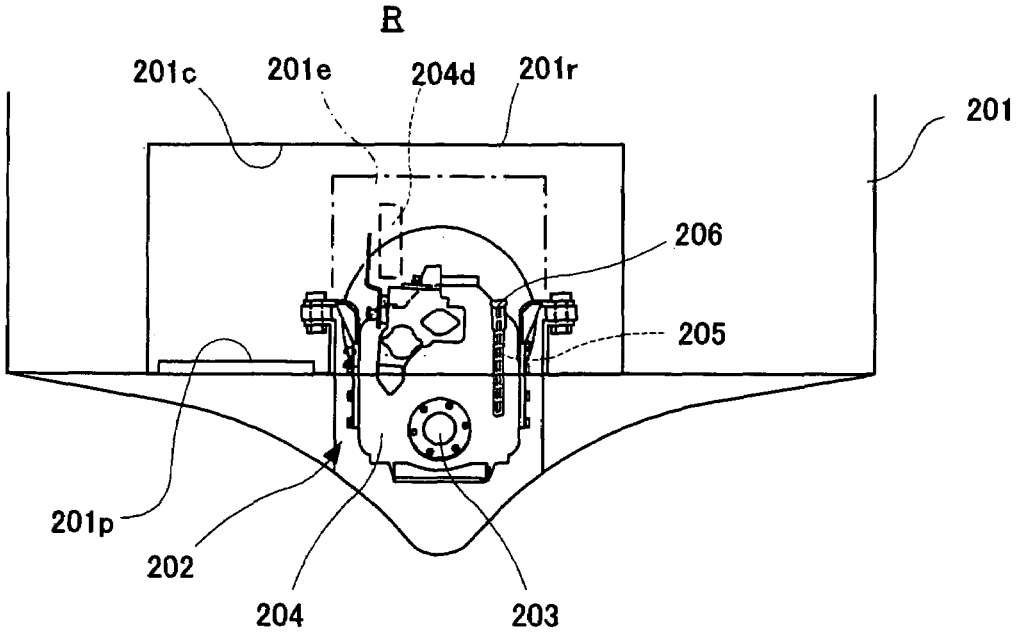
FIG. 42 is a descriptive sectional view showing an example in which a marine reversing gear assembly is installed.

As shown in FIG. 41, the marine reversing gear assembly comprises a clutch for switching forward and reverse motion and a gear train that transmits rotational force to the output shaft. The entire mechanism is accommodated in a casing 204, as shown in FIG. 42. The inner bottom part of the casing 204 functions as a hydraulic oil reservoir for the clutch and a lubricator for the gear train.

Figure 43:
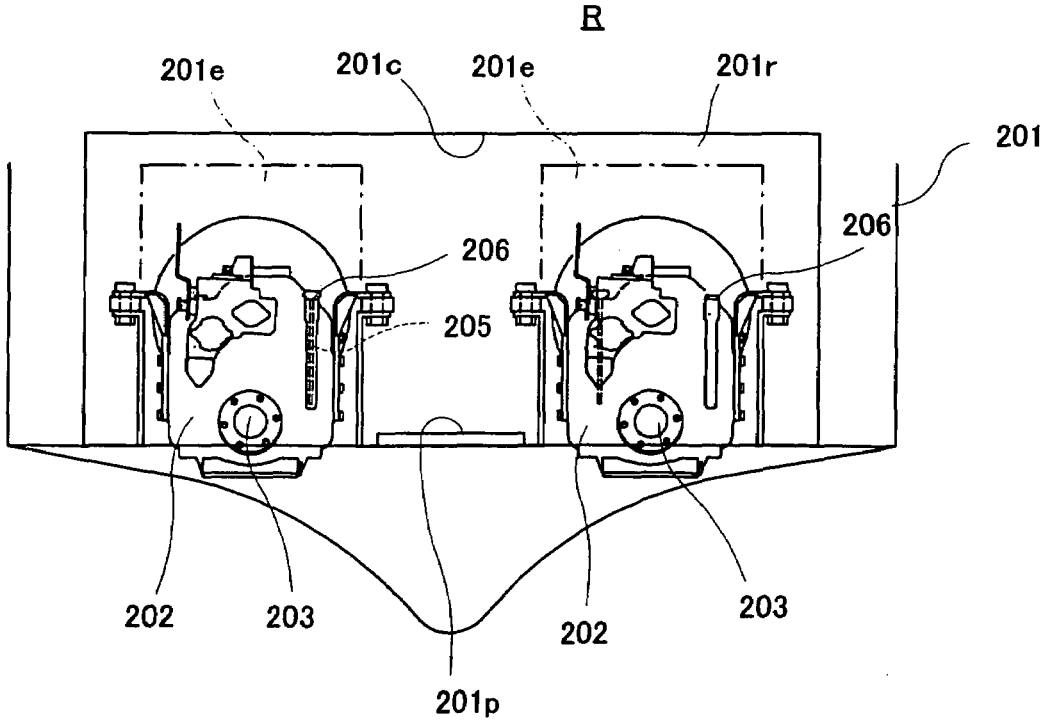
FIG. 43 is a descriptive sectional view showing another example in which a marine reversing gear assembly is installed.

Oil shortage in the reservoir adversely affects the operation of the marine reversing gear assembly. Therefore, as shown in FIGS. 42 and 43, the casing 204 of the marine reversing gear assembly 202 must have an insertion opening 206 to receive a dipstick 205 for use in checking the oil level. In addition to the marine reversing gear assembly 202, an engine 201*e* and the like are similarly furnished with an insertion opening (as cited, for example, in Japanese Patent Publication No. 2002-339722), although it is not shown in the figures attached hereto.

However, it is often difficult with conventional marine reversing gear assemblys to check the lubricant because there is usually only one insertion opening 206 provided in the casing 204 to insert the dipstick 205.

By reference to FIGS. 42 and 43, for example, a space 201*r* for accommodating the engine 201*e* and the marine reversing gear assembly 202 in a small craft 201 is usually so small that a person has to bend over to enter. If an insertion opening 206 to insert a dipstick 205 is placed opposite a space 201*p* where a person can enter, as shown in FIG. 42, he must reach over the casing 204 for the dipstick 205, thereby making the checking operation very difficult. Once the dipstick is reached, such a configuration is problematic in that it limits the movement to check the oil by making it possible for a hand to touch the heated casing 204 or by being blocked by the ceiling 201*c* of the installation space 201*r* when removing and inserting the dipstick 205.

In the case of a small craft 201 that drives two propeller shafts by a pair of engines 201*e*, as shown in FIG. 43, the space 201*p* where a person can enter is further limited, thereby making the above-described oil-checking operation more difficult.

When the marine reversing gear assembly 202 is equipped with a controller 204*d*, as shown by the chain line in FIG. 42, the insertion opening 206 for the dipstick 205 may be hidden by the controller 204*d* in the small space 201*r*, and the oil-checking operation may need to be performed without being able to see the insertion opening.

Therefore, the demand exists for a marine reversing gear assembly that makes it possible to suitably select the location of the insertion opening for receiving a dipstick in the casing and to easily check the oil level in a small engine space.

Embodiments of such a marine reversing gear assembly that makes it possible to suitably select the location of the insertion opening provided in the casing for receiving a dipstick and to easily check the oil level in a small engine space are described below by reference to FIGS. 33 to 40.

Figure 33:
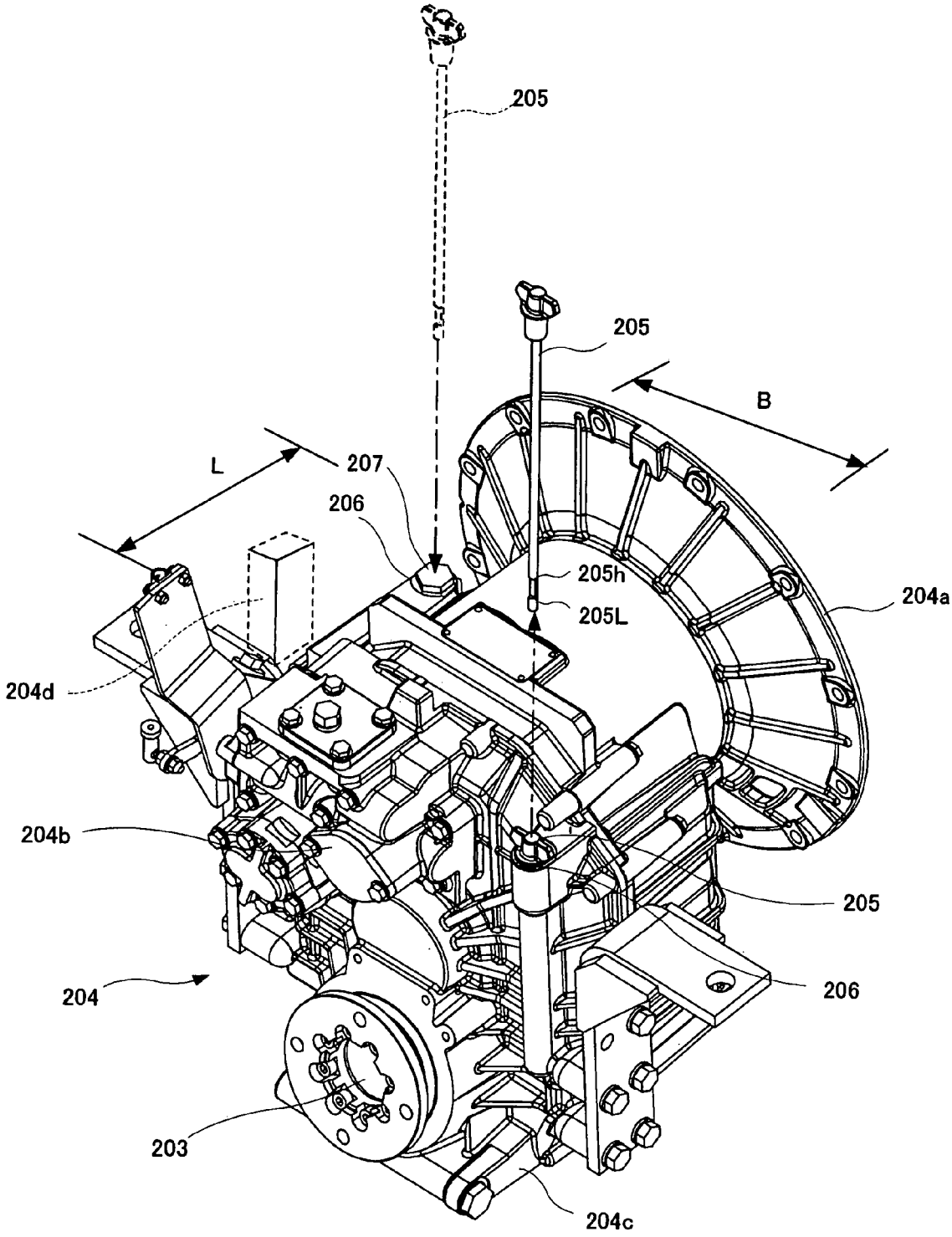
FIG. 33 is a perspective view of a marine reversing gear assembly similar to the marine reversing gear assembly shown in FIG. 12.
Figure 34:
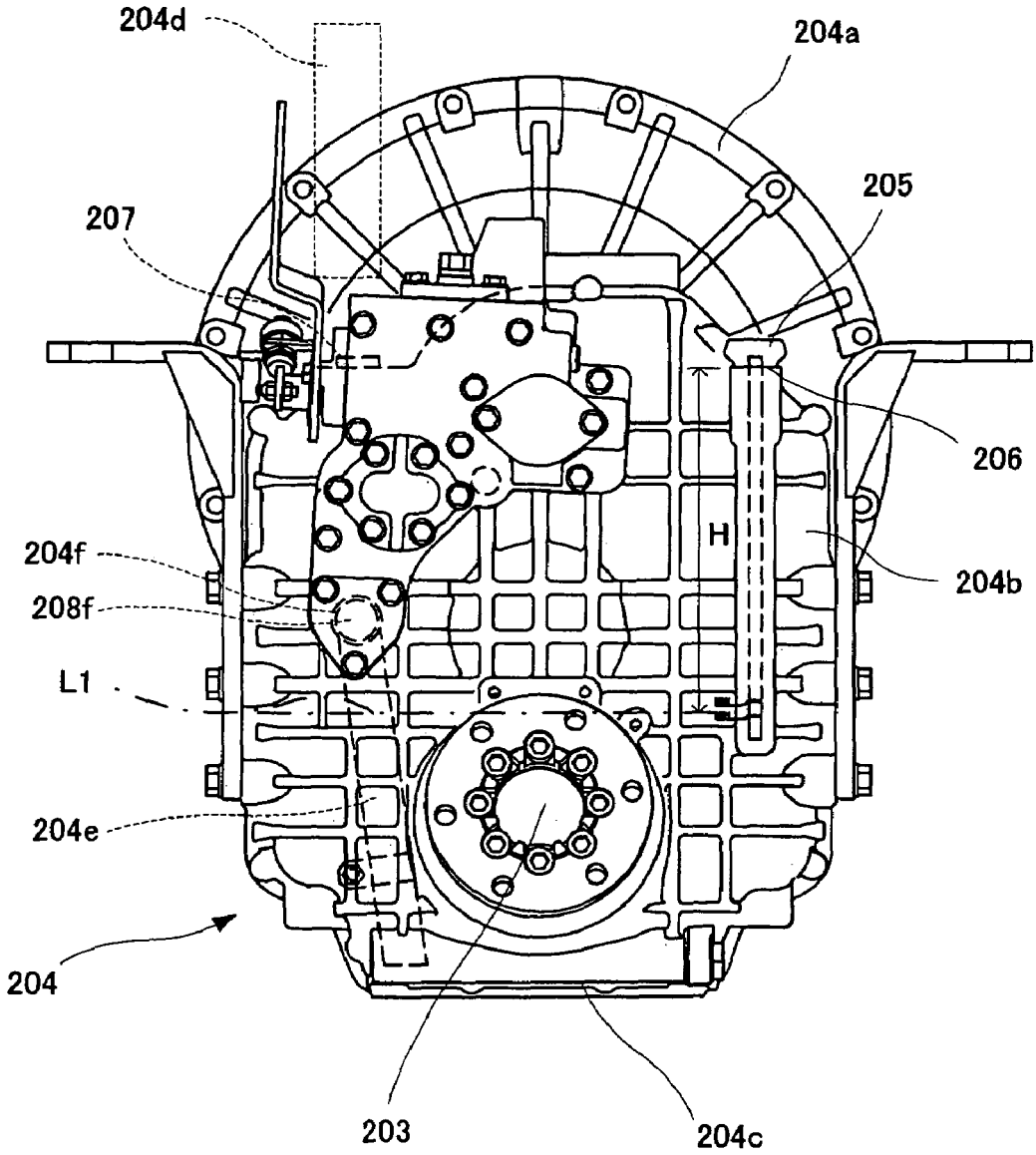
FIG. 34 is a front view of the marine reversing gear assembly of FIG. 33 when the marine reversing gear assembly shown in FIG. 33 is seen from the left.
Figure 35:
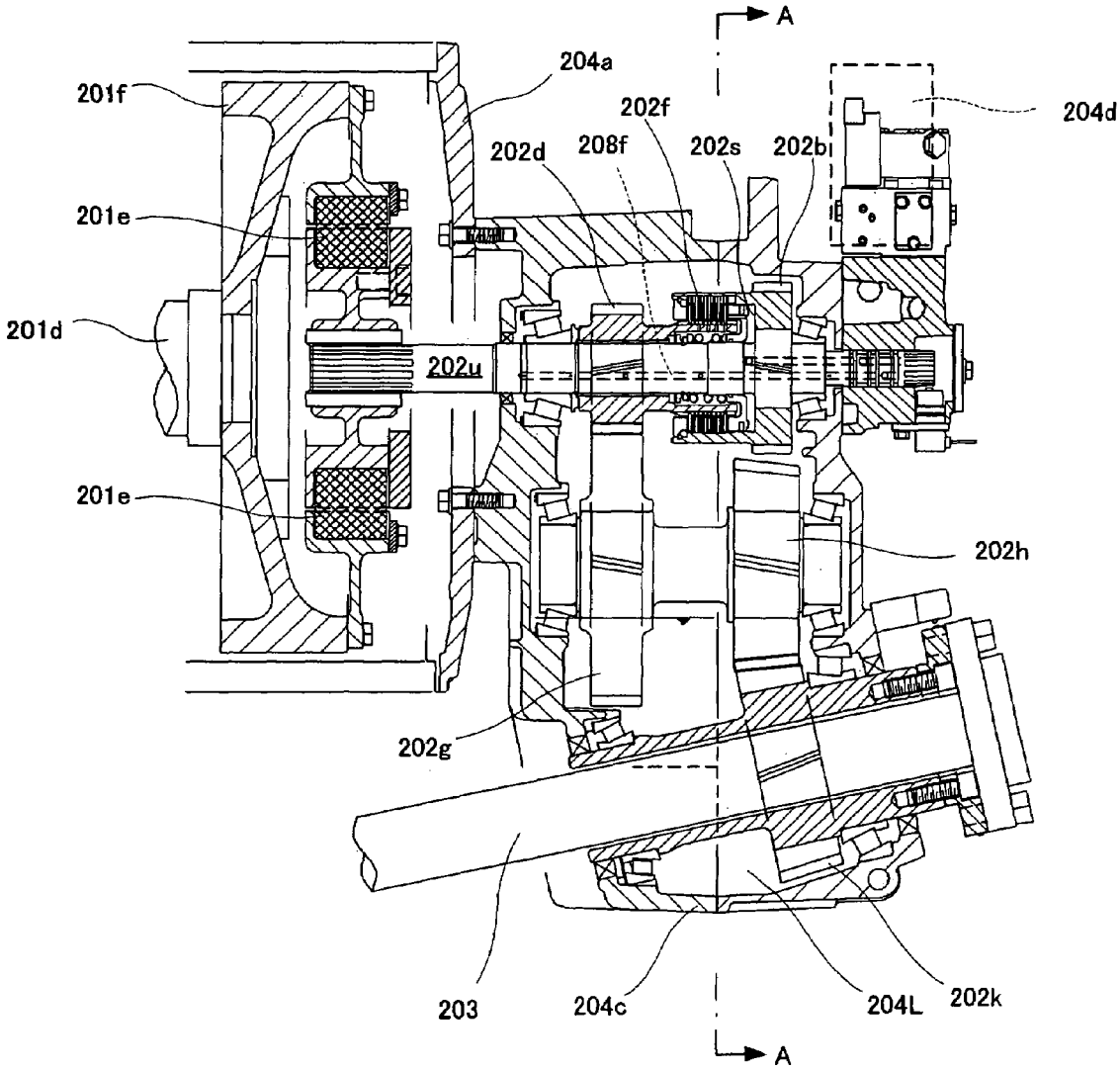
FIG. 35 is a sectional view of the marine reversing gear assembly of FIG. 33.
Figure 36:
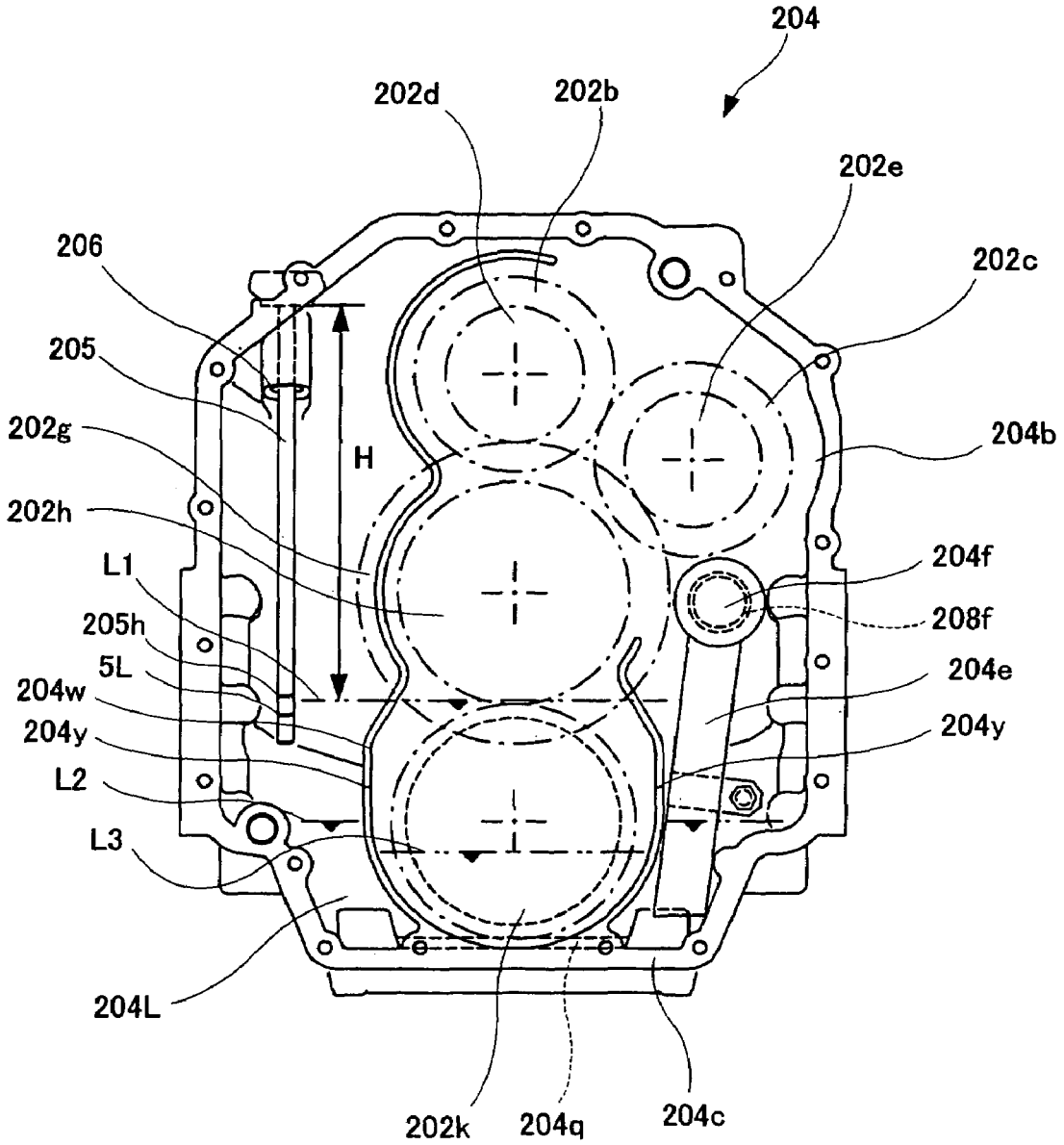
FIG. 36 is a back view of the casing of the marine reversing gear assembly of FIG. 35 taken along the line A to A.
Figure 39:
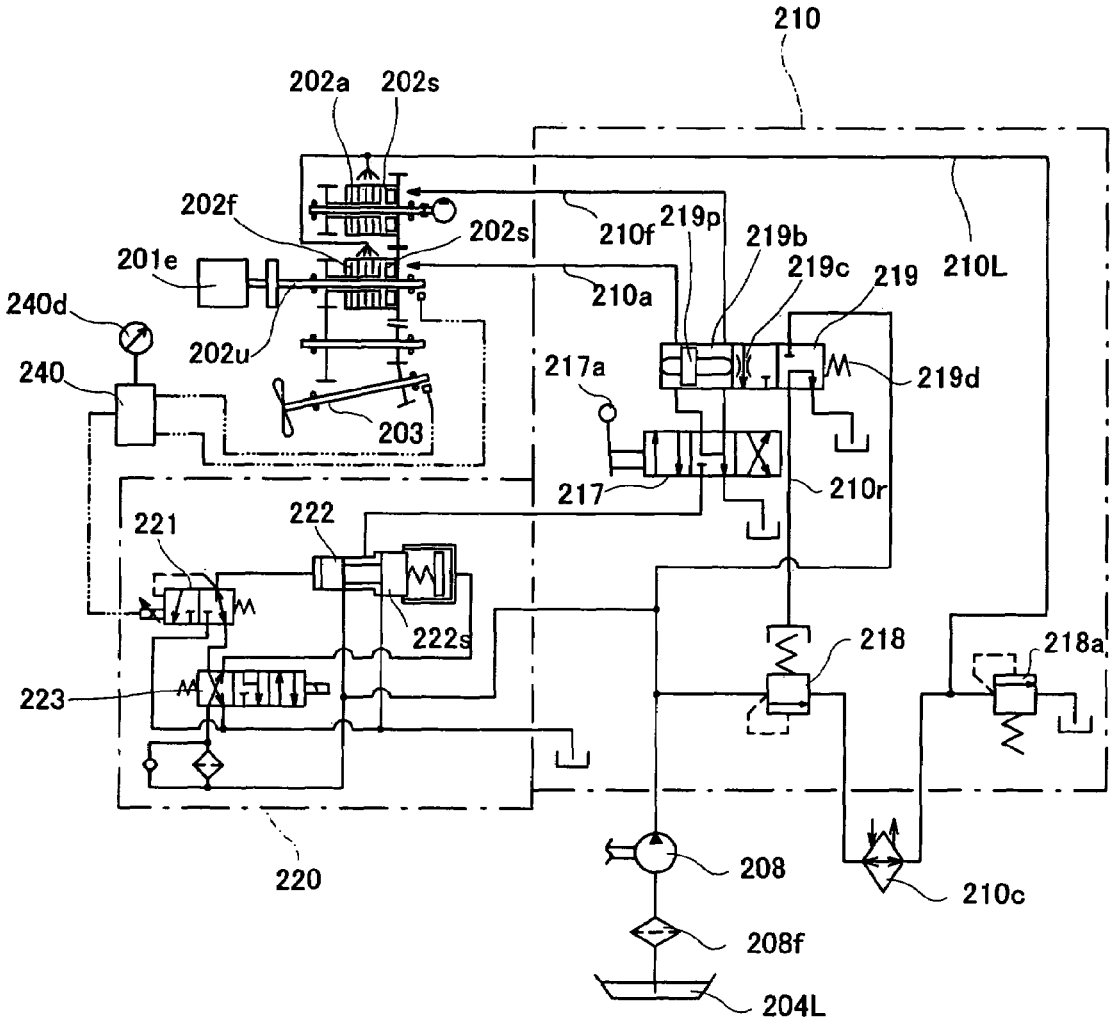
FIG. 39 is a circuit diagram showing the oil passage configuration of the marine reversing gear assembly of FIG. 33.

FIG. 33 is a perspective view of the marine reversing gear assembly. FIG. 34 is a front view of the marine reversing gear assembly when the marine reversing gear assembly of FIG. 33 is seen from the left. FIG. 35 is a sectional view of the marine reversing gear assembly of FIG. 33. FIG. 36 is a back view of the casing of the marine reversing gear assembly of FIG. 35 taken along the line A to A. FIG. 36 is an enlarged sectional view of the oil pump of the marine reversing gear assembly. FIG. 39 is a circuit diagram of the oil passage configuration of the marine reversing gear assembly.

Figure 37:
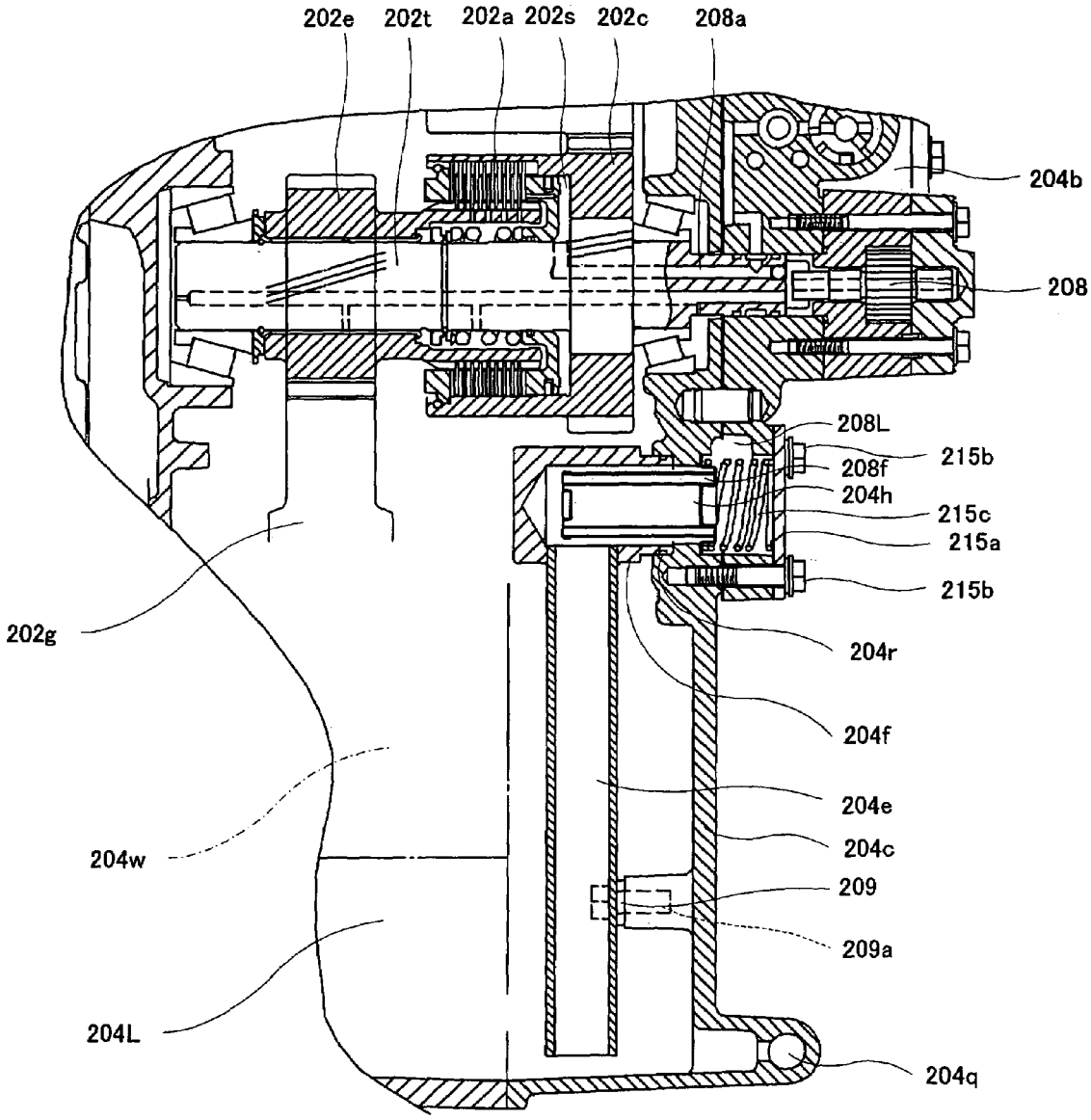
FIG. 37 is an enlarged sectional view of the oil pump of the marine reversing gear assembly of FIG. 33.

The casing 204 shown in FIG. 33 consists of three sections: a front part 204*a*, a body part 204*b*, and a lower part 204*c*. The front part 204*a* faces the engine 201*e* and is shaped like a disk to receive the flywheel 201*f* of the engine. The forward/reverse clutches 202*f* and 202*a* and transmission gears 202*b* to 202*k* are accommodated in the body part 204*b*. Bearing slots are created therein by means of casting to receive each shaft. The inside of the lower part 204*c* is an oil reservoir 204L, as shown in FIGS. 35 to 57. The oil reservoir 204L contains oil that serves as a hydraulic oil for the forward/reverse clutches 202*f* and 202*a* (FIGS. 35 and 37) and a lubricating oil for the transmission gears 202*b* to 202*k* (FIGS. 35 and 37). On the outer surface of the casing 204, a controller 204*d* is furnished to control the operation of the forward/reverse clutches 202*f* and 202*a*.

As shown in FIGS. 36 and 37, the oil is sucked by a pump 208 from the oil reservoir 204L through a vertically arranged suction pipe 204*e* and supplied to various parts via an oil passage 208L.

In the casing 204, insertion openings 206 are provided at two or more locations on the upper surface of the body part 204*b*, as shown in FIGS. 33 and 34 (two locations in FIG. 33). Each insertion opening is designed to receive, as indicated by the solid line and the dashed line in FIG. 33, the dipstick 205 to check the oil level in the oil reservoir 204L.

The dipstick 205 has marks 205*h* and 205L at the tip to indicate the upper and lower limits of the proper amount of oil L contained in the oil reservoir 204L. Whether the amount of oil is within the proper level or not can be determined by inserting the dipstick 205 into the insertion opening 206, removing it, and examining the mark created by the oil left on the dipstick 205 to see whether it is between the marks 205*h* and 205L or not.

As shown in FIG. 34, all the insertion openings 206 are created to have the same height from oil level L1 (FIG. 36) so that a single dipstick 205 can be used in any insertion opening 206.

Such a configuration makes it possible to easily remove and insert the dipstick 205 in a small space even for a pre-installed marine reversing gear assembly 202, as shown in FIG. 42, once an insertion opening 206 that is situated on the side close to the space 201*p* where a person can enter is selected and the dipstick 205 is inserted into it. When there are two marine reversing gear assemblys and thus two shafts, as shown in FIG. 43, insertion openings 206 that are situated on the side close to the space 201*p* at the center are selected and dipsticks 205 are inserted into the openings, thereby enabling insertion and removal of dipsticks 205 in a small space. Insertion openings 206 that are not used are suitably covered with plugs 207 by screw fitting or a like manner.

Although insertion openings 206 may be provided in any location on the upper surface of the casing 204, it is advantageous to create insertion openings 206 that are separated from each other in the direction of the belly of the craft, as indicated by arrow B in FIG. 33. Such a separated arrangement makes it possible to easily determine which insertion opening is to be used.

When the casing 204 of the marine reversing gear assembly 202 is furnished with a controller 204*d*, it is advantageous, as indicated by arrow L in FIG. 33, to place an insertion opening 206 situated on the same side as the controller 204*d* to be distant from the controller so as not to hinder the removal and insertion of the dipstick 205. Such a configuration enables the controller 204*d* and the oil level to be easily inspected.

As shown in FIG. 36, the oil reservoir 204L has different oil levels when the marine reversing gear assembly 202 is in operation and when it is not in operation. In particular, when the marine reversing gear assembly 202 is in operation, the oil is supplied for actuating the clutches 202*f* and 202*a* and lubricating the gears 202*d* to 202*k*, and the oil is therefore lowered from the initial L1 level to L2 level.

Next, the structure of the marine reversing gear assembly 202 to which the aforementioned oil is supplied and the oil passage thereof are described below.

As shown in FIG. 35, the rotational output shaft 201*d* of the engine 201*e* is furnished with a flywheel 201*f*. The input shaft 202*u* of the marine reversing gear assembly 202 is connected to the flywheel 201*f* at the center via a rubber coupler 201*e*. The input shaft 202*u* is furnished with a forward clutch 202*f*.

On the side that would be closer to the background as viewed in FIG. 35, a support shaft 202*t* is provided parallel to the input shaft 202*s*. The support shaft 202*t* is furnished with a reverse clutch 202*a* as shown in FIG. 37.

Detailed drawings for the forward clutch 202*f* and the reverse clutch 202*a* are not provided herein. Both are composed of friction disks and steel plates that are alternately arranged. The friction disks of the forward clutch 202*f* are connected to the pinion gear 202*d* (FIG. 35) on the input shaft 202*u*, and the steel plates are connected to the outer gear 202*b* (FIG. 35) that is in continuous rotation integrally with the input shaft 202*u*. Similarly, the steel plates of the reverse clutch 202*a* are connected to the pinion gear 202*e* (FIG. 37) on the support shaft 202*t*, and the frictional disks are connected to the outer gear 202*b* (FIG. 37) that is in continuous rotation. The outer gear 202*b* of the input shaft 202*u* and the outer gear 202*c* of the support shaft 202*t* are always engaged and thus rotate in opposite directions.

When the friction disks on the input shaft 202*u* are pressed against the steel plates by a hydraulic piston 202*s*, the outer gear 202*b* and the pinion gear 202*d* are integrally rotated. The pinion gear 202*d* rotates the large gear 202*g*. The idle gear 202*h* provided on the same shaft as the large gear 202*g* then rotates the output gear 202*k*, thereby spinning the propeller shaft 203.

In this instance, since the friction disks of the reverse clutch 202*a* are not pressed, the pinion gear 202*e* is not in contact with the outer gear 202*c*, and thereby idles on the support shaft 202*t*.

Slipping occurs between the frictional disks and the steel disks, i.e., half clutching, by controlling the pressure applied by the hydraulic piston 202*s*, thereby enabling trolling travel.

Oil is supplied to the hydraulic piston 202*s* for the forward/reverse clutches 202*f* and 202*a*, through oil passages 210*f* and 210*a*, as shown in FIG. 39, to create forward or reverse motion. The hydraulic oil supply circuit 210 is furnished with a hydraulic oil pressure control circuit 220 to control the pressure of the hydraulic oil supplied to the hydraulic piston 202*s*. The hydraulic oil supply circuit 210 and the hydraulic oil pressure control circuit 220 attached thereto, as shown in FIG. 39, to enable trolling are as shown in FIG. 16, and thus detailed descriptions of the circuits are not provided here.

The oil contained in the oil reservoir 4L is supplied to each circuit as hydraulic oil or lubricating oil. When the oil level shown in FIG. 36 is lowered from L1 to L2, the extent of the decrease corresponds to the amount of oil supplied to the oil circuits.

As shown in FIG. 36, about half of the large gear 202*g* or the gear 202*k* placed at the lowermost position (202*k* in FIG. 36) is immersed in oil even when the oil level of the oil reservoir 204L is at L2. When the gear is immersed in oil, the agitation resistance of the oil should not be ignored. Therefore, to reduce the amount of oil that covers the gear 202 to a suitable amount, a separator 204*w* isolates the gear 202 from the oil reservoir 204L.

The oil level in the separator 204*w* is thus lowered to L3, and agitation resistance is minimized.

An oil communicating port 204*q* is created at the bottom of the oil reservoir 204L so as not to completely partition the oil reservoir 204L by the oil separator 204*w*.

Bubbles are formed in the oil when the oil is agitated by the rotation of gears 202*h* and 202*k*. The flow of bubbles into the oil reservoir 204L is prevented by the oil separator 204*w*. The oil separator 204*w* therefore also functions to prevent the suction pipe 204*e* from sucking in the bubbles.

It is preferable that the space between the oil separator 204*w* and gears such as 202*k* and 202*h* is as small as possible. In particular, when part of the gear 202*h* or 202*k* is immersed in the oil L, the space should preferably be as small as possible to reduce the agitation resistance.

Changing the speed reduction rate of the marine reversing gear assembly 202 has been accomplished by replacing all the gears 202*d* to 202*k*. In such a case, the use of a gear 202*k* or 202*h* with a smaller diameter results in a large space between the gear and the oil separator 204*w*, which is likely to increase agitation resistance due to the viscosity of the oil L.

In the marine reversing gear assembly 202, conical gears are often used for the idle gear 202*h* and the output gear 202*k*. Such a configuration is problematic in that it increases the number of assembly processes and also costs because backlash control is necessary every time the speed reduction rate is changed.

Therefore, with respect to the marine reversing gear assembly 202, the speed reduction rate is changed by selecting a large gear 202*g* or pinion gear 202*d* with a different number of teeth. In particular, the speed reduction rate is changed without replacing the output gear 202*k* and idle gear 202*h* with ones having a different number of teeth. In this manner, the increase of the space between the oil separator 204*w* and the perimeter of the large gear 202*g*, idle gear 202*h* and output gear 202*k* immersed in the oil L can be prevented, thus not increasing the agitation resistance.

Moreover, since the conical gears used for the gears 202*h* and 202*k* are not replaced with ones having a different number of teeth, it is not necessary to perform backlash control when the speed reduction rate is changed, thereby enabling the reduction rate to be easily changed.

Next, described below are the suction pipe 204*e* and the pump member used in supplying the oil from the oil reservoir 204L to the oil circuit 210.

It has already been described above that the oil L is sucked by the pump 208 through the vertically arranged suction pipe 204*e* and supplied to various parts, as shown in FIGS. 36 and 37.

In prior-art techniques, the oil passage from the oil reservoir 204L to the pump 208 is created by casting a communicating tube, which functions as the oil passage, at the time of casting the casing 204, or by casting a groove into the inner surface of the casing and covering the opening of the groove with a cover plate from the inside of the casing after casting.

In such a manner, different casings have to be cast according to the model, and this kind of high-mix, low-volume production is highly uneconomical. Even in high-volume production, a design change or the like makes already cast casings useless and requires a new mold for producing another type of casing, thereby being highly uneconomical.

Alternatively, instead of creating an oil passage by casting, a pipe is sometimes used for an oil passage by casting mounts onto the inner surface of a casing, and fixing a suction pipe to the mounts by flanges. However, flanges may sometimes interfere with gears installed in a casing, thereby being troublesome by requiring careful attention in the design and installation of the pipe.

The suction pipe 204*e* was therefore invented to solve such problems. The suction pipe 204*e* is described below.

As shown in FIGS. 36 and 37, at one end of the suction pipe 204*e*, a cylindrical filter case 204*f* is welded with its axis substantially perpendicular to the longitudinal direction of the suction pipe 204*e*. The suction pipe 204*e* is installed such that the filter case 204*f* is fitted to the through-hole 204*h* of the casing 204*c*. 204*r* in FIG. 37 is an O-ring for sealing.

The oil passage 208L is designed to be closable by inserting a filter 208*f* into the filter case 204*f* from outside the casing 204, placing a covering member 215*a* over the opening of the through-hole 204*h*, and fastening bolts 215*b* for sealing. In FIG. 37, 215*c* is a hold-down spring for the filter 208*f*. The hold-down spring 215*c* is inserted into the filter case 204*f* in a compressed condition to secure the filter 208*f*.

The middle section of the suction pipe 204*e* is affixed to the inner surface of the casing 204 by using a band or a bolt/nut 209*a* in combination with a bracket 209.

The suction pipe 204*e* can rotate in conjunction with the filter case 204*f* with the filter case 204*f* being at the center, thus making it easy to adjust the installation position. Since the suction pipe 204*e* is affixed in a desired position by using a band or a bolt/nut 209*a* in combination with a bracket 209, even when the design specifications of the entire casing 204 are changed, the same suction pipe 204*e* can be used if there is a through-hole 204*h* having the same inner diameter, thereby increasing applicability.

The filter 208*f* is readily replaceable from outside the casing once the covering member 215*a* is removed, thereby simplifying maintenance and inspection.

Figure 38:
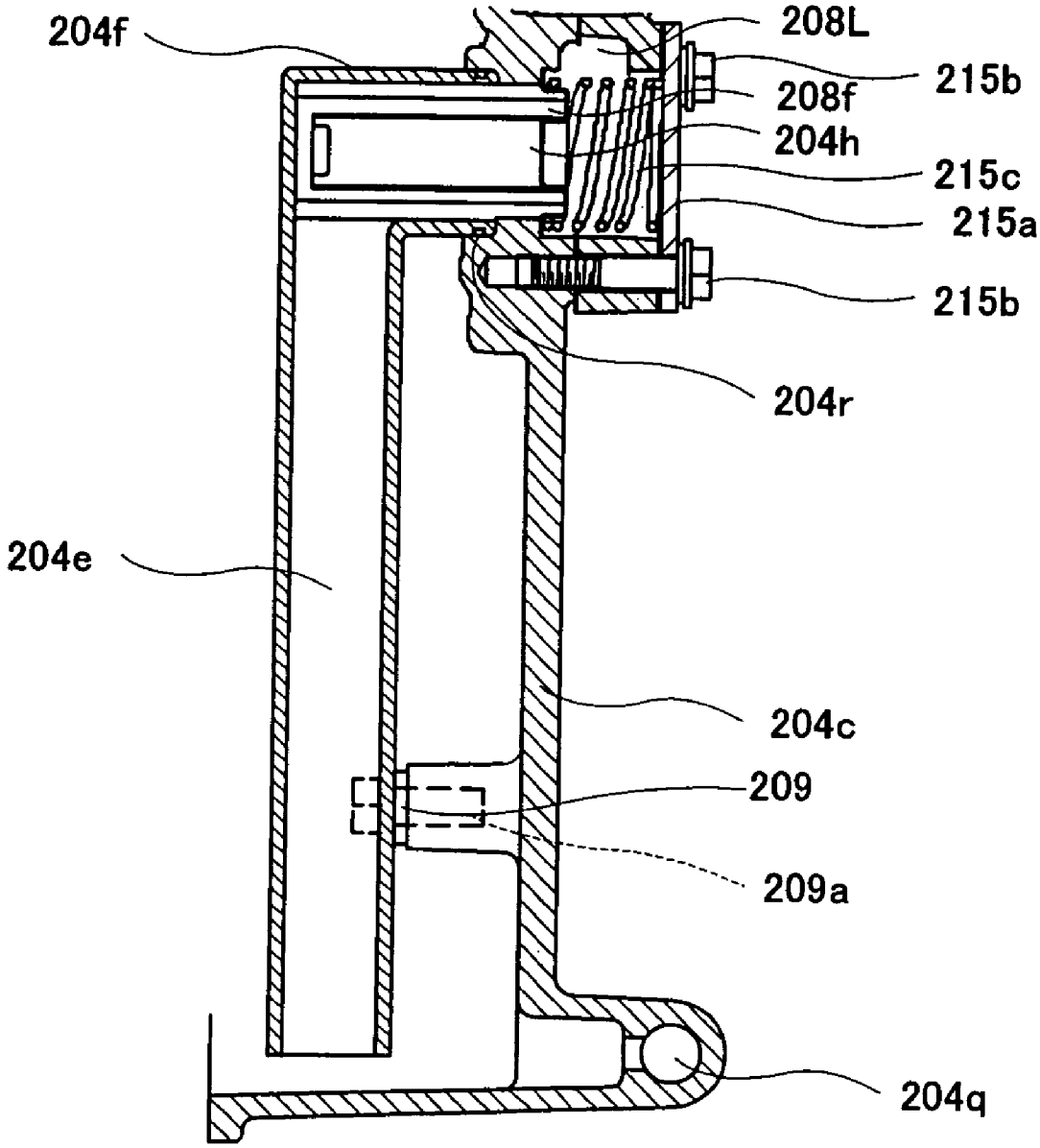
FIG. 38 is an enlarged sectional view showing another embodiment of the oil pump of the marine reversing gear assembly.

FIG. 38 is a fragmental sectional view showing another embodiment of the suction pipe 204*e*. The filter case 204*f* and the suction pipe 204*e* are integrally formed using an L-shaped pipe.

In such a configuration, there is no need to weld the suction pipe 204*e* and the filter case 204*f*. The suction pipe 204*e* shown in FIG. 38 is the same as that shown in FIG. 37 except for having an L-shaped curve. Therefore, the same reference numerals are given to the same or corresponding components, and a detailed description of the suction pipe 204*e* of FIG. 38 is not provided herein.

With respect to the marine reversing gear assembly 202 shown in FIG. 35, the propeller shaft 203 extends in the direction of the engine.

Figure 40:
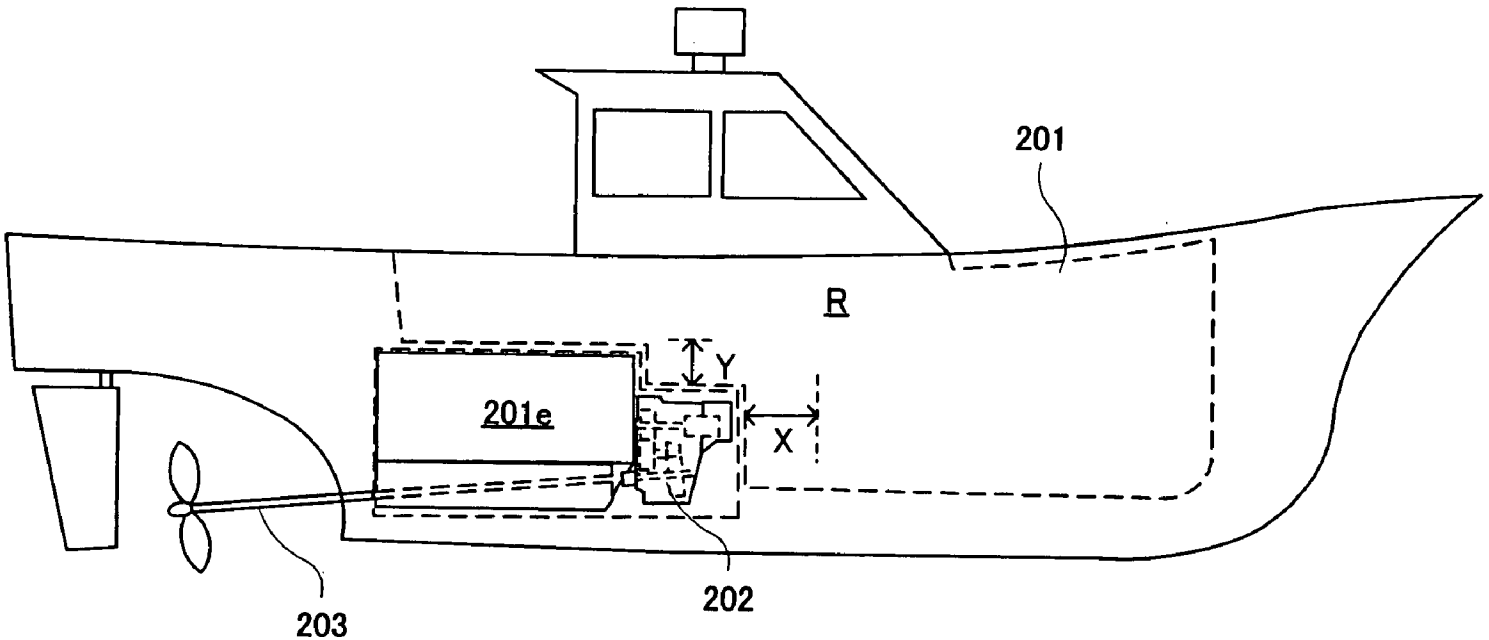
FIG. 40 is a descriptive side view showing an embodiment in which the marine reversing gear assembly of FIG. 33 is installed.

When actually installed in a craft, as shown in FIG. 40, the engine 201*e* is located toward the rear of the hull, and the marine reversing gear assembly 202 is located toward the front of the hull.

In such a configuration, compared with the configuration (FIG. 41) in which the propeller shaft 203 extends in the direction opposite the engine 201*e*, the inboard living space R shown in FIG. 40 is larger, by a length of X fore and aft and a height of Y, than the inboard living space R shown in FIG. 41.

Moreover, such a configuration simplifies inspection procedures by allowing the oil level of the marine reversing gear assembly 202 to be checked from the direction of the inboard living space R.

The configuration to furnish a plurality of insertion openings 206 to receive a dipstick 205 is applicable to the oil reservoir of internal combustion engines.

As is clear from the description given in reference to FIGS. 33 to 40, it is advantageous that the lower part 204*c* of the casing 204, which accommodates the clutch and gear mechanism to transmit the rotation of the input shaft to the output shaft in a reduced or reversed manner, functions as the reservoir 204L of the oil for lubricating the clutch and gear mechanism, and that insertion openings 206 for receiving a dipstick 205 to check the oil level in the oil reservoir 204L are provided at two or more locations on the casing 204. Due to such a configuration, the oil level can be easily checked once the most easily accessible opening to insert the dipstick 205 is selected because that makes it possible to easily remove and insert the dipstick even in the small space where the marine reversing gear assembly is installed.

In such a case, a plurality of insertion openings 206 are preferably provided at distant locations in the direction of the belly of the craft on the upper surface of the casing 204. The insertion openings 206 at different locations can be designed to be sealable with plugs 207. A controller 204*d* may be provided on one side of the casing 204 to control the pressure of the hydraulic oil. Insertion openings situated on the same side as the controller preferably are sufficiently distant from the controller so as not to allow the controller 204*d* to hinder the removal and insertion of the dipstick 205. Furthermore, it is preferable to create insertion openings 206 at a plurality of locations such that all of the openings are at the same height from the oil level of the oil reservoir 204L.

When a plurality of insertion openings 206 are provided at distant locations in the direction of the belly of the craft on the upper surface of the casing of the marine reversing gear assembly 202, the dipstick 205 can be easily removed and inserted by selecting an insertion opening on the side closer to the space, in consideration of the position of the marine reversing gear assembly and the space where a person can enter. Since the insertion openings 206 are sealable with plugs 207, foreign substances can be kept from entering from the unused openings, thereby preventing oil contamination. When an insertion opening 206 that is on the controller 204*d* side is placed sufficiently distant from the controller 204d, the oil level can be easily checked by using the insertion opening situated on the controller 204*d* side. Moreover, the oil level can be checked while the controller 204*d* is in operation, and both the checking of the oil level and the operation of the controller can be easily performed. When insertion openings 206 created at a plurality of locations have the same height from the oil level of the oil reservoir 204L, a single dipstick 205 can be used in any of the insertion openings 206.

Propulsion devices for small crafts such as motorboats and fishing boats generally transmit engine power to a propeller shaft while adjusting the rotational direction and speed by means of a marine reversing gear assembly.

Figure 54:
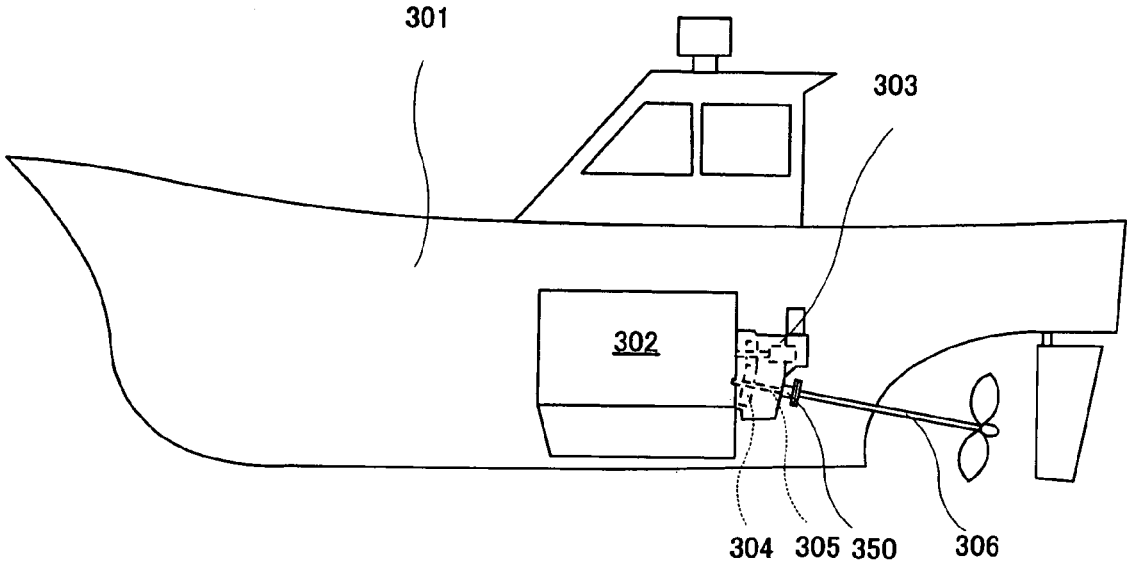
FIG. 54 is a schematic side view of a marine craft.

For example, FIG. 54 is a schematic side view illustrating one example of a motorboat or the like comprising an engine 302 in an engine compartment of a craft 301, and a marine reversing gear assembly 303 disposed at the rear side of the engine 302. An output shaft 305 having a large output gear 304 is disposed in the lower portion of the marine reversing gear assembly 303, and a propeller shaft 306 is connected via a coupling joint 350 to the rear end of the output shaft 305.

Figure 55:
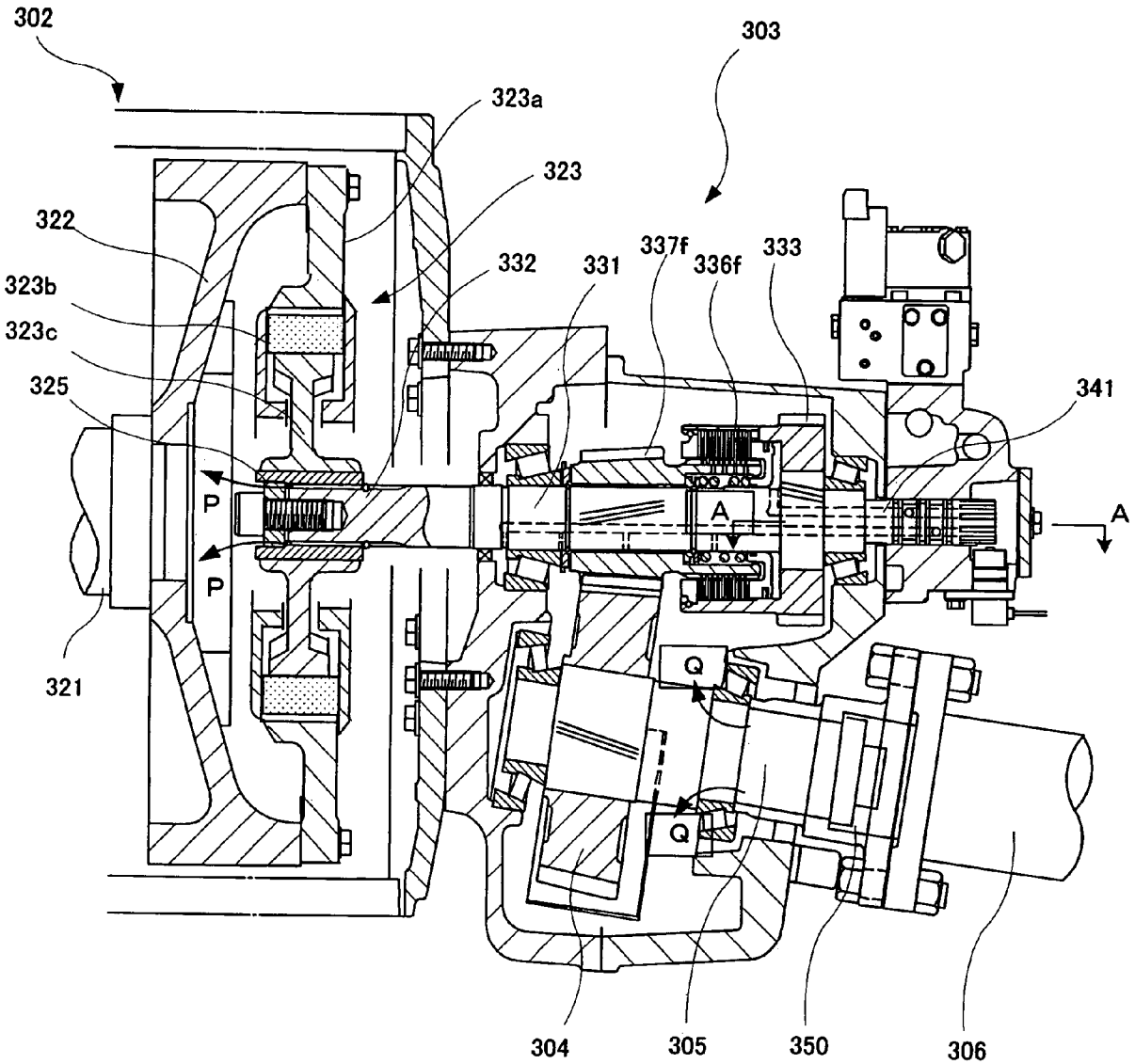
FIG. 55 is a sectional view of a conventional marine reversing gear assembly.

FIG. 55 is an enlarged sectional view of one example of the marine reversing gear assembly 303. An engine output shaft 321 is provided with a flywheel 322 to which is connected an input shaft 331 via a coupling member such as an elastic coupling 323 or the like comprising an outer ring 323*a*, an elastic block 323*b* used as a torque variation buffer, and an inner ring 323*c* provided with an output connecting port 325 in the center.

Figure 56:
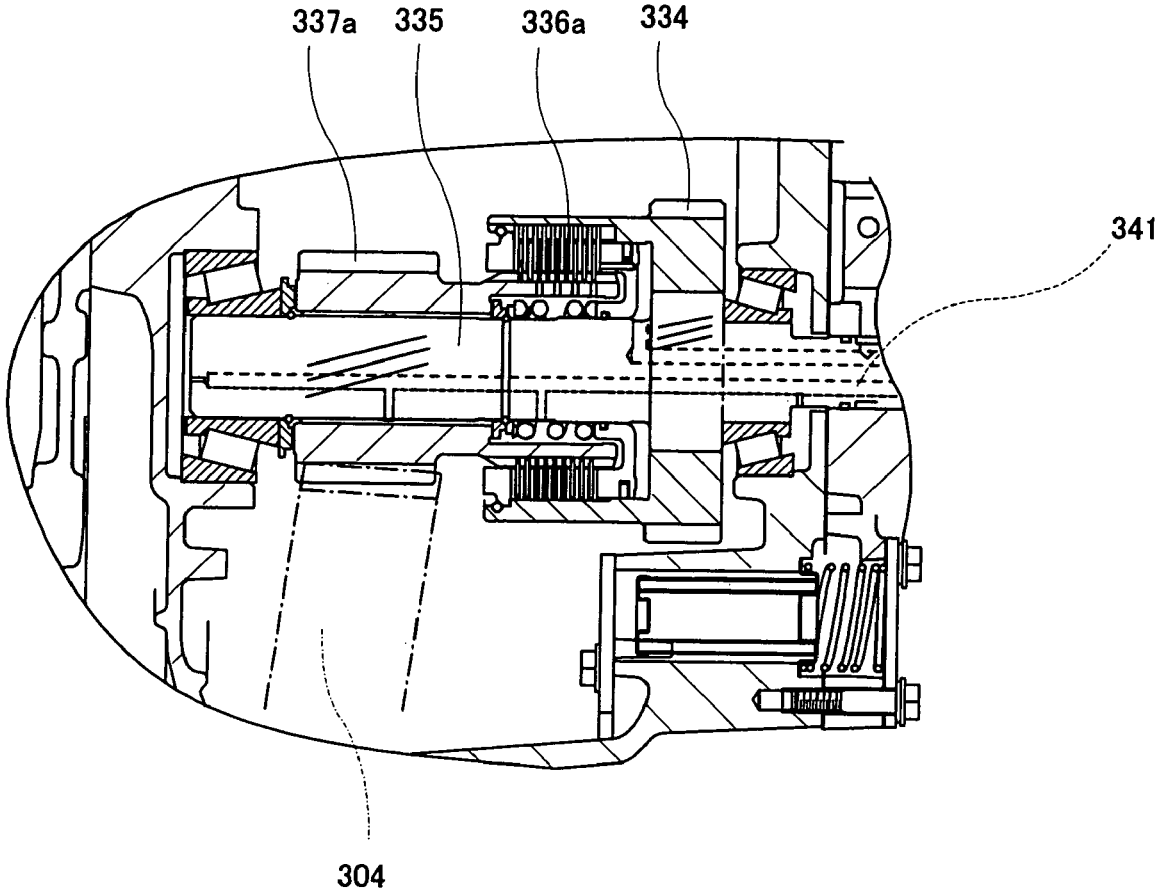
FIG. 56 is a sectional view taken along arrows A—A of FIG. 55.

An input connecting portion 332 fitted into the output connecting port 325 is provided at one end of the input shaft 331 of the marine reversing gear assembly 303, whereas an input gear 333 is provided at the other end. Although hidden at the back side of the input gear 333 and not shown in FIG. 55, a support shaft 335 having an intermediate gear 334 engaging the input gear 333 is supported in parallel with the input shaft 331, as shown in FIG. 56, which is a partial plan sectional view taken along line A—A of FIG. 51.

A pinion 337*f* is rotably supported on the input shaft 331 via a clutch 336*f* relative to the input gear 333. The transmission of forward rotation is turned on and off by means of the clutch 336*f*. When a large output gear 304 is engaged with the pinion 337*f* and the clutch 336*f* activates the forward rotational transmission, forward rotation is transmitted to the large output gear 304 and is passed from the output shaft 305 via a coupling joint 350 to rotate the propeller shaft 306.

In constrast, a pinion 337*a* is rotably supported on the support shaft 335 via a clutch 336*a* relative to the intermediate gear 334. The transmission of reverse rotation is turned on and off by means of the clutch 336*a*. When the large output gear 304 is engaged with the pinion 337*a* and the clutch 336*a* activates the reverse rotational transmission, reverse rotation is transmitted to the large output gear 304.

When the forward clutch 336*f* is engaged, the pinion 337*f* rotates so that the output large gear 304 rotates in the forward direction to rotate the propeller shaft 306 in the forward direction. Since the reverse clutch 336*a* is disengaged at this time, the pinion 337*a* rotates idly while being engaged with the large output gear 304.

Vice versa, when the reverse clutch 336*a* is engaged, the pinion 337*a* rotates so that the large output gear 304 rotates in the reverse direction to rotate the propeller shaft 306 in the reverse direction. Since the forward clutch 336*f* is disengaged at this time, the pinion 337*f* rotates idly while being engaged with the output large gear 304.

In FIG. 55, the member 341 is a hydraulic oil passage penetrating inside the input shaft 331, and is provided to operate the clutch 336*f* (FIG. 55) and the clutch 336*a* (FIG. 56).

Manufacturers that produce marine reversing gear assemblys as mentioned above must be careful about the spline configuration of the output connecting port of various coupling members provided in various types of engines.

In the case of the engine 302 and the marine reversing gear assembly 303 shown in FIG. 55, if the output connecting port 325 of the coupling member and the input connecting portion 332 at the front end of the input shaft 331 of the marine reversing gear assembly 303 have a common configuration produced according to the same specification, no problems should arise. However, there are cases in which the output connecting port and the input connecting portion cannot be connected to each other because they are different in terms of diameter or spline type.

In this case, the diameter of the input shaft of the marine reversing gear assembly must be changed in accordance with the output connecting port of the coupling member. To make such a design change, however, changes are also needed in the input gear 333 attached around the input shaft 331 and the pinion 337*f* and furthermore in the diameter of the feed hole of the hydraulic clutch 336*f* attached thereto, thus making the change extremely troublesome.

When the output connecting port 325 and the input connecting portion 332 are to be connected by splines or when the outer periphery of the output shaft 305 of the marine reversing gear assembly 303 and the inner surface of the coupling joint 350 are to be connected by splines, they are usually configured to have a closely fitting contact surface therebetween so as to transmit a high power.

Therefore, when a connecting shaft having outer peripheral splines is inserted into a connecting port having inner peripheral splines, the surface of the tooth tip of splines may cut the surface of the tooth grove of corresponding splines, causing shavings to enter the engine 302 or the casing of the marine reversing gear assembly 303 as indicated by arrows P and Q in FIG. 55.

Furthermore, when the central axis of the shaft having splines to be inserted is tilted even slightly relative to the central axis of the port with the corresponding splines, coupling of the splines becomes very difficult. If the insertion is done forcibly, the generation of shavings increases, which may result in abnormal cutting or burning of the splines and make the device useless.

Therefore, easy connection is desired even when the diameter of the input shaft of the marine reversing gear assembly does not match that of the engine output portion, and it is also desired to reduce shavings when these are connected by splines.

Figure 44:
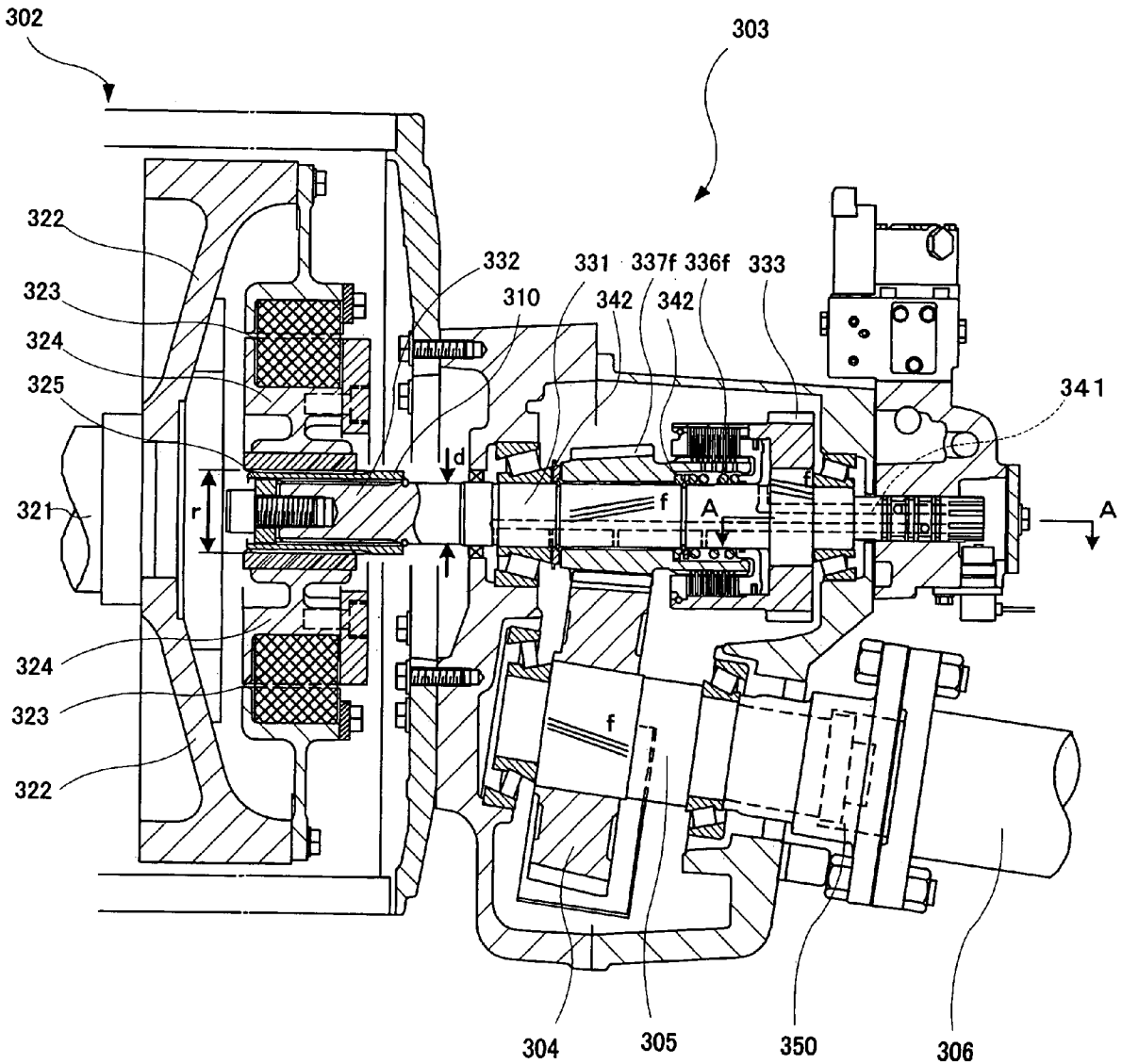
FIG. 44 is a sectional view of a marine reversing gear assembly having a structure similar to that of the marine reversing gear assembly shown in FIG. 26.
Figure 45:
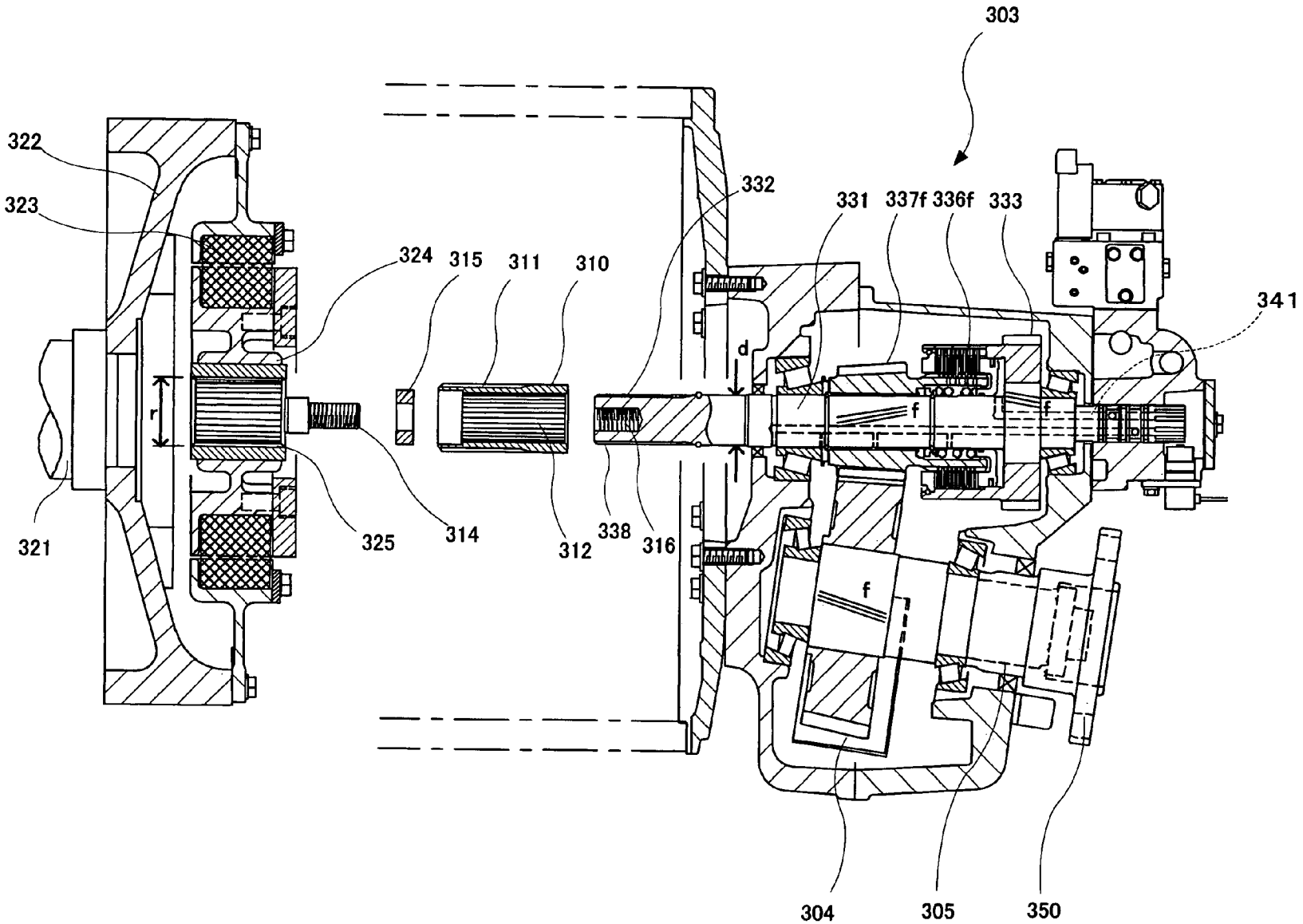
FIG. 45 is an exploded sectional view of the marine reversing gear assembly shown in FIG. 44.

Such a marine reversing gear assembly capable of suppressing the generation of shavings is described below in detail with reference to FIGS. 44 and 54. FIG. 44 is a sectional view illustrating the main portion of the marine reversing gear assembly. FIG. 45 is an exploded sectional view of the connection between the engine and the marine reversing gear assembly.

The basic structure of the marine-reducing and reversing machine 303 is the same as shown in FIGS. 55 and 56. The similar components are indicated by the same reference numerals and detailed descriptions thereof are omitted.

The marine reversing gear assembly 303 is configured so that the output connecting port 325 of the inner hub ring 323*c* of an elastic coupling 323 that transmits engine powder to the marine reversing gear assembly 303 has a diameter "r" greater than the outer diameter "d" of the input shaft 331 of the marine reversing gear assembly 303.

The output connecting port 325 has female splines formed according to the same specification as used by the manufacturer of the elastic coupling 323.

In contrast, the outer end of the input shaft 331 of the marine reversing gear assembly 303 has male splines formed according to the same specification as used by the manufacturer of the marine reversing gear assembly.

The gap between the inner surface of the output connecting port 325 and the outer surface of the input connecting portion 332 of the input shaft 331 is filled with a cylindrical sleeve 310 having the same thickness as the gap.

The outer and inner peripheral surfaces of the sleeve 310 are provided with male and female splines, respectively. Several types of sleeves can be prepared in advance having various types of splines formed according to various specifications and having different thicknesses that match the gaps calculated from the combination of types of splines and elastic coupling 323 used.

Therefore, if the manufacturer of the marine reversing gear assembly 303 knows the type of elastic coupling 323 that will be attached to the marine reversing gear assembly 303 and the output connecting port 325, it is possible to prepare a sleeve 310 that matches the gap therebetween and attach such a sleeve to the input shaft, so that an immediate connection can be made even when the diameter "r" of the output connecting port 325 of the elastic coupling 323 does not match the diameter of the input connecting portion 332 in the marine reversing gear assembly side.

To allow high torque transmission, the outer surface and inner surface of the sleeve 310 should be closely contacted with the inner surface of the output connecting port 325 and the outer surface of the input connecting portion 332, respectively.

Figure 46:
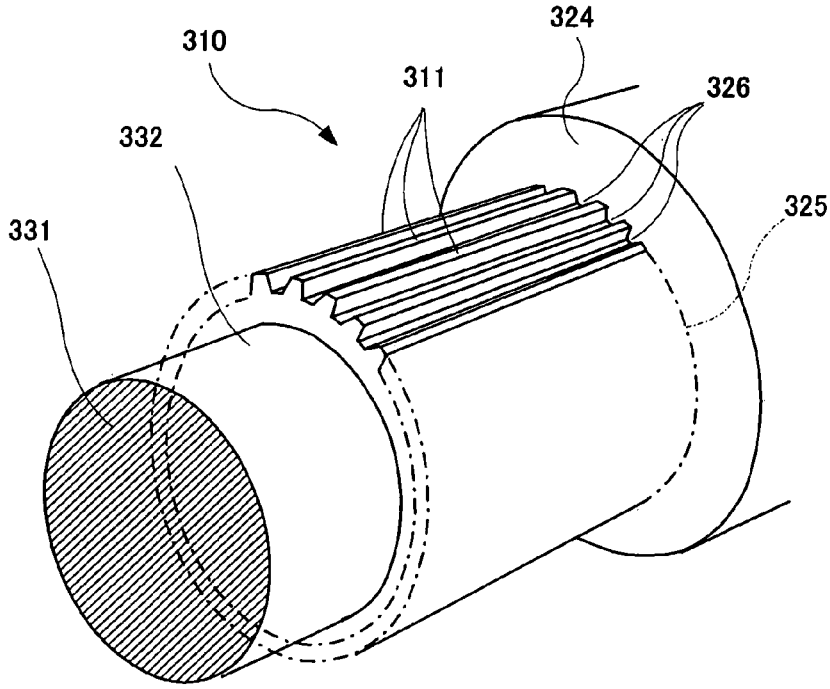
FIG. 46 is a perspective view of the sleeve used as a component of the marine reversing gear assembly shown in FIG. 44.

FIG. 46 is an exploded perspective view of a structure therefor. The sleeve 310 is fitted to the outer surface of the input connecting portion 332 by shrink fitting. This shrink fitting can be done by heat expanding the sleeve 310 having a smaller diameter than the input connecting portion 332 and forcibly fitting the sleeve 310 over the input connecting portion 332 when the inner diameter of the sleeve 310 becomes at least as large as the outer diameter of the input connecting portion 332, followed by thermal contraction while cooling to room temperature, thereby interference fitting.

Splines 311 are provided on the outer surface of the sleeve 310 and configured so that the splines 311 fit into connecting splines 326 of the output connecting port 325 provided at the center of the inner ring 323*c*.

Figure 47:
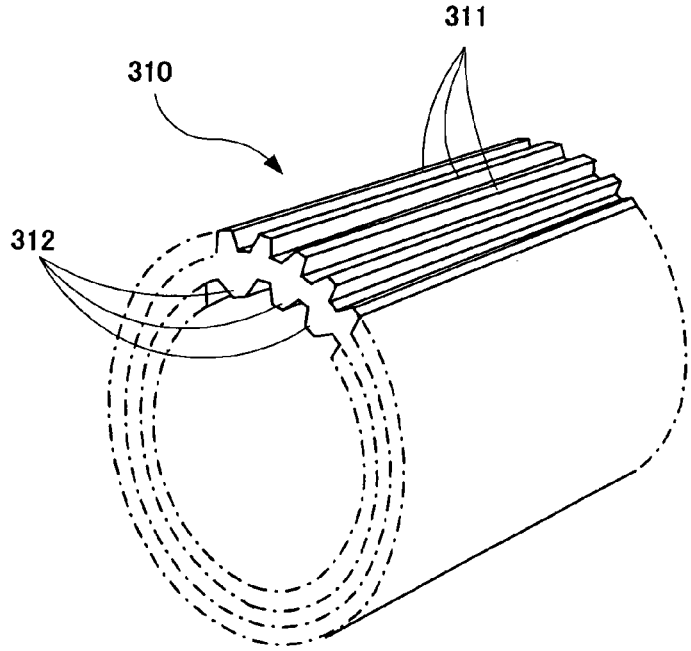
FIG. 47 is a perspective view of another structural embodiment of the sleeve.

FIG. 47 is a perspective view illustrating another structural embodiment of the sleeve 310. The sleeve 310 according to this embodiment is configured so that the inner surface has splines 312 that fit over splines 338 (FIG. 45) formed on the outer surface of the input connecting portion 332, while the outer surface has splines 311 that fit into connecting splines 326 formed on the inner surface of the output connecting port 325.

In this case, the sleeve 310 is axially fitted forcibly over the outer surface of the input connecting portion 332 and splines 338 and 312 are mated to one another to firmly secure the sleeve 310. The sleeve 310 is then inserted into the output connecting port 325 and splines 311 and 326 are mated to one another to connect the output connecting port 325 of the engine 302 side and to the input connecting portion 332 via the sleeve 310.

Figure 48:
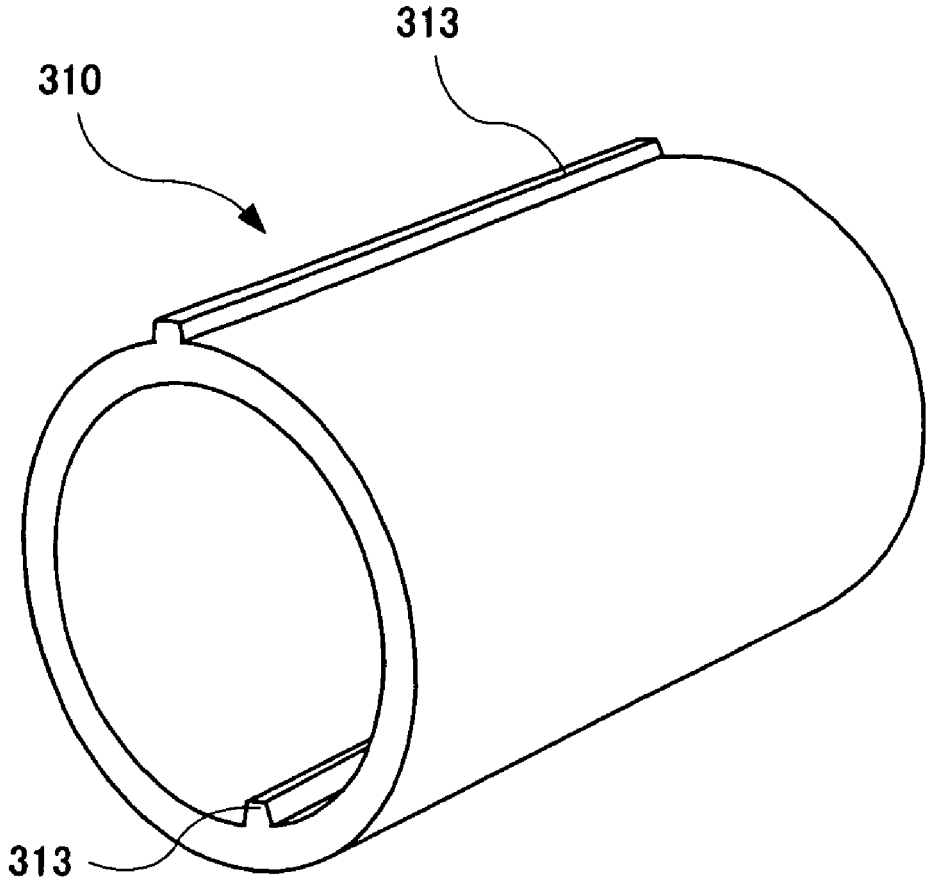
FIG. 48 is a perspective view of another structural embodiment of the sleeve.

FIG. 48 shows another structural embodiment of the sleeve 310. Key 313 is axially formed on the inner and outer surfaces of the sleeve 310. The key 313 fits into key groove (not shown) formed on the inner surface of the output connecting port 325 and the outer surface of the input connecting portion 332 so as to connect the output connecting port 325 and the input shaft 331.

Accordingly, a connection can be easily made by the sleeve 310 even when there is a difference between the inner diameter of the output connecting port 325 on the engine 302 side and the outer diameter of the input connecting portion 332 on the marine reversing gear assembly 303 side.

A connection of a shaft of the marine reversing gear assembly 303 is present not only between the elastic coupling 323 and the input connecting portion 332 but also between the output shaft 305 and the propeller shaft 306.

Figure 49:
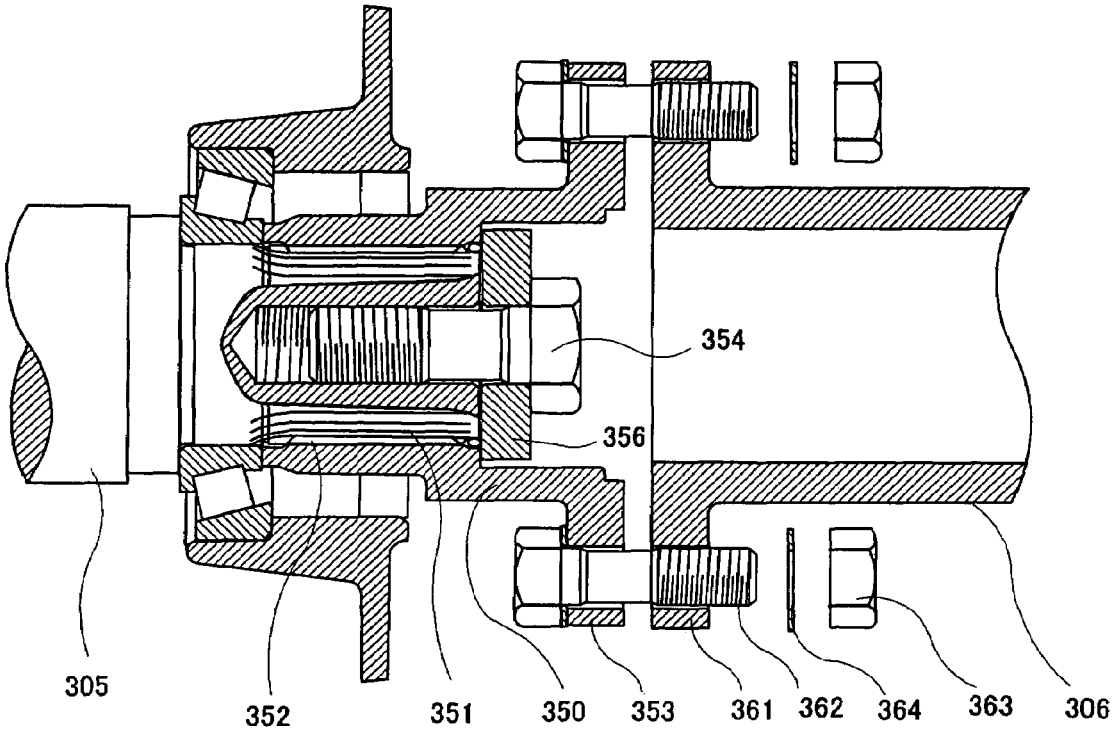
FIG. 49 is a partial enlarged sectional view of a connection structure between an output shaft and a coupling.
Figure 50:
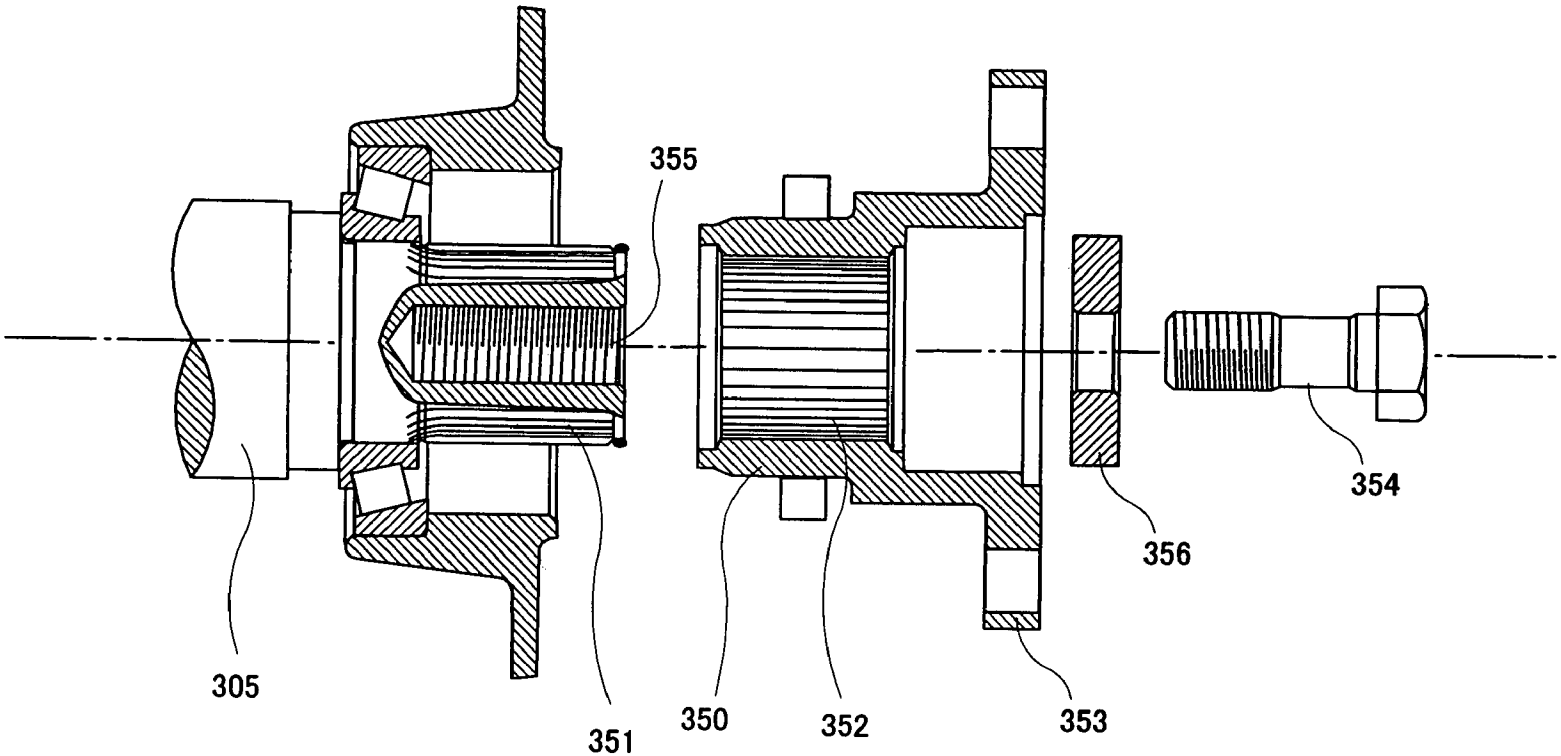
FIG. 50 is an exploded sectional view of the connection structure between the output shaft and the coupling shown in FIG. 49.

FIG. 49 is an enlarged sectional view of the main portion of a connection between the output shaft 305 and the propeller shaft 306. FIG. 50 is an exploded sectional view of the same.

In FIGS. 49 and 50, the output 305 and the propeller shaft 306 are connected via a coupling 350. To allow high torque transmission as mentioned above, the connection between the output shaft 305 and the coupling 350 is securely made by axially mating splines 351 provided on the outer circumference at the end of the output shaft 305 to the coupling 350 having a spline 352 provided on the inner surface, placing a washer to prevent the coupling 350 from escaping from the output shaft 305, and tightening a bolt 354 on the end face of the output shaft 305 to secure the coupling 350 on the output shaft 305.

The flange 361 of the propeller shaft 306 is firmly attached by bolts 362 and nuts 363 to the flange 353 formed on the coupling 350. In FIG. 49, a reference numeral 364 denotes a washer for the nut 363.

Figure 51:
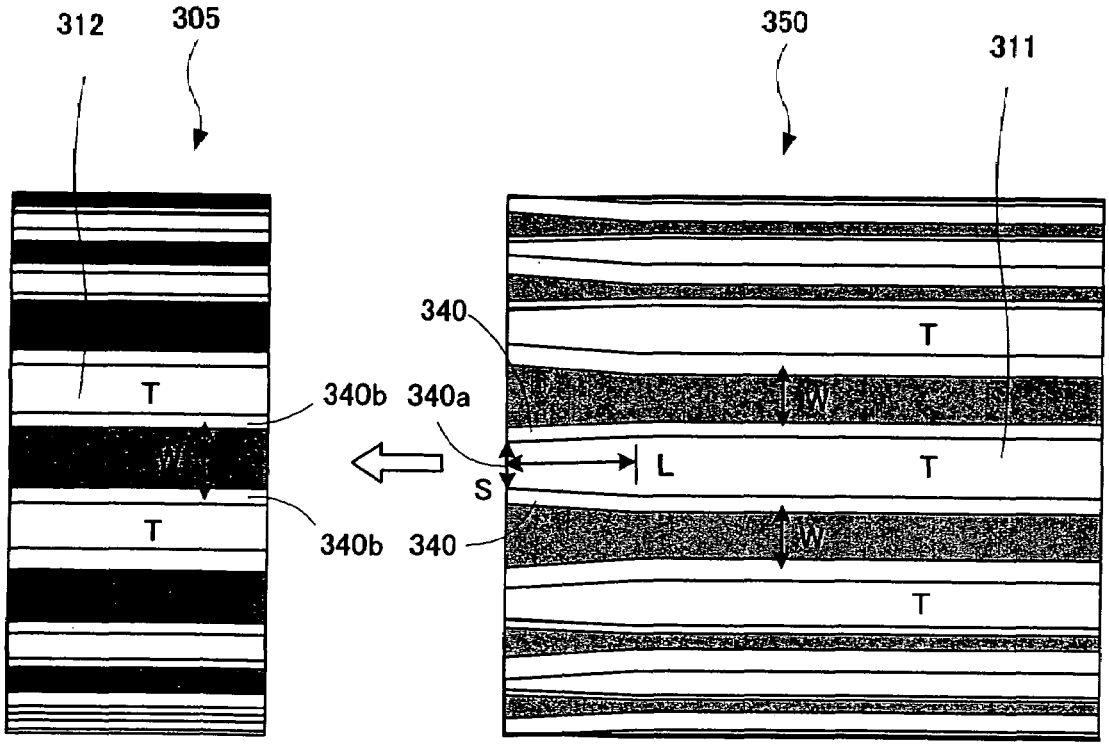
FIG. 51 is a plan view of sleeve splines.

FIG. 51 is a plan view of a spline tooth configuration for preventing the generation of shavings when the coupling 350 is connected to the output shaft 305 by splines.

In FIG. 51, the splines formed on the connection of the coupling 350 have teeth T whose thickness S is smaller than the gap W between the teeth of the corresponding spline 312 of the output shaft 305 only in the portion of length "L" from the shaft end of the spline 352, so that the sides of the teeth 340 come into contact with the inner surfaces 340*b* of the grooves of the corresponding splines.

In this case, when splines 352 are inserted into the grooves of corresponding splines 351, the surface of tooth tip 340*a* is prevented from shaving the inner surface 340*b* of the groove of the corresponding spline 351, thereby suppressing the generation of shavings.

Furthermore, when the splines 352 and 351 are axially engaged with one another, the portion having a small thickness "s" functions as a guide so as to facilitate the insertion. Moreover, even when the central axes of the splines 352 and 351 deviate from each other, axial deviation can be corrected during the insertion. Therefore, the generation of unwanted shavings can also be prevented.

Length L should be about 3% to about 15% of the overall length of the spline. If the length is less than 3%, a satisfactory anti-shaving effect cannot be obtained, whereas if the length is over 15%, the effective length for torque transmission is reduced, which may result in insufficient strength for torque transmission.

Further, the teeth of the splines 352 with a smaller thickness "S" may be configured to be harder than the teeth T of the corresponding connecting splines 351.

With this construction, it is also possible during the insertion of the spline with the hardened teeth to connect while compressively deforming the teeth of the corresponding splines 351 peripherally, so that a connection structure capable of withstanding a higher torque transmission without generating shavings can be provided.

The above structures of the splines 352, 351 are not limited to those between the output shaft 305 and the coupling 350 but are likewise applicable to the splines 311 and 312 of the sleeve 310 inserted between the output connecting port 325 of the engine and the input connecting portion 332 of the input shaft 331.

The thrust bearing 343 of the gears of the marine reversing gear assembly 303 is described below.

Figure 52:
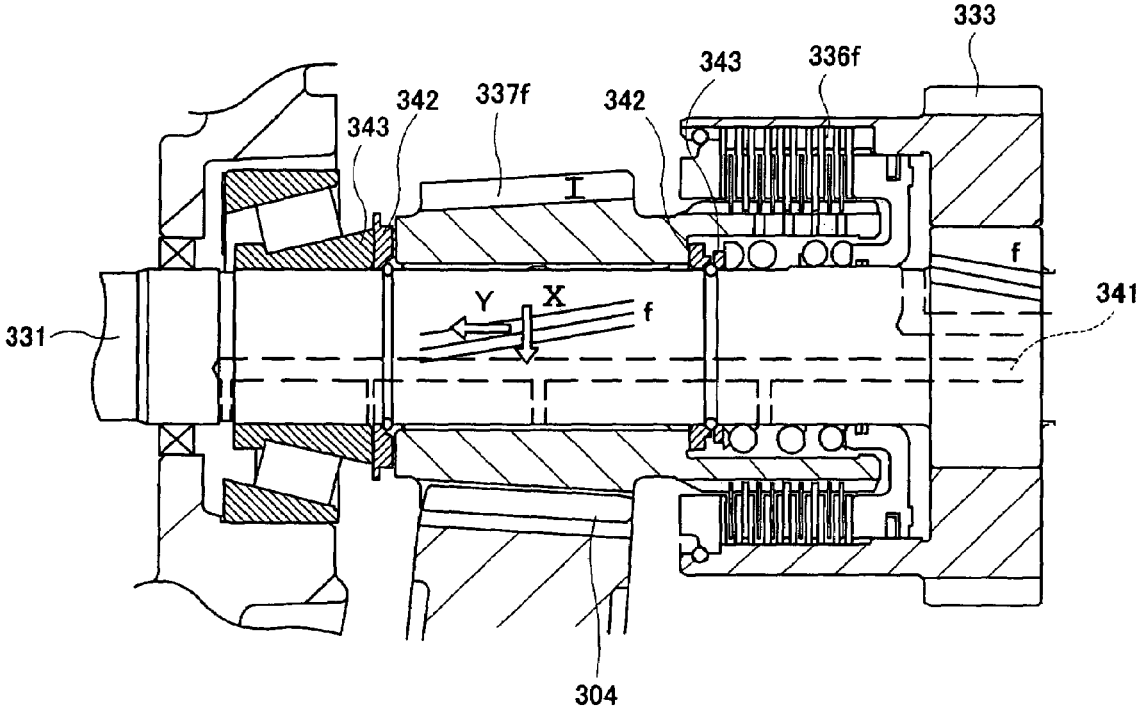
FIG. 52 is a partial enlarged sectional view illustrating the engagement of a pinion with a large output gear.
Figure 53:
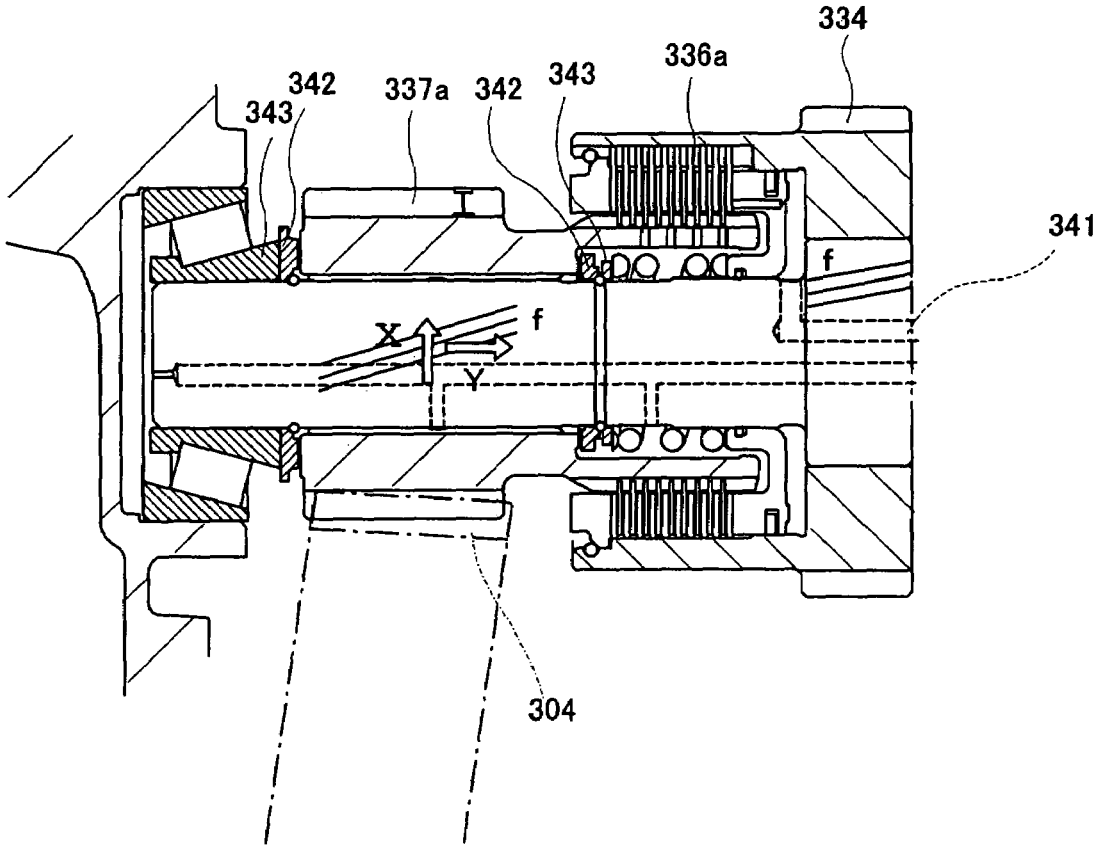
FIG. 53 is a sectional view taken along arrows A—A of FIG. 44, and is a partial enlarged sectional view illustrating the engagement of the pinion on the support shaft with the large output gear.

Gears 304, 333 and 334 and the like provided in the marine reversing gear assembly 303, such as pinion 337*f* (FIG. 52) and pinion 337*a* (FIG. 53) shown in FIG. 44, FIG. 52 (a partial enlarged view of FIG. 44), and FIG. 53, are often configured to be helical gears to smoothly transmit rotation. In these Figs., the slanted lines "f" represent the directions of thread helices of helical gears.

Accordingly, as shown in FIG. 52, when torque is transmitted from the pinion 337*f* to the large output gear 304, an axial thrust force Y is generated according to the tilt angle of the thread helix "f" relative to the rotational direction X of the gear. To counteract the thrust force Y, the pinion 337*f* is supported by thrust bearings 343 via thrust collars 342 used as sliding members.

According to this embodiment, when the engine 302 output rotation is counterclockwise as seen from the stern and the propeller rotates clockwise as seen from the stern for forward movement, the teeth T of the forward pinion 337*f* shown in FIG. 52 translate downward as shown by arrow X (in FIG. 52), and rotational resistance to the water at the propeller is constantly applied to the propeller shaft 306. Therefore, the thrust that acts on the pinion 337*f* is always applied to the left of FIG. 52 as shown by arrow Y and little thrust is generated in the right direction.

In contrast, as shown in FIG. 53, the teeth T of the reverse pinion 337*a* translate upward as shown by arrow X (in FIG. 53), and rotational resistance to the water at the propeller is constantly applied to the propeller shaft 306. Therefore, the thrust that acts on the pinion 337*a* is always applied to the right of FIG. 53 as shown by arrow Y and little thrust is generated in the left direction.

In small crafts, there are cases in which thrust always act in one direction as described above, depending on the purpose of use. In such a case, the antifriction lining for the right-hand thrust collar 342 provided for the pinion 337*f* shown in FIG. 52 and the antifriction lining for the left-hand thrust collar 342 provided for the pinion 337*a* shown in FIG. 53 can be omitted.

Therefore, the low-friction treatment for the thrust collars 342 can be simplified to that extent. It is also possible to omit the thrust collars 342 themselves that have no linings.

Alternatively, as a low-friction treatment, the thrust collars 342 of the thrust shaft 343 may be subjected to a fine particle peening surface treatment. A fine particle peening surface treatment is a surface treatment comprising blowing fine steel spherules with a particle diameter of 10 to 20 microns onto the surface of a metal by high pressure compressed air. Numerous minute pits and bumps formed on the metal surface by the fine steel spherules provides the surface with better oil retentivity, and the impact of the fine steel spherules increases the residual compression stress of the metal surface, thus extending the fatigue time of the metal and increasing the surface strength.

Therefore, such a treatment can simplify the low-friction treatment for a thrust collar 342 used as a sliding member and extend the lifetime.

According to the marine reversing gear assembly configured as above, even when the input shaft of the marine reversing gear assembly has a diameter different from that of the engine coupling member, the coupling member can be easily connected by attaching to the input shaft one of the sleeves prepared in advance having various inner and outer diameters and various types of splines.

Furthermore, the generation of shavings as conventionally generated during spline connection in the marine reversing gear assembly as mentioned above can be greatly suppressed. Moreover, a marine reversing gear assembly can be provided at low cost due to the omission of low-friction members used in consideration of thrust, or by simplification of the low-friction treatment.

As is clear from the descriptions referring to FIGS. 44 to 54, the marine reversing gear assembly 303 preferably comprises: an input shaft 331 having an input connecting portion 332 at the front end and provided with an input gear 333; a support shaft 335 having an intermediate gear 334 engaged with the input gear 333 and supported in parallel with the input shaft 331; pinions 337*f* and 337*a* rotably supported on the input shaft 331 and support shaft 335 and disconnectably connected to the input gear 333 or the intermediate gear 334 via clutches 336*f* and 336*a*, respectively; an output shaft 305 having a large output gear 304 engaged with the pinions 337*f* and 337*a*; and an output connection 350 disposed at the propeller-side stern side; wherein a sleeve 310, which has an inner circumference fitting over the outer circumference of the input connecting portion 332 and has an outer circumference fitting into the inner surface of the output connecting port 325, is fitted over the input connecting portion 332 so as to fill the gap generated by the difference between the outer diameter of the input shaft 331 and the inner diameter of the output connecting port 325 of the engine side. With such a configuration, even when there is a difference in diameter between the output connecting port 325 of the coupling member and the input shaft 331 of the marine reversing gear assembly, a connection can be made by selectively using a sleeve 310 of different thickness to fill the gap. By preparing in advance several sleeves 310 with various male and female splines according to the anticipated diameter differences and spline types, a coupling member and a marine reversing gear assembly can be easily connected to each other even when they are of different types. Furthermore, since the sleeve 310 has a simple structure, it can be easily used.

In the above embodiment, the sleeve 310 is preferably secured to the engine-side front end of the input shaft 331 by shrink fitting and configured so that the outer periphery of the sleeve 310 fits into the engine output connecting port 325 by splines. Alternatively and preferably, connecting splines that fit to splines on the outer periphery of the input connecting portion 332 of the input shaft 331 and the inner periphery of the output connecting port 325 of the engine are provided on the inner and outer peripheries of the sleeve 310, respectively and are configured so that the engine output connection and the engine-side front end of the input shaft are connected via the sleeve by the connecting splines.

Alternatively and preferably, keys 313 may be provided on the inner and outer peripheries of the sleeve and configured so that the engine-side output connecting port and the input connection of the input shaft are connected by fitting the keys into key grooves provided on the input connection of the input shaft and the engine-side output connecting port.

With respect to the connection between the output shaft and the propeller shaft, preferably, splines are provided on the outer periphery of the end of the output shaft having a large output gear, and splines that match these splines are provided on the inner periphery of the end of the coupling shaft with a flange that connects with the propeller shaft, so that the output shaft and the coupling are connected to each other by axially inserting and fitting these latter splines to the former splines provided on the outer periphery of the output shaft.

In the case of spline-type connection, the teeth of the splines are preferably configured to be thinner than the gap between the teeth of the corresponding splines only at the end of the shaft, and further preferably, the teeth of such thin-toothed splines are harder than the teeth of the corresponding splines.

When the teeth of the connecting splines are configured to be thinner than the gap between the teeth of the corresponding connecting splines only at the end of the shaft, initial axial insertion becomes very easy and the amount of shavings generated during axial insertion can be greatly reduced.

In this case, if the teeth of the thin-toothed splines are configured to be harder than the teeth of the corresponding splines, the teeth of the corresponding splines can be compressively deformed without being shaved, thereby suppressing the generation of shavings.

When the teeth of the pinion and the large output gear are helical, low-friction linings for sliding members provided for the input shaft and the thrust bearing that supports the pinion on the support shaft are preferably provided only on the side to which thrust is applied, or sliding members for the input shaft and the thrust bearing that supports the pinion on the support shaft are preferably provided only on the side of the input shaft and the thrust bearing to which thrust is applied.

When the teeth of the pinion and the large output gear are helical, the structure can be simplified if low-friction linings for sliding members provided for the thrust bearing or the sliding members themselves are provided only on the side to which thrust is applied.

With respect to sliding materials provided for the thrust bearing, the surfaces that face the pinion are preferably subjected to a fine particle peening treatment.

What is claimed is:

1. A marine reversing gear assembly, wherein a manual directional control valve and an electromagnetic directional control valve for a forward/reverse directional control valve for a hydraulic oil supply line have a common structure of an oil line joint surface for the hydraulic oil supply lines for a forward clutch and a reverse clutch, and the forward/reverse directional control valve for the hydraulic oil supply line can be changed to either the manual directional control valve or the electromagnetic directional control valve by exchanging a spool of the manual directional control valve or the electromagnetic directional control valve.

2. The marine reversing gear assembly according to claim 1, wherein a directional control valve for supplying hydraulic oil to a loose-fitting valve provided for regulating hydraulic oil pressure in the hydraulic oil supply line is equipped with a restrictor for adjusting hydraulic oil pressure applied to the loose-fitting valve.

3. The marine reversing gear assembly according to claim 1, wherein a spool of the manual directional control valve is a cylindrical rotator to be received in a cylinder, the spool being provided on its outer peripheral surface with circumferential grooves which correspond to hydraulic oil communicating openings that are open at a plurality of positions on the inner surface of the cylinder and axial grooves, which axially communicate with these circumferential grooves, communicating state of the openings can be selected by rotating the spool around the axis inside the cylinder, a spool of the electromagnetic valve is axially inserted in a slidable manner in an adapter sleeve to be received in the cylinder, circumferential grooves formed at the outer peripheral surface of the spool of the electromagnetic valve communicate via the adapter sleeve with the hydraulic oil communicating openings that open at a plurality of positions on the inner surface of the cylinder, and communicating state of the openings at the inner surface of the cylinder can be selected by axially sliding the spool.

4. The marine reversing gear assembly according to claim 1, wherein the spool of the manual directional control valve has an axially extending oil passage that is formed in the axial center, the axially extending oil passage communicates with at least one of the circumferential grooves and the axial grooves, and the cylinder is provided with apertures that communicate with the axially extending oil passage.

5. The marine reversing gear assembly according to claim 1, wherein the adapter sleeve of the electromagnetic adapter sleeve has a dual structure of an outer sleeve and an inner sleeve, the outer sleeve is provided with radial oil through passages that communicate, on the outer surface of the outer sleeve, with the hydraulic oil communicating openings formed at a plurality of positions on the inner surface of the cylinder and that open, on the inner surface of the outer sleeve, toward a concave portion for forming an oil passage that is formed on the outer surface of the inner sleeve, and the inner sleeve is provided with radial openings that communicate with the radial oil through passages opening on the inner surface of the outer sleeve and that open at positions corresponding to the circumferential grooves formed at the outer peripheral surface of the spool that is disposed inside the inner sleeve.

6. The marine reversing gear assembly according to claim 1, wherein the spool of the electromagnetic directional control valve is provided at the shaft center with an axially extending oil passage, at least one of the circumferential grooves on the outer peripheral surface communicate with the axially extending oil passage, and an opening communicating with the axially extending oil passage is formed on the cylinder.

7. The marine reversing gear assembly according to claim 1, wherein the manual directional control valve and the electromagnetic directional control valve are disposed beforehand in parallel in the hydraulic oil supply line, as a forward/reverse directional control valve for hydraulic oil supply to the forward and reverse clutches, and either the manual directional control valve or the electromagnetic valve can be suitably selected by a directional control valve of the oil passage.

8. The marine reversing gear assembly according to claim 1, wherein the spool of the electromagnetic directional control valve is configured to be able to be axially shifted by manual operation so as to change the oil line.

9. The marine reversing gear assembly according to claim 1, wherein the operation of the loose-fitting valve is controlled by a directional control valve that is operated by using oil pressure of the hydraulic oil supply line as a pilot pressure.

10. The marine reversing gear assembly according to claim 1, wherein the operation of the loose-fitting valve is controlled by a directional control valve that is directly operated by oil pressure of the hydraulic oil supply line.

11. The marine reversing gear assembly according to claim 1, wherein a restrictor for controlling flow rate is provided inside the directional control valve so as to control the operation of the loose-fitting valve, the restrictor is provided with a cylinder in which a hydraulic oil supply port and a hydraulic oil discharge port are open, on the inner surface, and a plurality of pistons each having a hydraulic oil guide groove, on the outer peripheral surface, extending from the hydraulic oil supply port to the hydraulic oil discharge port, and the restriction amount thereof is adjustable by selectively inserting into the cylinder some of the pistons each with a different capacity of the hydraulic oil guide passage in a slidable manner.

12. The marine reversing gear assembly according to claim 11, wherein the hydraulic oil guide groove is provided spirally on the outer peripheral surface of the piston, and the capacity of the hydraulic oil guide groove is varied by varying a spiral length.

13. The marine reversing gear assembly according to claim 11 or 12, wherein the capacity of the hydraulic oil guide groove is varied by varying a cross-sectional area of the hydraulic oil guide groove.

14. A marine reversing gear assembly with a trolling device, the trolling device being configured in such a manner as to enable trolling by slippage of friction discs caused by lowering the hydraulic oil pressure applied to friction discs of a forward clutch or a reverse clutch, which can be suitably changed, and by lowering the ship speed by reducing the rotation of an output shaft to be less than that of an input shaft, wherein either a mechanically-operated hydraulic oil pressure adjusting element or an electrically-operated hydraulic oil pressure adjusting element can be applied as a hydraulic oil pressure adjusting element for trolling to be attached to a hydraulic oil supply element for the forward clutch and the reverse clutch, and either one of the mechanically-operated or electrically-operated hydraulic oil pressure adjusting element suitably selected can be attached to the hydraulic oil supply element.

15. The marine reversing gear assembly according to claim 14, wherein the mechanically-operated hydraulic oil adjusting element and the electrically-operated hydraulic oil pressure adjusting element have a common attachment to the hydraulic oil supply element, and either the mechanically-operated hydraulic oil adjusting element or the electrically-operated hydraulic oil pressure adjusting element can be attached to the one attachment site formed on the hydraulic oil supply element.

16. The marine reversing gear assembly according to claim 14, wherein the attachment site on the side of the hydraulic oil supply element to which the mechanically-operated hydraulic oil pressure adjusting element or the electrically-operated hydraulic oil pressure adjusting element is attached can be sealed with a cover.

17. The marine reversing gear assembly with a trolling device according to claim 14, wherein the hydraulic oil supply element comprises the hydraulic oil supply lines for the forward clutch and the reverse clutch, and a hydraulic line casing for encasing the hydraulic oil supply line is connected to a gear casing for accommodating the forward clutch and the reverse clutch.

18. The marine reversing gear assembly with a trolling device according to claim 14, further comprises marks provided on the outer peripheral surface of the input/output shaft of the forward clutch and the reverse clutch, and a sensor that is fixed opposite the marks and that detects the number of revolutions of an input/output shaft to the electrically-operated hydraulic oil pressure adjusting element, wherein the sensor counts the number of times that the mark passes the sensor per a certain period of time while the input/output shaft rotates, thereby detecting the number of revolutions of the input/output shaft.

19. The marine reversing gear assembly according to claim 18, wherein the marks are dot-like magnets and the sensor is a magnetic sensor.

20. The marine reversing gear assembly with a trolling device according to claim 19, wherein the dot-like magnet mark is adhered to the outer peripheral surface of the input/output shaft with tape.

21. The marine reversing gear assembly with a trolling device according to claim 19, wherein the dot-like magnet mark is embedded in a depression part formed around the shaft.

22. The marine reversing gear assembly with a trolling device according to claim 18, wherein the marks are spline teeth formed at a shaft end, and the sensor is a sensor for detecting the spline teeth.

* * * * *